US009768507B2

(12) United States Patent
Rajgopal et al.

(10) Patent No.: US 9,768,507 B2
(45) Date of Patent: Sep. 19, 2017

(54) ANTENNA DEVICES HAVING FREQUENCY-DEPENDENT CONNECTION TO ELECTRICAL GROUND

(71) Applicant: Tyco Electronics Services GmbH, Schaffhausen (CH)

(72) Inventors: Sunil Kumar Rajgopal, San Diego, CA (US); Cheng Jung Lee, Santa Clara, CA (US); Ajay Gummalla, Sunnyvale, CA (US)

(73) Assignee: Tyco Electronics Services GmbH (CH)

( * ) Notice: Subject to any disclaimer, the term of this patent is extended or adjusted under 35 U.S.C. 154(b) by 237 days.

(21) Appl. No.: 14/467,708

(22) Filed: Aug. 25, 2014

(65) Prior Publication Data

US 2015/0102968 A1 Apr. 16, 2015

Related U.S. Application Data

(63) Continuation of application No. 12/649,906, filed on Dec. 30, 2009, now Pat. No. 8,816,912.

(51) Int. Cl.

| | |
|---|---|
| ***H01Q 5/328*** | (2015.01) |
| ***H01Q 9/04*** | (2006.01) |
| ***H01Q 1/22*** | (2006.01) |
| ***H01Q 1/48*** | (2006.01) |
| ***H01Q 15/00*** | (2006.01) |
| ***H01Q 9/42*** | (2006.01) |
| ***H01P 1/203*** | (2006.01) |
| ***H01P 3/08*** | (2006.01) |

(52) U.S. Cl.

CPC ..... *H01Q 5/328* (2015.01); *H01P 1/203* (2013.01); *H01P 3/081* (2013.01); *H01Q 1/2275* (2013.01); *H01Q 1/48* (2013.01); *H01Q 9/0407* (2013.01); *H01Q 9/42* (2013.01); *H01Q 15/008* (2013.01); *H01Q 15/0086* (2013.01)

(58) Field of Classification Search

None

See application file for complete search history.

(56) References Cited

U.S. PATENT DOCUMENTS

| | | | | |
|---|---|---|---|---|
| 7,592,957 | B2 | 9/2009 | Achour et al. | |
| 8,816,912 | B2 | 8/2014 | Rajgopal et al. | |
| 2007/0159401 | A1* | 7/2007 | Baliarda ..... | H01Q 1/241 343/702 |

(Continued)

FOREIGN PATENT DOCUMENTS

| | | |
|---|---|---|
| CN | 1778014 A | 5/2006 |
| CN | 1918744 A | 2/2007 |

(Continued)

OTHER PUBLICATIONS

"International Application Serial No. PCT/US2009/069840, Search Report mailed Jun. 30, 2010", 3 pgs.

(Continued)

*Primary Examiner* — Robert Karacsony

(57) ABSTRACT

Antenna devices and techniques that provide specific control of the spatial distributions of DC and RF signals at various positions in a wireless apparatus are disclosed. The wireless apparatus includes various device components each having specifications for achieving desired operations in antenna devices.

13 Claims, 41 Drawing Sheets

(56) References Cited

U.S. PATENT DOCUMENTS

| | | | | |
|---|---|---|---|---|
| 2008/0143609 | A1* | 6/2008 | Mashima | H01Q 1/243 343/702 |
| 2008/0258981 | A1 | 10/2008 | Achour et al. | |
| 2009/0085815 | A1 | 4/2009 | Jakab et al. | |
| 2009/0091507 | A1 | 4/2009 | Chung et al. | |
| 2009/0102728 | A1 | 4/2009 | Gamand et al. | |
| 2009/0128446 | A1 | 5/2009 | Gummalla et al. | |
| 2009/0135087 | A1 | 5/2009 | Gummalla et al. | |
| 2009/0295660 | A1 | 12/2009 | Xu et al. | |
| 2011/0156963 | A1 | 6/2011 | Rajgopal et al. | |

FOREIGN PATENT DOCUMENTS

| | | | |
|---|---|---|---|
| CN | 101573833 | A | 11/2009 |
| CN | 102859791 | A | 1/2013 |
| JP | 11163756 | A | 6/1999 |
| JP | 2005086632 | A | 3/2005 |
| JP | 2006166370 | A | 6/2006 |
| JP | 2009535942 | A | 10/2009 |
| JP | 2009303204 | A | 12/2009 |
| JP | 5599472 | B2 | 8/2014 |
| KR | 10-2012-0109595 | | 10/2012 |
| WO | WO-2011081630 | A1 | 7/2011 |

OTHER PUBLICATIONS

"International Application Serial No. PCT/US2009/069840, Written Opinion mailed Jun. 30, 2010", 6 pgs.
"Japanese Application Serial No. 2012-547055, Response filed Jun. 3, 2014", with English translation of claims, 14 pgs.
"Japanese Application Serial No. 2012-547055, Voluntary Amendment filed Dec. 19, 2012", with English translation of claims, 17 pgs.
"Korean Application Serial No. 10-2012-7019943, Office Action mailed May 26, 2016", with English translation, 6 pgs.
"Korean Application Serial No. 10-2012-7019943, Office Action mailed Sep. 21, 2015", w/ English Translation, 8 pgs.
"Korean Application Serial No. 10-2012-7019943, Response filed Jan. 21, 2016 to Office Action mailed Sep. 21, 2015", (English Translation of Claims), 16 pgs.
"Korean Application Serial No. 10-2012-7019943, Response filed Jul. 26, 2016 to Office Action mailed May 26, 2016", with English translation of claims, 14 pgs.
U.S. Appl. No. 12/649,906, filed Dec. 30, 2009, Antenna Devices Having Frequency-Dependent Connection to Electrical Ground.
"Chinese Application Serial No. 200980163486.8 Response filed Dec. 24, 2014 to Non-Final Office Action mailed Oct. 10, 2014", (W/ English Translation), 13 pgs.
"U.S. Appl. No. 12/649,906, Response filed Aug. 29, 2013 to Non-Final Office Action mailed Apr. 29, 2013", 11 pgs.
"U.S. Appl. No. 12/649,906, Corrected Notice of Allowance mailed Jul. 16, 2014", 4 pgs.
"U.S. Appl. No. 12/649,906, Final Office Action mailed Oct. 7, 2013", 6 pgs.
"U.S. Appl. No. 12/649,906, Non Final Office Action mailed Apr. 29, 2013", 8 pgs.
"U.S. Appl. No. 12/649,906, Notice of Allowance mailed Apr. 15, 2014", 7 pgs.
"U.S. Appl. No. 12/649,906, Response filed Mar. 28, 2014 to Final Office Action mailed Oct. 7, 2013", 10 pgs.
"U.S. Appl. No. 12/649,906, Response filed Dec. 21, 2012 to Restriction Requirement mailed Nov. 23, 2012", 14 pgs.
"U.S. Appl. No. 12/649,906, Restriction Requirement mailed Nov. 23, 2012", 5 pgs.
"Chinese Application Serial No. 200980163486.8 Response filed Dec. 24, 2014 to Non-Final Office Action mailed Oct. 10, 2014", 9 pgs.
"Chinese Application Serial No. 200980163486.8, Office Action mailed Mar. 5, 2014", (W/ English Translation), 9 pgs.
"Chinese Application Serial No. 200980163486.8, Office Action mailed Oct. 10, 2014", (W/ English Translation), 9 pgs.
"International Application No. PCT/US2009/069840, International Report on Patentability and Written Opinion mailed Jul. 12, 2012", 8 pgs.
"Japanese Application Serial No. 2012-547055, Office Action mailed Mar. 4, 2014", (W/ English Translation), 2 pgs.
"Korean Application Serial No. 10-2012-7019943, Amendment filed Jul. 31, 2012", (W/ English Translation of Claims), 28 pgs.

* cited by examiner

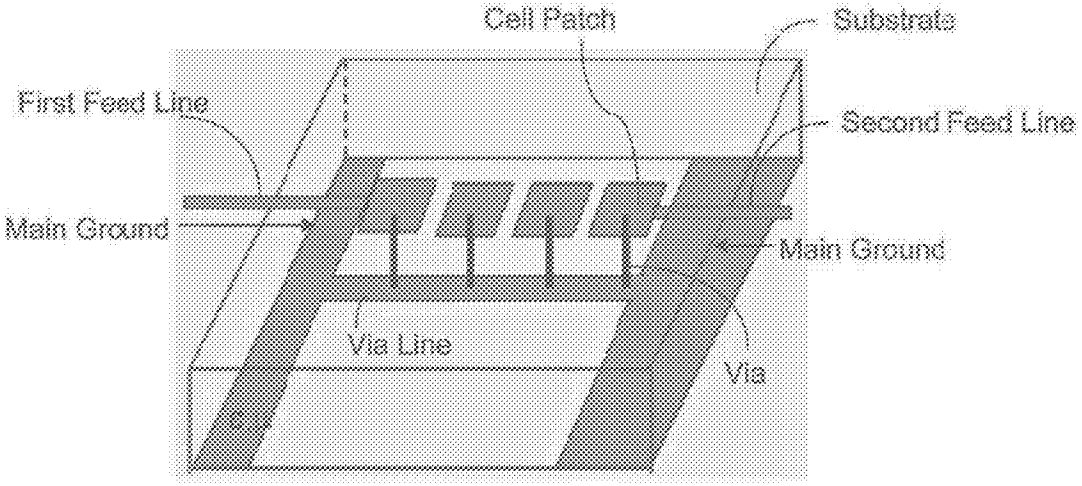
FIG. 8
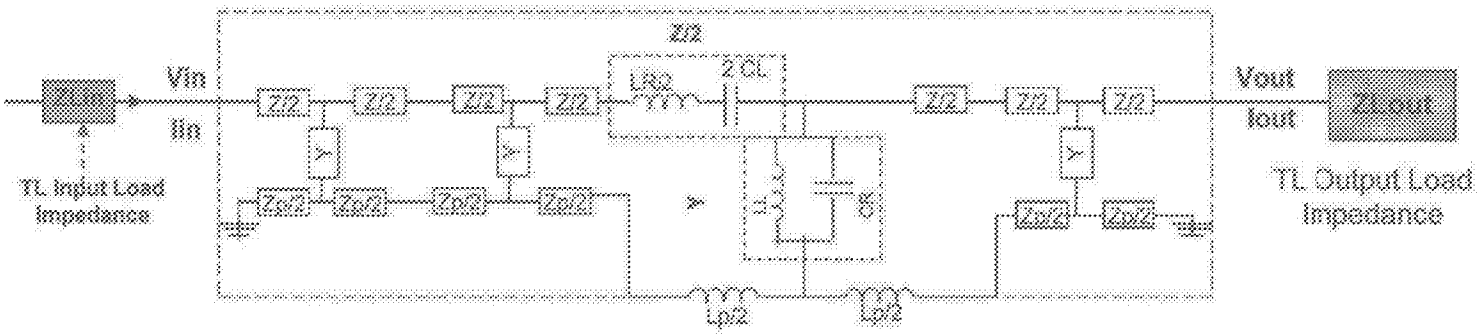
Vout
Iout
TL Output Load Impedance
Z2
Z2
Z2

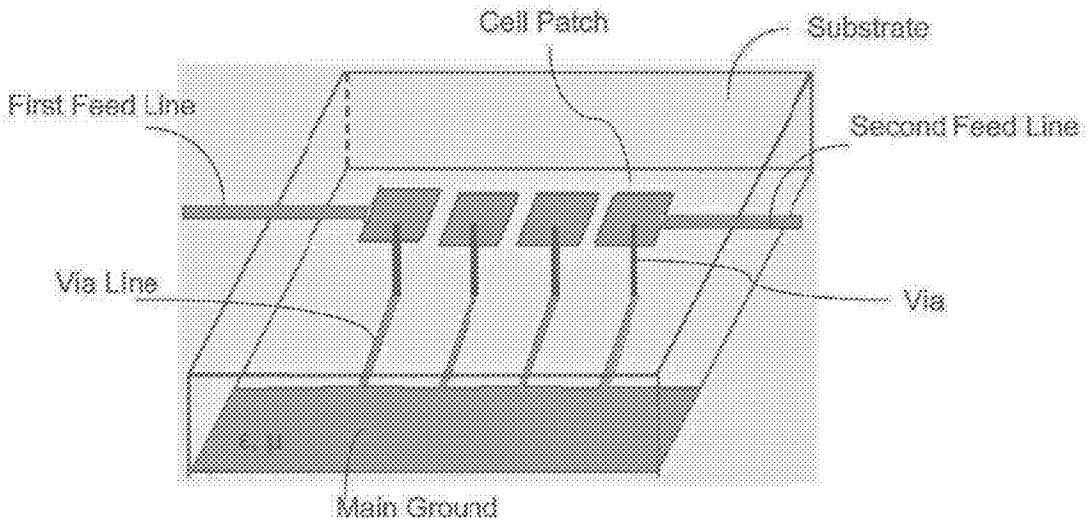
FIG. 11
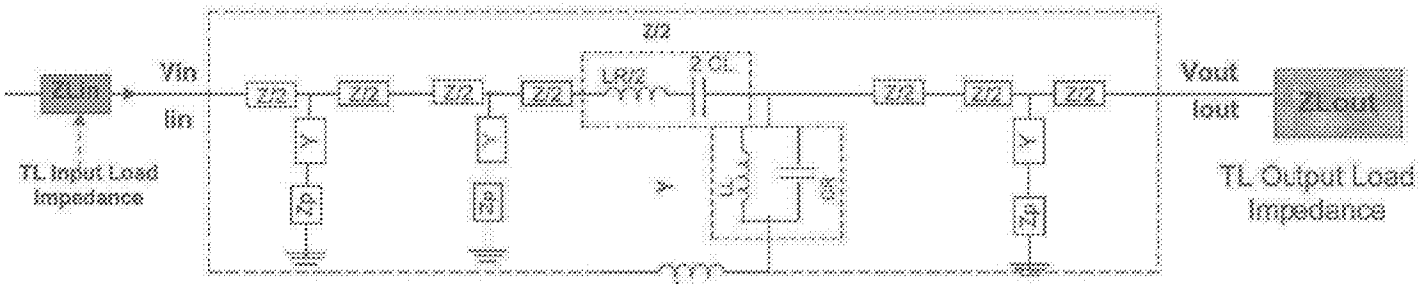
Vout
Iout
TL Output Load Impedance
Z2
Z2
Z2

ANTENNA DEVICES HAVING FREQUENCY-DEPENDENT CONNECTION TO ELECTRICAL GROUND

BACKGROUND

As designers continue to add communication functionality to more and more devices, antenna circuits are developed to communicate in a variety of scenarios. Within a single device, multiple applications may operate incorporating antennas as transmitters, receivers or both. The combination of communication signals with such a variety of applications requires direct-current (DC) and RF signals to co-exist at various points without interfering with operation of these device components. A variety of configurations exist to implement antennas for these devices.

SUMMARY

This document describes, among others, antenna devices and techniques that provide proper control of spatial distributions of DC and RF signals at various device components for achieving desired operations in antenna devices.

BRIEF DESCRIPTION OF THE DRAWINGS

FIG. 8 illustrates a one dimensional composite right and left handed metamaterial transmission line with a truncated ground based on four unit cells, according to an example embodiment.

FIG. 9 illustrates an equivalent circuit of a one dimensional composite right and left handed metamaterial transmission line with the truncated ground as in FIG. 8, according to an example embodiment.

FIG. 11 illustrates another example of a one dimensional composite right and left handed metamaterial transmission line with a truncated ground based on four unit cells, according to an example embodiment.

FIG. 12 illustrates an equivalent circuit of the one dimensional composite right and left handed metamaterial transmission line with the truncated ground as in FIG. 11, according to an example embodiment.

Figure 1:
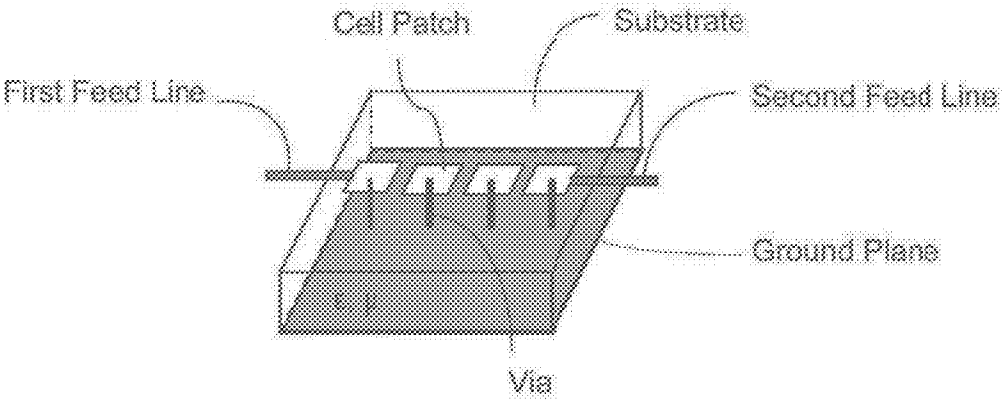
FIGS. 1-3 illustrate examples of one dimensional composite right and left handed metamaterial transmission lines based on four unit cells, according to example embodiments.

In the appended figures, similar components and/or features may have the same reference numeral. Further, various components of the same type are distinguished by a second label following the reference numeral. If only the first reference numeral is used in the specification, the description is applicable to any one of the similar components having the same first reference numeral irrespective of the second reference numeral.

DETAILED DESCRIPTION

The shape, dimension and location of an electrical ground structure in an antenna device may impact the spatial distribution of an RF antenna signal and thus the operation of the antenna device in receiving or transmitting the RF antenna signal. For antenna devices in some embodiments, an electric ground structure may be formed by one or more conductive ground electrodes and components located in a common metallization layer in or in different metallization layers. The shape, dimension and location of the electrical ground of a given antenna device tend to be fixed when an antenna device is manufactured. In operation, an antenna device is electrically coupled to other circuits or devices. This electrical coupling with other circuits or devices may alter the electromagnetic configuration of the antenna device such that the effective electrical ground for the antenna device for at least certain operations has an effective shape, dimension or both that are different from the original shape, dimension or both of the original electrical ground of the antenna device.

For example, the electrical ground of the antenna device may be permanently connected to an electrically conductive component of a circuit. This connection may alter the electromagnetic configuration of the antenna device. In another example, the antenna device may be removably connected to an electrically conductive component of another device where, after the other device is connected to the antenna device, the electrical ground of the antenna device can connected to an electrically conductive component of other device and this connection may alter the electromagnetic configuration of the antenna device. This connection may alter the electromagnetic configuration of the antenna device.

The altered electromagnetic configuration of the antenna device may degrade the antenna device performance in transmitting or receiving one or more RF antenna signals. The antenna devices and techniques described in this document include one or more frequency-dependent connectors to control the electromagnetic configuration of the antenna device at one or more operating RF frequencies of the antenna device. Such a frequency-dependent connector can be connected between the electrical ground electrode structure with one or more ground electrodes and another electrically conductive component or metal plate to vary the impedance of the connector to a signal depending on the frequency of the signal. For example, such a frequency-dependent connector can have a structure that produces a low impedance to allow for transmission of a DC signal between the electrically conductive component or metal plate and the ground electrode and produces a high impedance at the one or more RF antenna frequencies to block transmission of the one or more antenna signals between the electrically conductive component or metal plate and the ground electrode. In this specific example, the frequency-dependent connector can be an inductor or a circuit with the desired frequency-dependent behavior.

One implementation of an antenna device based on the above example can include one or more antennas that transmit or receive one or more antenna signals at one or more RF antenna frequencies, an antenna circuit in communication with the one or more antennas, and a ground electrode structure to which the antenna circuit is connected to provide an electrical ground for the antenna circuit and for the one or more antennas. The antenna circuit generates the one or more antenna signals for transmission by the one or more antennas or receives the one or more antenna signals from the one or more antennas. In this antenna device, an electrically conductive component or a metal plate is provided and is spaced from the ground electrode structure without being in direct contact with the ground electrode structure. A frequency-dependent connector is provided to connect the electrically conductive component or metal plate to the ground electrode structure and is structured to produce a low impedance to allow for transmission of a DC signal between the electrically conductive component or metal plate and the ground electrode structure and to produce a high impedance at the one or more RF antenna frequencies to block transmission of the one or more antenna signals between the electrically conductive component or metal plate and the ground electrode structure. The ground electrode structure can include a single ground electrode or a combination of two or more ground electrodes. The two or more ground electrodes may be in a common metallization layer or in two or more different metallization layers. In this example, the ground electrode structure is isolated by the frequency-dependent connector from the electrically conductive component or metal plate at the one or more RF antenna frequencies and is connected to the electrically conductive component or metal plate for a DC signal.

The one or more antennas in the above and other antenna devices described in this document may be in various antenna structures, including right-handed (RH) antenna structures and composite right and left handed (CRLH) metamaterial (MTM) structures. In a right-handed (RH) antenna structure, the propagation of electromagnetic waves obeys the right-hand rule for the (E, H, β) vector fields, considering the electrical field E, the magnetic field H, and the wave vector β (or propagation constant). The phase velocity direction is the same as the direction of the signal energy propagation (group velocity) and the refractive index is a positive number. Such materials are referred to as Right Handed (RH) materials. Most natural materials are RH materials. Artificial materials can also be RH materials.

A metamaterial has an artificial structure. When designed with a structural average unit cell size p much smaller than the wavelength λ of the electromagnetic energy guided by the metamaterial, the metamaterial can behave like a homogeneous medium to the guided electromagnetic energy. Unlike RH materials, a metamaterial can exhibit a negative refractive index, and the phase velocity direction may be opposite to the direction of the signal energy propagation wherein the relative directions of the (E, H, β) vector fields follow the left-hand rule. Metamaterials having a negative index of refraction and have simultaneous negative permittivity ∈ and permeability μ are referred to as pure Left Handed (LH) metamaterials.

Many metamaterials are mixtures of LH metamaterials and RH materials and thus are CRLH metamaterials. A CRLH metamaterial can behave like an LH metamaterial at low frequencies and an RH material at high frequencies. Implementations and properties of various CRLH metamaterials are described in, for example, Caloz and Itoh, "Electromagnetic Metamaterials: Transmission Line Theory and Microwave Applications," John Wiley & Sons (2006). CRLH metamaterials and their applications in antennas are described by Tatsuo Itoh in "Invited paper: Prospects for Metamaterials," Electronics Letters, Vol. 40, No. 16 (August, 2004).

CRLH metamaterials may be structured and engineered to exhibit electromagnetic properties that are tailored for specific applications and can be used in applications where it may be difficult, impractical or infeasible to use other materials. In addition, CRLH metamaterials may be used to develop new applications and to construct new devices that may not be possible with RH materials.

Metamaterial (MTM) structures can be used to construct antennas, transmission lines and other RF components and devices, allowing for a wide range of technology advancements such as functionality enhancements, size reduction and performance improvements. An MTM structure has one or more MTM unit cells. The equivalent circuit for an MTM unit cell includes an RH series inductance LR, an RH shunt capacitance CR, a LH series capacitance CL, and a LH shunt inductance LL. The MTM-based components and devices can be designed based on these CRLH MTM unit cells that can be implemented by using distributed circuit elements, lumped circuit elements or a combination of both. Unlike conventional antennas, the MTM antenna resonances are affected by the presence of the LH mode. In general, the LH mode helps excite and better match the low frequency resonances as well as improves the matching of high frequency resonances. The MTM antenna structures can be configured to support multiple frequency bands including a "low band" and a "high band." The low band includes at least one LH mode resonance and the high band includes at least one RH mode resonance associated with the antenna signal.

Some examples and implementations of MTM antenna structures are described in the U.S. patent application Ser. No. 11/741,674 entitled "Antennas, Devices and Systems Based on Metamaterial Structures," filed on Apr. 27, 2007; and the U.S. Pat. No. 7,592,957 entitled "Antennas Based on Metamaterial Structures," issued on Sep. 22, 2009. The disclosures of the above US patent documents are incorporated herein by reference. These MTM antenna structures may be fabricated by using a conventional FR-4 Printed Circuit Board (PCB) or a Flexible Printed Circuit (FPC) board. Examples of other fabrication techniques include thin film fabrication techniques, System On Chip (SOC) techniques, Low Temperature Co-fired Ceramic (LTCC) techniques, and Monolithic Microwave Integrated Circuit (MMIC) techniques.

One type of MTM antenna structures is a Single-Layer Metallization (SLM) MTM antenna structure. The conductive portions of an MTM structure are positioned in a single metallization layer formed on one side of a substrate.

A Two-Layer Metallization Via-Less (TLM-VL) MTM antenna structure is another type of MTM antenna structure having two metallization layers on two parallel surfaces of a substrate. A TLM-VL does not have a conductive vias connecting conductive portions of one metallization layer to conductive portions of the other metallization layer. The examples and implementations of the SLM and TLM-VL MTM antenna structures are described in the U.S. patent application Ser. No. 12/250,477 entitled "Single-Layer Metallization and Via-Less Metamaterial Structures," filed on Oct. 13, 2008, the disclosure of which is incorporated herein by reference.

FIG. 1 illustrates an example of a 1-dimensional (1D) CRLH MTM transmission line (TL) based on four unit cells. One unit cell includes a cell patch and a via, and is a building block for constructing a desired MTM structure. The illustrated TL example includes four unit cells formed in two conductive metallization layers of a substrate where four conductive cell patches are formed on the top conductive metallization layer of the substrate and the other side of the substrate has a metallization layer as the ground electrode. Four centered conductive vias are formed to penetrate through the substrate to connect the four cell patches to the ground plane, respectively. The unit cell patch on the left side is electromagnetically coupled to a first feed line and the unit cell patch on the right side is electromagnetically coupled to a second feed line. In some implementations, each unit cell patch is electromagnetically coupled to an adjacent unit cell patch without being directly in contact with the adjacent unit cell. This structure forms the MTM transmission line to receive an RF signal from one feed line and to output the RF signal at the other feed line.

Figure 2:
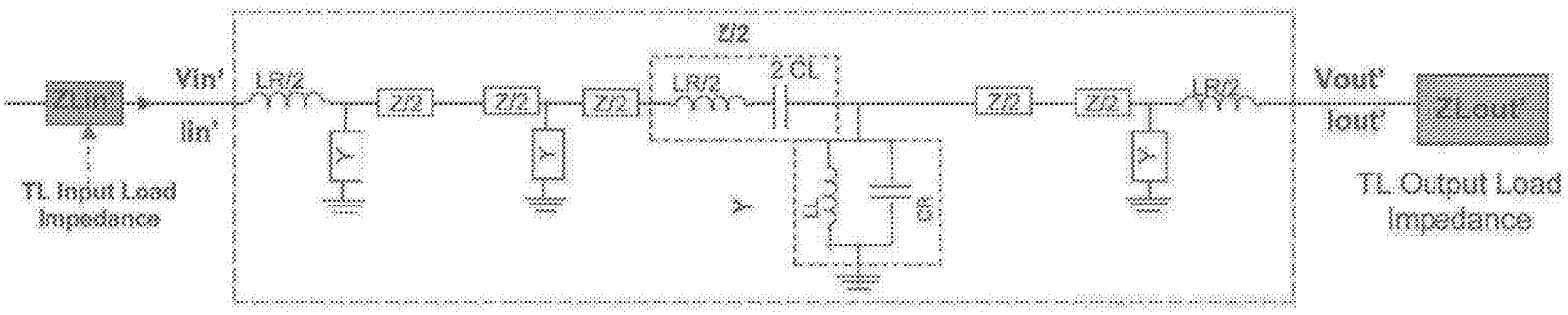

FIG. 2 shows an equivalent network circuit of the 1D CRLH MTM TL in FIG. 1. The ZLin' and ZLout' correspond to the TL input load impedance and TL output load impedance, respectively, and are due to the TL coupling at each end. This is an example of a printed two-layer structure. LR is due to the cell patch on the dielectric substrate, and CR is due to the dielectric substrate being sandwiched between the cell patch and the ground plane. CL is due to the presence of two adjacent cell patches, and the via induces LL.

Each individual unit cell can have two resonances $\omega_{SE}$ and $\omega_{SH}$ corresponding to the series (SE) impedance Z and shunt (SH) admittance Y. In FIG. 2, the Z/2 block includes a series combination of LR/2 and 2CL, and the Y block includes a parallel combination of LL and CR. The relationships among these parameters are expressed as follows:

$$\omega_{SH} = \frac{1}{\sqrt{LL\,CR}};\ \omega_{SE} = \frac{1}{\sqrt{LR\ CL}};\ \omega_R = \frac{1}{\sqrt{LR\ CR}};\quad \text{Eq. (1)}$$

$$\omega_L = \frac{1}{\sqrt{LL\,CL}} \text{ where,}$$

$$Z = j\omega LR + \frac{1}{j\omega CL} \text{ and } Y = j\omega CR + \frac{1}{j\omega LL}.$$

The two unit cells at the input/output edges in FIG. 1 do not include CL, since CL represents the capacitance between two adjacent cell patches and is missing at these input/output edges. The absence of the CL portion at the edge unit cells prevents $\omega_{SE}$ frequency from resonating. Therefore, only $\omega_{SH}$ appears as an m=0 resonance frequency.

Figure 3:
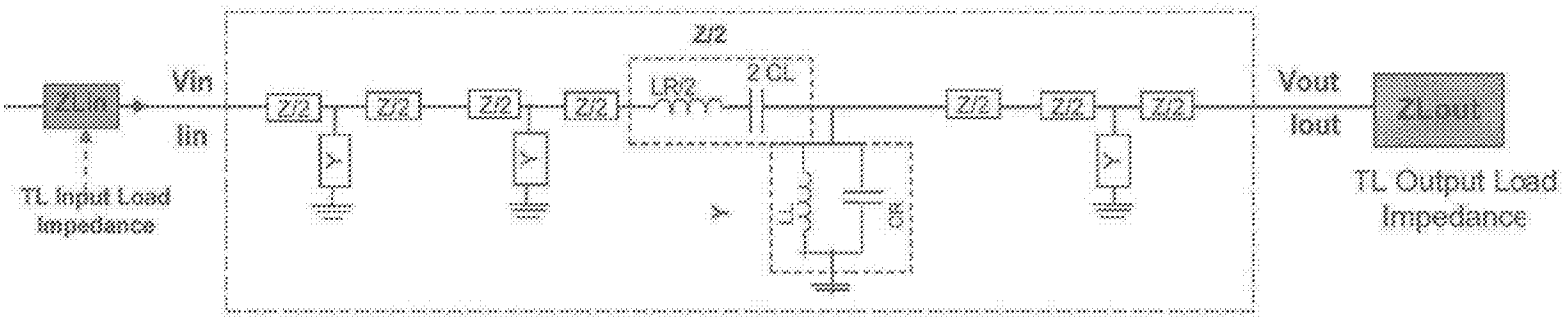

To simplify the computational analysis, a portion of the ZLin' and ZLout' series capacitor is included to compensate for the missing CL portion, and the remaining input and output load impedances are denoted as ZLin and ZLout, respectively, as seen in FIG. 3. Under this condition, all unit cells have identical parameters as represented by two series Z/2 blocks and one shunt Y block in FIG. 3, where the Z/2 block includes a series combination of LR/2 and 2CL, and the Y block includes a parallel combination of LL and CR.

Figure 4A:
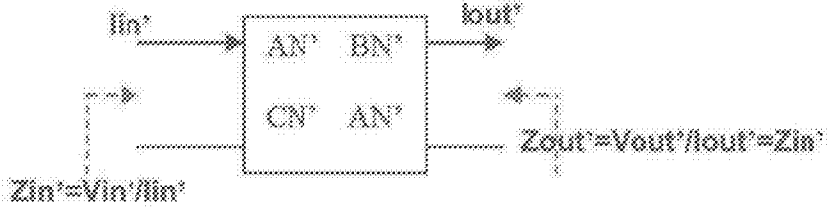
FIG. 4A illustrates a two-port network matrix representation for a one dimensional composite right and left handed metamaterial transmission line equivalent circuit as in FIG. 2, according to an example embodiment.
Figure 4B:
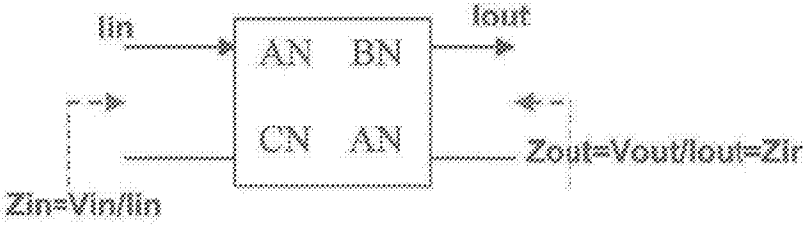
FIG. 4B illustrates a two-port network matrix representation for a one dimensional composite right and left handed metamaterial transmission line equivalent circuit as in FIG. 3, according to an example embodiment.
Figure 5:
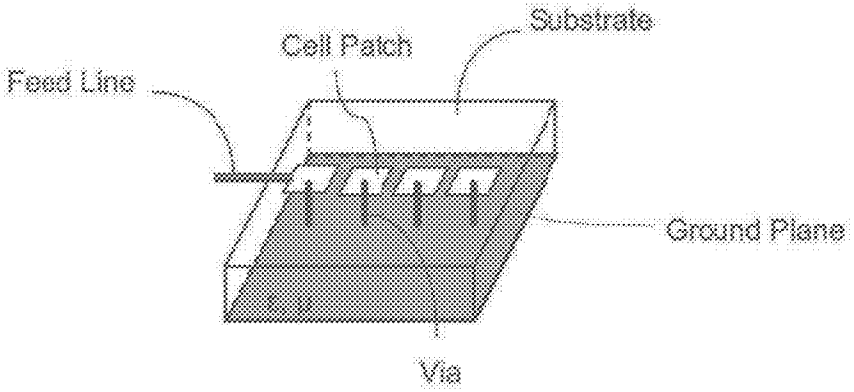
FIG. 5 illustrates a one dimensional composite right and left handed metamaterial antenna based on four unit cells, according to an example embodiment.

FIG. 4A and FIG. 4B illustrate a two-port network matrix representation for TL circuits without the load impedances as shown in FIG. 2 and FIG. 3, respectively, FIG. 5 illustrates an example of a 1D CRLH MTM antenna based on four unit cells. Different from the 1D CRLH MTM TL in FIG. 1, the antenna in FIG. 5 couples the unit cell on the left side to a feed line to connect the antenna to a antenna circuit and the unit cell on the right side is an open circuit so that the four cells interface with the air to transmit or receive an RF signal.

Figure 6B:
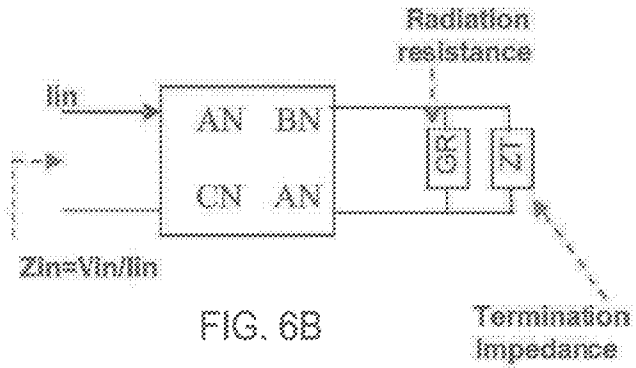
FIG. 6B illustrates a two-port network matrix representation for a one dimensional composite right and left handed metamaterial antenna equivalent circuit analogous to a TL case as in FIG. 4B, according to an example embodiment.
Figure 6A:
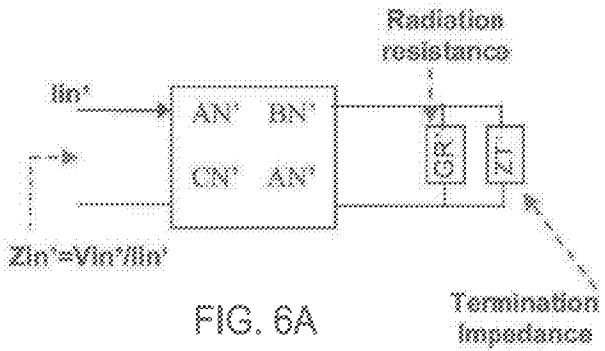
FIG. 6A illustrates a two-port network matrix representation for a one dimensional composite right and left handed metamaterial antenna equivalent circuit analogous to a transmission line case as in FIG. 4A, according to an example embodiment.

FIG. 6A shows a two-port network matrix representation for the antenna circuit in FIG. 5. FIG. 6B shows a two-port network matrix representation for the antenna circuit in FIG. 5 with the modification at the edges to account for the missing CL portion to have all the unit cells identical. FIGS. 6A and 6B are analogous to the TL circuits shown in FIGS. 4A and 4B, respectively.

In matrix notations, FIG. 4B represents the relationship given as below:

$$\begin{pmatrix} Vin \\ Iin \end{pmatrix} = \begin{pmatrix} AN & BN \\ CN & AN \end{pmatrix} \begin{pmatrix} Vout \\ Iout \end{pmatrix}, \quad \text{Eq. (2)}$$

where AN=DN because the CRLH MTM TL circuit in FIG. 3 is symmetric when viewed from Vin and Vout ends.

In FIGS. 6A and 6B, the parameters GR' and GR represent a radiation resistance, and the parameters ZT' and ZT represent a termination impedance. Each of ZT', ZLin' and ZLout' includes a contribution from the additional 2CL as expressed below:

$$ZLin' = ZLin + \frac{2}{j\omega CL},\ ZLout' = ZLout + \frac{2}{j\omega CL}, \quad \text{Eq. (3)}$$

-continued $$ZT' = ZT + \frac{2}{j\omega CL}.$$

Since the radiation resistance GR or GR' can be derived by either building or simulating the antenna, it may be difficult to optimize the antenna design. Therefore, it is preferable to adopt the TL approach and then simulate its corresponding antennas with various terminations ZT. The relationships in Eq. (1) are valid for the circuit in FIG. 2 with the modified values AN', BN', and CN', which reflect the missing CL portion at the two edges.

The frequency bands can be determined from the dispersion equation derived by letting the N CRLH cell structure resonate with nit propagation phase length, where n=0, ±1, ±2, . . . ±N. Here, each of the N CRLH cells is represented by Z and Y in Eq. (1), which is different from the structure shown in FIG. 2, where CL is missing from end cells. Therefore, one might expect that the resonances associated with these two structures are different. However, extensive calculations show that all resonances are the same except for n=0, where both $\omega_{SE}$ and $\omega_{SH}$ resonate in the structure in FIG. 3, and only $\omega_{SH}$ resonates in the structure in FIG. 2. The positive phase offsets (n>0) correspond to RH region resonances and the negative values (n<0) are associated with LH region resonances.

The dispersion relation of N identical CRLH cells with the Z and Y parameters is given below:

$$\begin{cases} N\beta p = \cos^{-1}(A_N),\ \Rightarrow |A_N| \le 1 \Rightarrow 0 \le \chi = -ZY \le 4\forall N \\ \text{where } A_N = 1 \text{ at even resonances } |n| = 2m \in \\ \left\{0, 2, 4, \ldots 2 \times Int\left(\frac{N-1}{2}\right)\right\} \\ \text{and } A_N = -1 \text{ at odd resonances } |n| = 2m+1 \in \\ \left\{1, 3, \ldots \left(2 \times Int\left(\frac{N}{2}\right) - 1\right)\right\} \end{cases} \quad \text{Eq. (4)}$$

where Z and Y are given in Eq. (1), AN is derived from the linear cascade of N identical CRLH unit cells as in FIG. 3, and p is the cell size. Odd n=(2 m+1) and even n=2 m resonances are associated with AN=−1 and AN=1, respectively. For AN' in FIG. 4A and FIG. 6A, the n=0 mode resonates at $\omega_0=\omega_{SH}$ only and not at both $\omega_{SE}$ and $\omega_{SH}$ due to the absence of CL at the end cells, regardless of the number of cells. Higher-order frequencies are given by the following equations for the different values of $\chi$ specified in Table 1:

For $n > 0$, Eq. (5)

$$\omega_{\pm n}^2 = \frac{\omega_{SH}^2 + \omega_{SE}^2 + \chi\omega_R^2}{2} \pm \sqrt{\left(\frac{\omega_{SH}^2 + \omega_{SE}^2 + \chi\omega_R^2}{2}\right)^2 - \omega_{SH}^2\omega_{SE}^2}.$$

Table 1 provides $\chi$ values for N=1, 2, 3, and 4. It should be noted that the higher-order resonances |n|>0 are the same regardless if the full CL is present at the edge cells (FIG. 3) or absent (FIG. 2). Furthermore, resonances close to n=0 have small $\chi$ values (near $\chi$ lower bound 0), whereas higher-order resonances tend to reach $\chi$ upper bound 4 as stated in Eq. (4).

TABLE 1

| Resonances for N = 1, 2, 3 and 4 cells | | | | |
|---|---|---|---|---|
| | Modes | | | |
| N | \|n\| = 0 | \|n\| = 1 | \|n\| = 2 | \|n\| = 3 |
| N = 1 | $\chi_{(1,0)} = 0$; ($\omega_0 = \omega_{SH}$ | | | |
| N = 2 | $\chi_{(2,0)} = 0$; ($\omega_0 = \omega_{SH}$ | $\chi_{(2,1)} = 2$ | | |
| N = 3 | $\chi_{(3,0)} = 0$; ($\omega_0 = \omega_{SH}$ | $\chi_{(3,1)} = 1$ | $\chi_{(3,2)} = 3$ | |
| N = 4 | $\chi_{(4,0)} = 0$; ($\omega_0 = \omega_{SH}$ | $\chi_{(4,1)} = 2 - \sqrt{2}$ | $\chi_{(4,2)} = 2$ | |

Figure 7A:
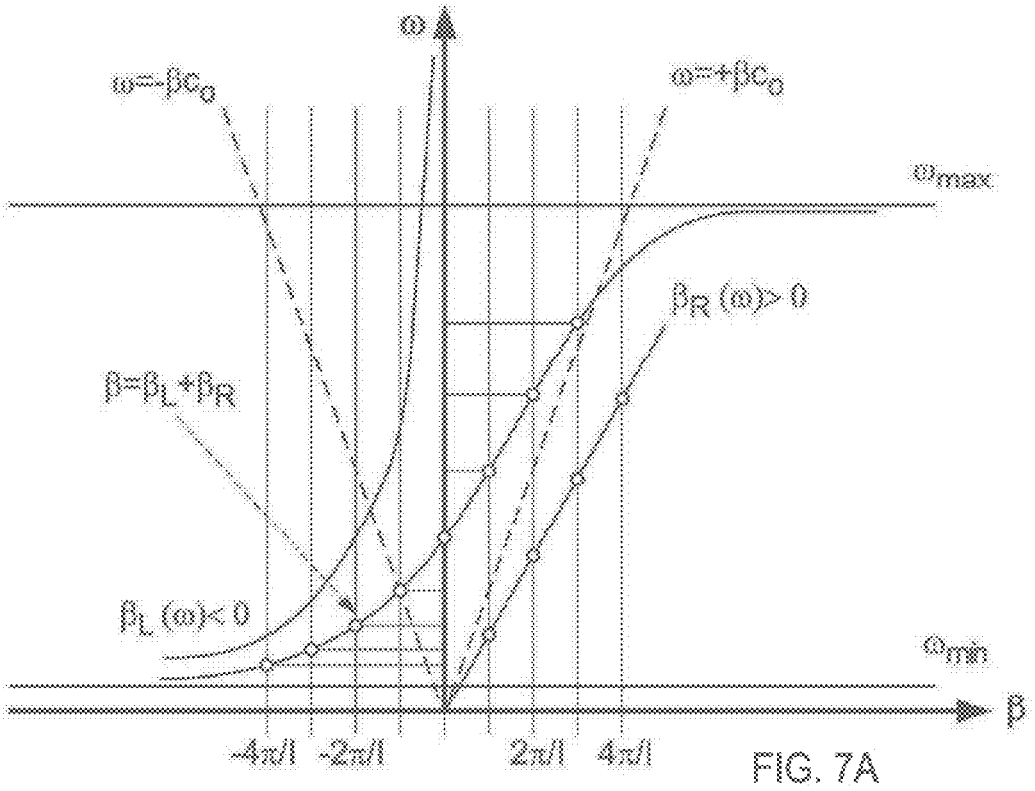
FIGS. 7A and 7B are dispersion curves of a unit cell as in FIG. 2 considering balanced and unbalanced cases, respectively, according to an example embodiment.
Figure 7B:
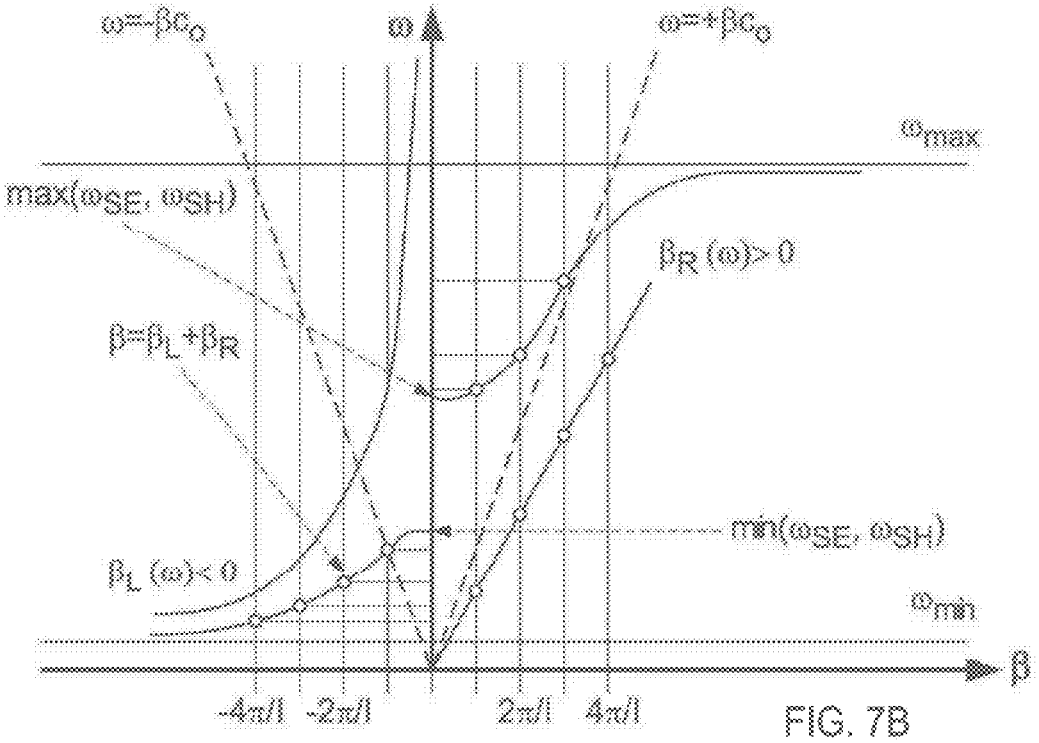

The dispersion curve β as a function of frequency ω is illustrated in FIGS. 7A and 7B for the $\omega_{SE}=\omega_{SH}$ (balanced, i.e., LR CL=LL CR) and $\omega_{SE}\neq\omega_{SH}$ (unbalanced) cases, respectively. In the latter case, there is a frequency gap between min ($\omega_{SE}$, $\omega_{SH}$) and max ($\omega_{SE}$, $\omega_{SH}$). The limiting frequencies $\omega_{min}$ and $\omega_{max}$ values are given by the same resonance equations in Eq. (5) with χ reaching its upper bound χ=4 as stated in the following equations:

$$\omega_{min}^2 = \frac{\omega_{SH}^2 + \omega_{SE}^2 + 4\omega_R^2}{2} - \sqrt{\left(\frac{\omega_{SH}^2 + \omega_{SE}^2 + 4\omega_R^2}{2}\right)^2 - \omega_{SH}^2\omega_{SE}^2} \quad (6)$$

$$\omega_{max}^2 = \frac{\omega_{SH}^2 + \omega_{SE}^2 + 4\omega_R^2}{2} + \sqrt{\left(\frac{\omega_{SH}^2 + \omega_{SE}^2 + 4\omega_R^2}{2}\right)^2 - \omega_{SH}^2\omega_{SE}^2}$$

In addition, FIGS. 7A and 7B provide examples of the resonance position along the dispersion curves. In the RH region (n>0) the structure size 1=Np, where p is the cell size, increases with decreasing frequency. In contrast, in the LH region, lower frequencies are reached with smaller values of Np, hence size reduction. The dispersion curves provide some indication of the bandwidth around these resonances. For instance, LH resonances have the narrow bandwidth because the dispersion curves are almost flat. In the RH region, the bandwidth is wider because the dispersion curves are steeper. Thus, the first condition to obtain broadbands, $1^{st}$ BB condition, can be expressed as follows:

$$COND1\text{: } 1^{st} BB \text{ condition } \left|\frac{d\beta}{d\omega}\right|_{res} = \left|-\frac{\frac{d(AN)}{d\omega}}{\sqrt{(1-AN^2)}}\right|_{res} << 1 \text{ near } \omega = \omega_{res} = \omega_0, \omega_{\pm 1}, \quad \text{Eq. (7)}$$

$$\omega_{\pm 2,\ldots} \Rightarrow \left|\frac{d\beta}{d\omega}\right| = \left|\frac{\frac{d\chi}{d\omega}}{2p\sqrt{\chi\left(1-\frac{\chi}{4}\right)}}\right|_{res} << 1 \text{ with } p = \text{cell size and } \left.\frac{d\chi}{d\omega}\right|_{res} = \frac{2\omega_{\pm n}}{\omega_R^2}\left(1 - \frac{\omega_{SE}^2\omega_{SH}^2}{\omega_{\pm n}^4}\right),$$

where χ is given in Eq. (4) and $\omega_R$ is defined in Eq. (1). The dispersion relation in Eq. (4) indicates that resonances occur when |AN|=1, which leads to a zero denominator in the $1^{st}$ BB condition (COND1) of Eq. (7). As a reminder, AN is the first transmission matrix entry of the N identical unit cells (FIG. 4B and FIG. 6B). The calculation shows that COND1 is indeed independent of N and given by the second equation in Eq. (7). It is the values of the numerator and χ at resonances, which are shown in Table 1, that define the slopes of the dispersion curves, and hence possible bandwidths. Targeted structures are at most Np=λ/40 in size with the bandwidth exceeding 4%. For structures with small cell sizes p, Eq. (7) indicates that high $\omega_R$ values satisfy COND1, i.e., low CR and LR values, since for n<0 resonances occur at χ values near 4 in Table 1, in other terms (1−χ/4→0).

As previously indicated, once the dispersion curve slopes have steep values, then the next step is to identify suitable matching. Ideal matching impedances have fixed values and may not require large matching network footprints. Here, the word "matching impedance" refers to a feed line and termination in the case of a single side feed such as in antennas. To analyze an input/output matching network, Zin and Zout can be computed for the TL circuit in FIG. 4B. Since the network in FIG. 3 is symmetric, it is straightforward to demonstrate that Zin=Zout. It can be demonstrated that Zin is independent of N as indicated in the equation below:

$$Zin^2 = \frac{BN}{CN} = \frac{B1}{C1} = \frac{Z}{Y}\left(1 - \frac{\chi}{4}\right), \quad \text{Eq. (8)}$$

which has only positive real values. One reason that B1/C1 is greater than zero is due to the condition of |AN|≤1 in Eq. (4), which leads to the following impedance condition:

$$0 \leq -ZY = \chi \leq 4.$$

The $2^{nd}$ broadband (BB) condition is for Zin to slightly vary with frequency near resonances in order to maintain constant matching. Remember that the real input impedance Zin' includes a contribution from the CL series capacitance as stated in Eq. (3). The $2^{nd}$ BB condition is given below:

$$COND2\text{: } 2^{nd} BB \text{ condition near resonances, } \left.\frac{dZin}{d\omega}\right|_{res} << 1. \quad \text{Eq. (9)}$$

Different from the transmission line example in FIG. 2 and FIG. 3, antenna designs have an open-ended side with an infinite impedance which poorly matches the structure edge impedance. The capacitance termination is given by the equation below:

$$Z_T = \frac{AN}{CN}, \quad \text{Eq. (10)}$$

which depends on N and is purely imaginary. Since LH resonances are typically narrower than RH resonances, selected matching values are closer to the ones derived in the n<0 region than the n>0 region.

One method to increase the bandwidth of LH resonances is to reduce the shunt capacitor CR. This reduction can lead to higher $\omega_R$ values of steeper dispersion curves as explained in Eq. (7). There are various methods of decreasing CR, including but not limited to: 1) increasing substrate thickness, 2) reducing the cell patch area, 3) reducing the ground area under the top cell patch, resulting in a "truncated ground," or combinations of the above techniques.

The MTM TL and antenna structures in FIGS. 1 and 5 use a conductive layer to cover the entire bottom surface of the substrate as the full ground electrode. A truncated ground electrode that has been patterned to expose one or more portions of the substrate surface can be used to reduce the area of the ground electrode to less than that of the full substrate surface. This can increase the resonant bandwidth and tune the resonant frequency. Two examples of a truncated ground structure are discussed with reference to FIGS. 8 and 11, where the amount of the ground electrode in the area in the footprint of a cell patch on the ground electrode side of the substrate has been reduced, and a remaining strip line (via line) is used to connect the via of the cell patch to a main ground electrode outside the footprint of the cell patch. This truncated ground approach may be implemented in various configurations to achieve broadband resonances.

Figure 10:
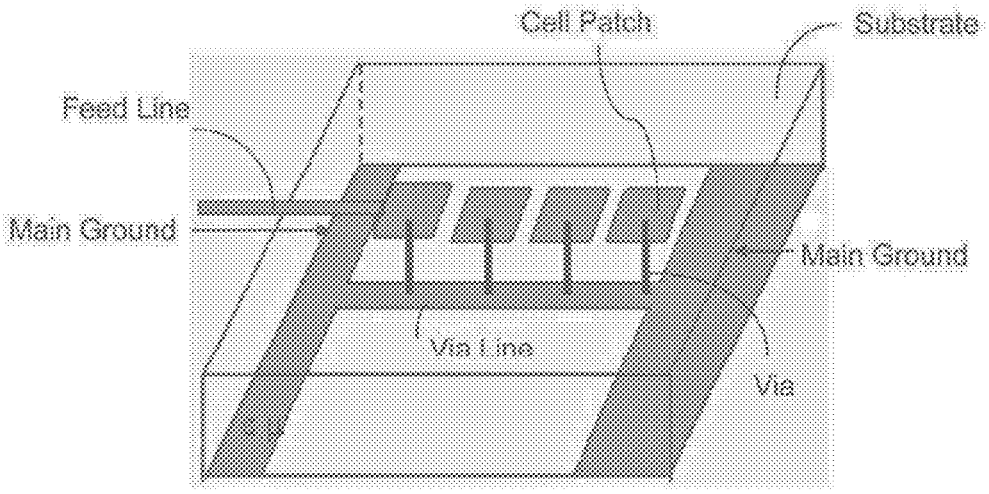
FIG. 10 illustrates an example of a one dimensional composite right and left handed metamaterial antenna with a truncated ground based on four unit cells, according to an example embodiment.

FIG. 8 illustrates one example of a truncated ground electrode for a four-cell MTM transmission line where the ground electrode has a dimension that is less than the cell patch along one direction underneath the cell patch. The ground conductive layer includes a via line that is connected to the vias and passes through underneath the cell patches. The via line has a width that is less than a dimension of the cell path of each unit cell. The use of a truncated ground may be a preferred choice over other methods in implementations of commercial devices where the substrate thickness cannot be increased or the cell patch area cannot be reduced because of the associated decrease in antenna efficiencies. When the ground is truncated, another inductor Lp (FIG. 9) is introduced by the metallization strip (via line) that connects the vias to the main ground as illustrated in FIG. 8. FIG. 10 shows a four-cell antenna counterpart with the truncated ground analogous to the TL structure in FIG. 8.

FIG. 11 illustrates another example of a MTM antenna having a truncated ground structure. In this example, the ground conductive layer includes via lines and a main ground that is formed outside the footprint of the cell patches. Each via line is connected to the main ground at a first distal end and is connected to the via at a second distal end. The via line has a width that is less than a dimension of the cell path of each unit cell.

The equations for the truncated ground structure can be derived. In the truncated ground examples, the shunt capacitance CR becomes small, and the resonances follow the same equations as in Eqs. (1), (5) and (6) and Table 1. Two approaches are presented. FIGS. 8 and 9 represent the first approach, Approach 1, wherein the resonances are the same as in Eqs. (1), (5) and (6) and Table 1 after replacing LR by (LR+Lp). For $|n|\neq 0$, each mode has two resonances corresponding to (1) $\omega\pm n$ for LR being replaced by (LR+Lp) and (2) $\omega\pm n$ for LR being replaced by (LR+Lp/N) where N is the number of unit cells. Under this Approach 1, the impedance equation becomes:

$$Zin^2 = \frac{BN}{CN} = \frac{B1}{C1} = \frac{Z}{Y}\left(1 - \frac{\chi + \chi_P}{4}\right)\frac{(1 - \chi - \chi_P)}{(1 - \chi - \chi_P/N)}, \quad \text{Eq. (11)}$$

$$\text{where } \chi = -YZ \text{ and } \chi = -YZ_P,$$

where $Zp=j\omega Lp$ and Z, Y are defined in Eq. (2). The impedance equation in Eq. (11) provides that the two resonances $\omega$ and $\omega'$ have low and high impedances, respectively. Thus, it is easy to tune near the $\omega$ resonance in most cases.

The second approach, Approach 2, is illustrated in FIGS. 11 and 12 and the resonances are the same as in Eqs. (1), (5), and (6) and Table 1 after replacing LL by (LL+Lp). In the second approach, the combined shunt inductor (LL+Lp) increases while the shunt capacitor CR decreases, which leads to lower LH frequencies.

The above exemplary MTM structures are formed on two metallization layers and one of the two metallization layers is used as the ground electrode and is connected to the other metallization layer through a conductive via. Such two-layer CRLH MTM TLs and antennas with a via can be constructed with a full ground electrode as shown in FIGS. 1 and 5 or a truncated ground electrode as shown in FIGS. 8 and 10.

In one embodiment, an SLM MTM structure includes a substrate having a first substrate surface and an opposite substrate surface, a metallization layer formed on the first substrate surface and patterned to have two or more conductive portions to form the SLM MTM structure without a conductive via penetrating the dielectric substrate. The conductive portions in the metallization layer include a cell patch of the SLM MTM structure, a ground that is spatially separated from the cell patch, a via line that interconnects the ground and the cell patch, and a feed line that is capacitively coupled to the cell patch without being directly in contact with the cell patch. The LH series capacitance CL is generated by the capacitive coupling through the gap between the feed line and the cell patch. The RH series inductance LR is mainly generated in the feed line and the cell patch. There is no dielectric material vertically sandwiched between the two conductive portions in this SLM MTM structure. As a result, the RH shunt capacitance CR of the SLM MTM structure may be designed to be negligibly small. A small RH shunt capacitance CR can still be induced between the cell patch and the ground, both of which are in the single metallization layer. The LH shunt inductance LL in the SLM MTM structure is negligible due to the absence of the via penetrating the substrate, but the via line connected to the ground can generate inductance equivalent to the LH shunt inductance LL. A TLM-VL MTM antenna structure may have the feed line and the cell patch positioned in two different layers to generate vertical capacitive coupling.

Different from the SLM and TLM-VL MTM antenna structures, a multilayer MTM antenna structure has conductive portions in two or more metallization layers which are connected by at least one via. The examples and implementations of such multilayer MTM antenna structures are described in the U.S. patent application Ser. No. 12/270,410 entitled "Metamaterial Structures with Multilayer Metallization and Via," filed on Nov. 13, 2008, the disclosure of which is incorporated herein by reference. These multiple metallization layers are patterned to have multiple conductive portions based on a substrate, a film or a plate structure where two adjacent metallization layers are separated by an electrically insulating material (e.g., a dielectric material). Two or more substrates may be stacked together with or without a dielectric spacer to provide multiple surfaces for the multiple metallization layers to achieve certain technical features or advantages. Such multilayer MTM structures may implement at least one conductive via to connect one conductive portion in one metallization layer to another conductive portion in another metallization layer. This allows connection of one conductive portion in one metallization layer to another conductive portion in the other metallization layer.

An implementation of a double-layer MTM antenna structure with a via includes a substrate having a first substrate surface and a second substrate surface opposite to the first surface, a first metallization layer formed on the first substrate surface, and a second metallization layer formed on the second substrate surface, where the two metallization layers are patterned to have two or more conductive portions with at least one conductive via connecting one conductive portion in the first metallization layer to another conductive portion in the second metallization layer. A truncated ground can be formed in the first metallization layer, leaving part of the surface exposed. The conductive portions in the second metallization layer can include a cell patch of the MTM structure and a feed line, the distal end of which is located close to and capacitively coupled to the cell patch to transmit an antenna signal to and from the cell patch. The cell patch is formed in parallel with at least a portion of the exposed surface. The conductive portions in the first metallization layer include a via line that connects the truncated ground in the first metallization layer and the cell patch in the second metallization layer through a via formed in the substrate. The LH series capacitance CL is generated by the capacitive coupling through the gap between the feed line and the cell patch. The RH series inductance LR is mainly generated in the feed line and the cell patch. The LH shunt inductance LL is mainly induced by the via and the via line. The RH shunt capacitance CR is mainly induced between the cell patch in the second metallization layer and a portion of the via line in the footprint of the cell patch projected onto the first metallization layer. An additional conductive line, such as a meander line, can be attached to the feed line to induce an RH monopole resonance to support a broadband or multi-band antenna operation.

Examples of various frequency bands that can be supported by MTM antennas include frequency bands for cell phone and mobile device applications, WiFi applications, WiMax applications and other wireless communication applications. Examples of the frequency bands for cell phone and mobile device applications are: the cellular band (824-960 MHz) which includes two bands, CDMA (824-894 MHz) and GSM (880-960 MHz) bands; and the PCS/DCS band (1710-2170 MHz) which includes three bands, DCS (1710-1880 MHz), PCS (1850-1990 MHz) and AWS/WCDMA (2110-2170 MHz) bands.

An MTM structure can be specifically tailored to comply with requirements of an application, such as PCB real-estate factors, device performance requirements and other specifications. The cell patch in the MTM structure can have a variety of geometrical shapes and dimensions, including, for example, rectangular, polygonal, irregular, circular, oval, or combinations of different shapes. The via line and the feed line can also have a variety of geometrical shapes and dimensions, including, for example, rectangular, polygonal, irregular, zigzag, spiral, meander or combinations of different shapes. The distal end of the feed line can be modified to form a launch pad to modify the capacitive coupling. The launch pad can have a variety of geometrical shapes and dimensions, including, e.g., rectangular, polygonal, irregular, circular, oval, or combinations of different shapes. The gap between the launch pad and cell patch can take a variety of forms, including, for example, straight line, curved line, L-shaped line, zigzag line, discontinuous line, enclosing line, or combinations of different forms. Some of the feed line, launch pad, cell patch and via line can be formed in different layers from the others. Some of the feed line, launch pad, cell patch and via line can be extended from one metallization layer to a different metallization layer. The antenna portion can be placed a few millimeters above the main substrate. Multiple cells may be cascaded in series to form a multi-cell 1D structure. Multiple cells may be cascaded in orthogonal directions to form a 2D structure. In some implementations, a single feed line may be configured to deliver power to multiple cell patches. In other implementations, an additional conductive line may be added to the feed line or launch pad in which this additional conductive line can have a variety of geometrical shapes and dimensions, including, for example, rectangular, irregular, zigzag, planar spiral, vertical spiral, meander, or combinations of different shapes. The additional conductive line can be placed in the top, mid or bottom layer, or a few millimeters above the substrate.

Another type of MTM antenna includes non-planar MTM antennas. Such non-planar MTM antenna structures arrange one or more antenna sections of an MTM antenna away from one or more other antenna sections of the same MTM antenna so that the antenna sections of the MTM antenna are spatially distributed in a non-planar configuration to provide a compact structure adapted to fit to an allocated space or volume of a wireless communication device, such as a portable wireless communication device. For example, one or more antenna sections of the MTM antenna can be located on a dielectric substrate while placing one or more other antenna sections of the MTM antenna on another dielectric substrate so that the antenna sections of the MTM antenna are spatially distributed in a non-planar configuration such as an L-shaped antenna configuration. In various applications, antenna portions of an MTM antenna can be arranged to accommodate various parts in parallel or non-parallel layers in a three-dimensional (3D) substrate structure. Such non-planar MTM antenna structures may be wrapped inside or around a product enclosure. The antenna sections in a non-planar MTM antenna structure can be arranged to engage to an enclosure, housing walls, an antenna carrier, or other packaging structures to save space. In some implementations, at least one antenna section of the non-planar MTM antenna structure is placed substantially parallel with and in proximity to a nearby surface of such a packaging structure, where the antenna section can be inside or outside of the packaging structure. In some other implementations, the MTM antenna structure can be made conformal to the internal wall of a housing of a product, the outer surface of an antenna carrier or the contour of a device package. Such non-planar MTM antenna structures can have a smaller footprint than that of a similar MTM antenna in a planar configuration and thus can be fit into a limited space available in a portable communication device such as a cellular phone. In some non-planar MTM antenna designs, a swivel mechanism or a sliding mechanism can be incorporated so that a portion or the whole of the MTM antenna can be folded or slid in to save space while unused. Additionally, stacked substrates may be used with or without a dielectric spacer to support different antenna sections of the MTM antenna and incorporate a mechanical and electrical contact between the stacked substrates to utilize the space above the main board.

Non-planar, 3D MTM antennas can be implemented in various configurations. For example, the MTM cell segments described herein may be arranged in non-planar, 3D configurations for implementing a design having tuning elements formed near various MTM structures. U.S. patent application Ser. No. 12/465,571 filed on May 13, 2009 and entitled "Non-Planar Metamaterial Antenna Structures", for example, discloses 3D antennas structure that can implement tuning elements near MTM structures. The entire disclosure of the application Ser. No. 12/465,571 is incorporated by reference as part of the disclosure of this document.

In one aspect, the application Ser. No. 12/465,571 discloses an antenna device to include a device housing comprising walls forming an enclosure and a first antenna part located inside the device housing and positioned closer to a first wall than other walls, and a second antenna part. The first antenna part includes one or more first antenna components arranged in a first plane close to the first wall. The second antenna part includes one or more second antenna components arranged in a second plane different from the first plane. This device includes a joint antenna part connecting the first and second antenna parts so that the one or more first antenna components of the first antenna section and the one or more second antenna components of the second antenna part are electromagnetically coupled to form a CRLH MTM antenna supporting at least one resonance frequency in an antenna signal and having a dimension less than one half of one wavelength of the resonance frequency. In another aspect, the application Ser. No. 12/465,571 discloses an antenna device structured to engage a packaging structure. This antenna device includes a first antenna section configured to be in proximity to a first planar section of the packaging structure and the first antenna section includes a first planar substrate, and at least one first conductive portion associated with the first planar substrate. A second antenna section is provided in this device and is configured to be in proximity to a second planar section of the packaging structure. The second antenna section includes a second planar substrate, and at least one second conductive portion associated with the second planar substrate. This device also includes a joint antenna section connecting the first and second antenna sections. The at least one first conductive portion, the at least one second conductive portion and the joint antenna section collectively form a CRLH MTM structure to support at least one frequency resonance in an antenna signal. In yet another aspect, the application Ser. No. 12/465,571 discloses an antenna device structured to engage to an packaging structure and including a substrate having a flexible dielectric material and two or more conductive portions associated with the substrate to form a CRLH MTM structure configured to support at least one frequency resonance in an antenna signal. The CRLH MTM structure is sectioned into a first antenna section configured to be in proximity to a first planar section of the packaging structure, a second antenna section configured to be in proximity to a second planar section of the packaging structure, and a third antenna section that is formed between the first and second antenna sections and bent near a corner formed by the first and second planar sections of the packaging structure.

Return loss, gain, and radiation efficiency are important antenna performance metrics especially for a compact mobile communication device where the PCB real-estate is limited. Generally, when the antenna size decreases, the efficiency decreases. Obtaining high performance metrics with a given limited space becomes a challenge in antenna designs especially for cell phones and other compact mobile communication devices. For example, as real-estate on the PCB becomes limited due to smaller mobile device size, designing antenna structures around RF circuitry, keypad, microphone, liquid-crystal display (LCD), battery, and camera and so on becomes more difficult. Antenna performance, including return loss, gain, and radiation efficiency, can be significantly degraded by other objects on the same PCB proximate to the antenna. Other external objects include the human body which can also interfere with antenna performance. In some cases, it is important to shield the antenna from human body effects to minimize absorption of RF signals to the human body.

Antenna structures can be built on other small devices such as Universal Serial Bus (USB) adapters and Personal Computer Memory Card International Association (PCMCIA) cards. These devices are typically plugged into a host device such as laptop or desktop computer and serve as a peripheral interface for communicating with external devices such as network cards, external storage, print, and multimedia devices. Antenna performance can be impacted by the proximity of these additional objects such as the host device PCB ground and the host device LCD. Performance may also vary based on the host device size, shape and structure. Therefore, ensuring that the embedded device operates independently of the host device is an important design consideration for achieving acceptable and stable antenna performance. For example, some design features which are used to isolate the embedded device from the host device may include antenna devices which utilize frequency-dependent connectors or active components as a way of mitigating interference introduced by surrounding objects without affecting the operation of other circuit components and devices. This document describes several frequency-dependent isolation techniques and structures for eliminating or minimizing the proximity effect of objects close to an MTM antenna structure.

An embodiment of a wireless device supporting an antenna and using one or more frequency-dependent structures to isolate certain circuit components from the antenna may include one or more substrates; one or more metallization layers supported by the one or more substrates; a ground electrode formed in one of the one or more metallization layers; one or more metal plates formed in at least one of the one or more metallization layers; several conductive portions formed in at least one of the one or more metallization layers; and one or more electrical components, each electrically coupling to the one or more metal plates and the ground electrode, in which an RF frequency source determines an impedance associated with the one or more electrical components.

Figure 13:
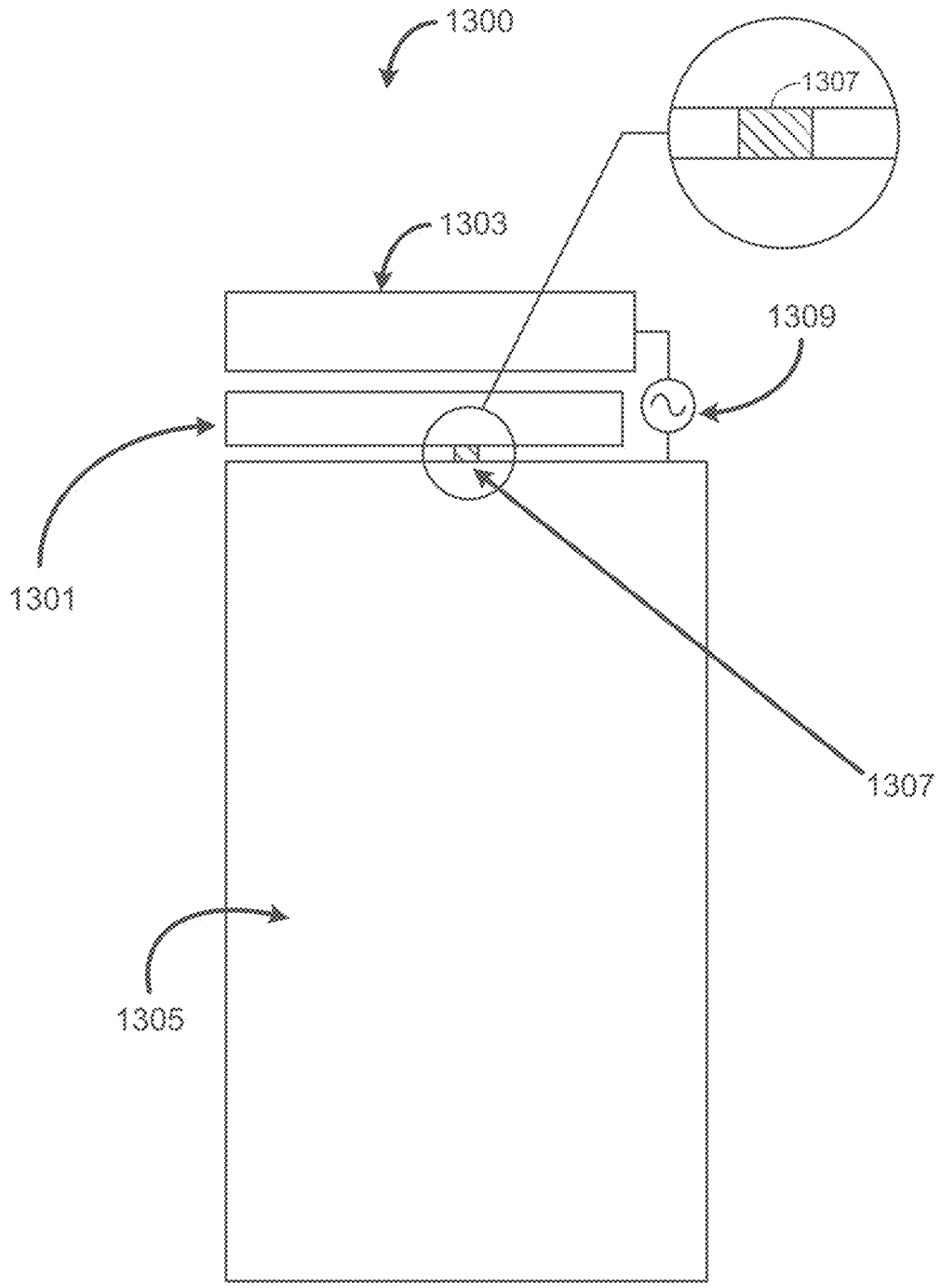
FIG. 13 illustrates a first configuration of a wireless device with a frequency-dependent connection to a ground plane, according to an example embodiment.

FIG. 13 illustrates an example of isolation techniques and structures used to improve the performance of an antenna in a wireless device 1300. In FIG. 13, a metal plate 1301 is positioned proximate to an antenna 1303 and a ground plane 1305. According to one example, the metal plate 1301 may be configured to support integrated cellular components such as such as a keypad, key domes, microphone and a camera module. The ground plane 1305 may be shared by the antenna 1303 and integrated components located on the metal plate 1301 to permit proper grounding. An antenna source 1309, such as a radio transceiver, may be used to feed RF input signals to the antenna 1303 and connects the antenna 1303 to the ground plane 1305. During DC operation, a DC current can be supplied to the metal plate 1301 to support the integrated cellular components. However, at high RF operation, undesirable interactions between these integrated components and the antenna 1303 may be present and reduce the performance of the antenna. Thus, at certain frequencies, isolating the antenna 1303 from these integrated cellular components located on the metal plate 1301 may be of particular interest and advantageous in terms of antenna performance. Various isolation techniques and structures which allow one or more antennas to operate in proximity to integrated components are presented herein. For example, an electrical component having frequency-dependent properties, such as an inductor 1307, may be used to couple the metal plate 1301 to the ground plane 1305 and isolate the metal plate 1301 from the antenna 1303 at certain frequencies. At DC operation, the inductor 1307 may act as a low impedance component which allows DC current from the integrated components to be transferred to other circuit components in the ground plane 1305 without distortion. At a high frequency range or microwave frequency, the inductor 1307 may act as a high impedance component which can block RF current from flowing to the metal plate 1301 that produce adverse interactions with the antenna 1303. Thus, by utilizing this frequency-dependent connector, such as inductor 1307, between the metal plate 1301 and the ground plane 1305, integrated components such as a keypad, key domes, microphone and a camera module can safely operate on the metal plate 1301 without adversely affecting the antenna 1303 performance during high frequency operation.

Other wireless device configurations may include a non-planar wireless device. For example, the antenna 1303 illustrated in FIG. 13 can be formed on a different surface which is substantially parallel to and spatially distributed from the metal plate 1301 and the ground plane 1305 to form a non-planar wireless device. In addition, the isolation techniques and structures previously presented can be applied to the non-planar wireless device to provide isolation, which may allow one or more antennas to operate in proximity to other circuit components.

Figure 14:
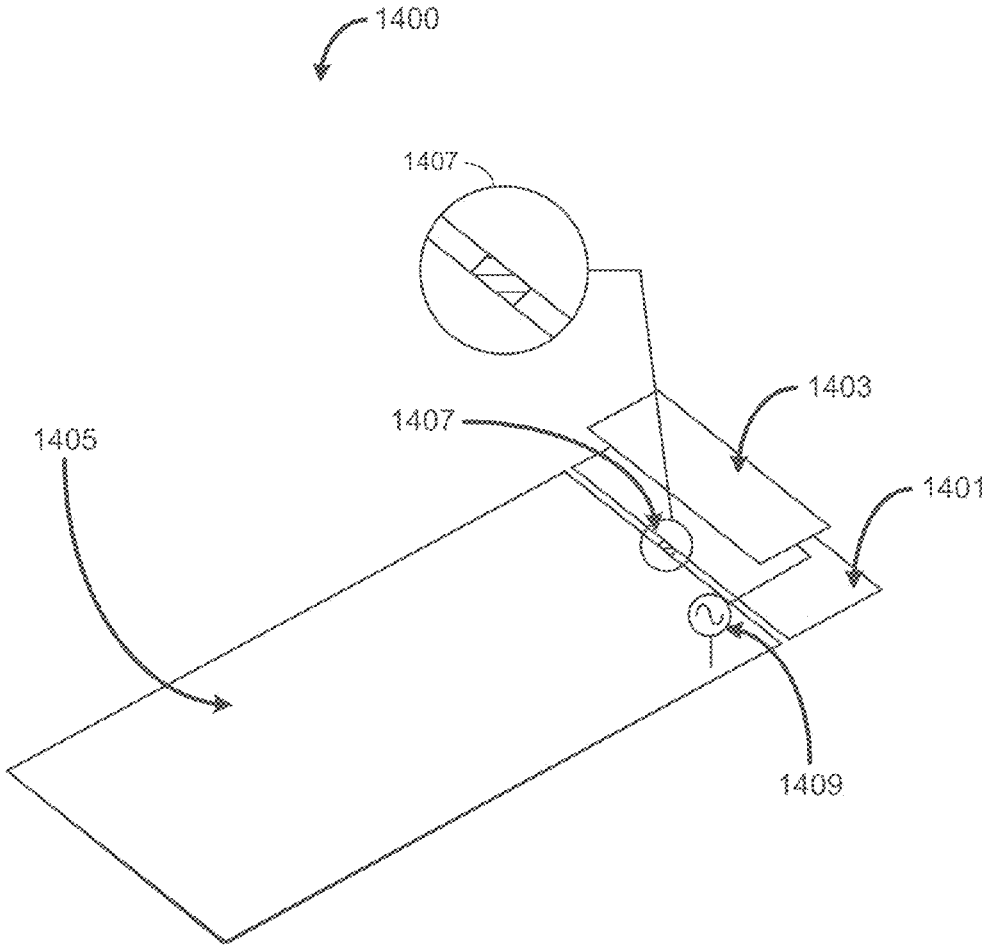
FIG. 14 illustrates a second configuration of a wireless device with a frequency-dependent connection to a ground plane, according to an example embodiment.

In FIG. 14, for example, a non-planar wireless device 1400 may include an antenna 1403 formed on a first surface and two conductive elements, a metal plate 1401 and a ground plane 1405, each formed on a second surface. An antenna source 1409, such as a radio transceiver, may be used to feed RF input signals to the antenna 1403 and connects the antenna 1403 to the ground plane 1405. The metal plate 1401 may be configured to be substantially parallel to and positioned below the antenna 1403, and thus, can act as a physical barrier or shield between nearby objects, such as the human body, and the antenna 1403 to reduce radio interference caused by the objects such as the human body effect. In addition, the metal plate 1401 may be configured to support integrated cellular components such as such as a keypad, key domes, microphone and a camera module. The ground plane 1405 may be shared by the antenna 1403 and other circuitry and cellular components formed in the metal plate 1401. At DC operation, a DC current can be supplied to the metal plate 1401 to support these integrated cellular components. However, at high frequencies, these cellular components, as described in the previous embodiment, can interference with the antenna 1403 and result in reduced antenna performance.

A similar isolation technique and structure described in the previous embodiment can be applied to the non-planar wireless device 1400. For example, an electrical component 1407 having frequency-dependent properties, such as an inductor, may be used to couple the metal plate 1401 to the ground plane 1405 and isolate the metal plate 1401 from the antenna 1403 at certain frequencies. At DC operation, for example, the inductor 1407 may act as a low impedance component which allows DC current from the integrated components to be transferred to other circuit components without distortion. At a high frequency range or microwave frequency, the inductor 1407 may act as a high impedance component which can prevent RF current from flowing to the metal plate 1401, and thus, eliminate or minimize interference to the antenna 1403. By utilizing the frequency-dependent connector, such as the inductor 1407, between the metal plate 1401 and the ground plane 1405, integrated components such as a keypad, key domes, microphone and a camera module can be mounted on the metal plate 1401 without adversely affecting antenna performance during high frequency operation. Also, the metal plate 1401, in combination with the inductor 1407, can act as a shield to the antenna 1403 to mitigate the human body effect and may help reduce the specific absorption rate (SAR) absorbed by the human body.

Figure 15A:
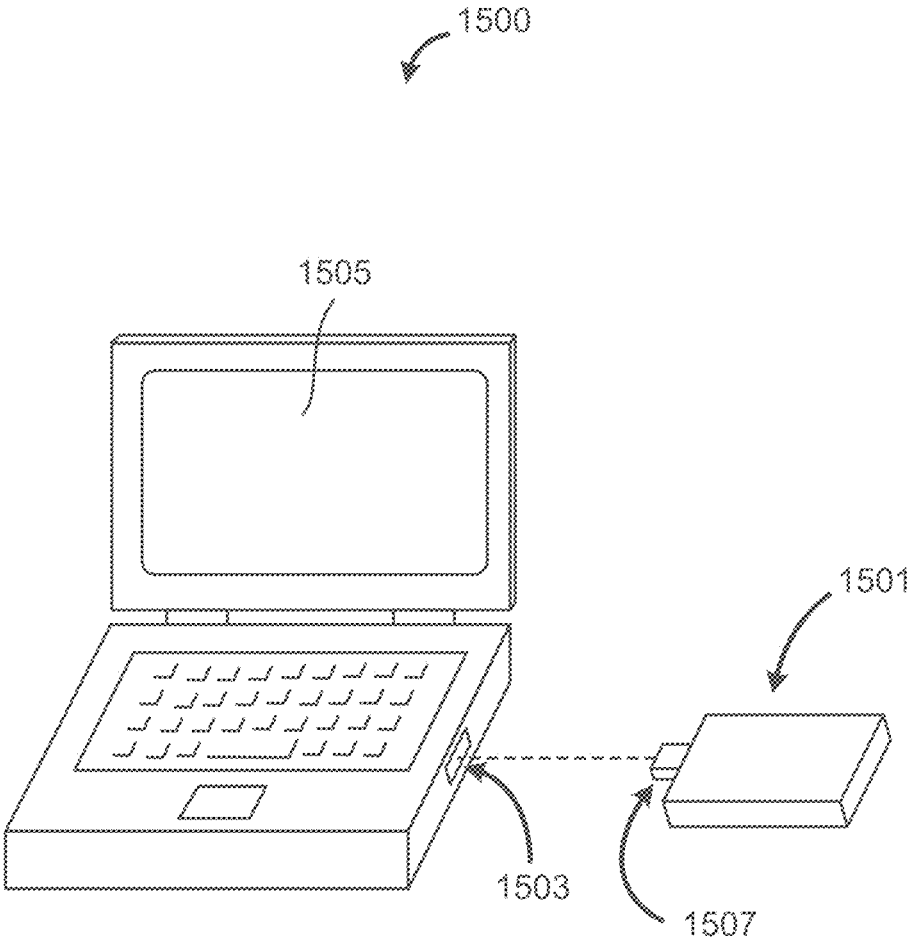
FIGS. 15A and 15B illustrate an MTM antenna structure with a frequency-dependent connection to a ground plane which may be used in a Universal Serial Bus (USB) dongle device application, according to example embodiments.
Figure 15B:
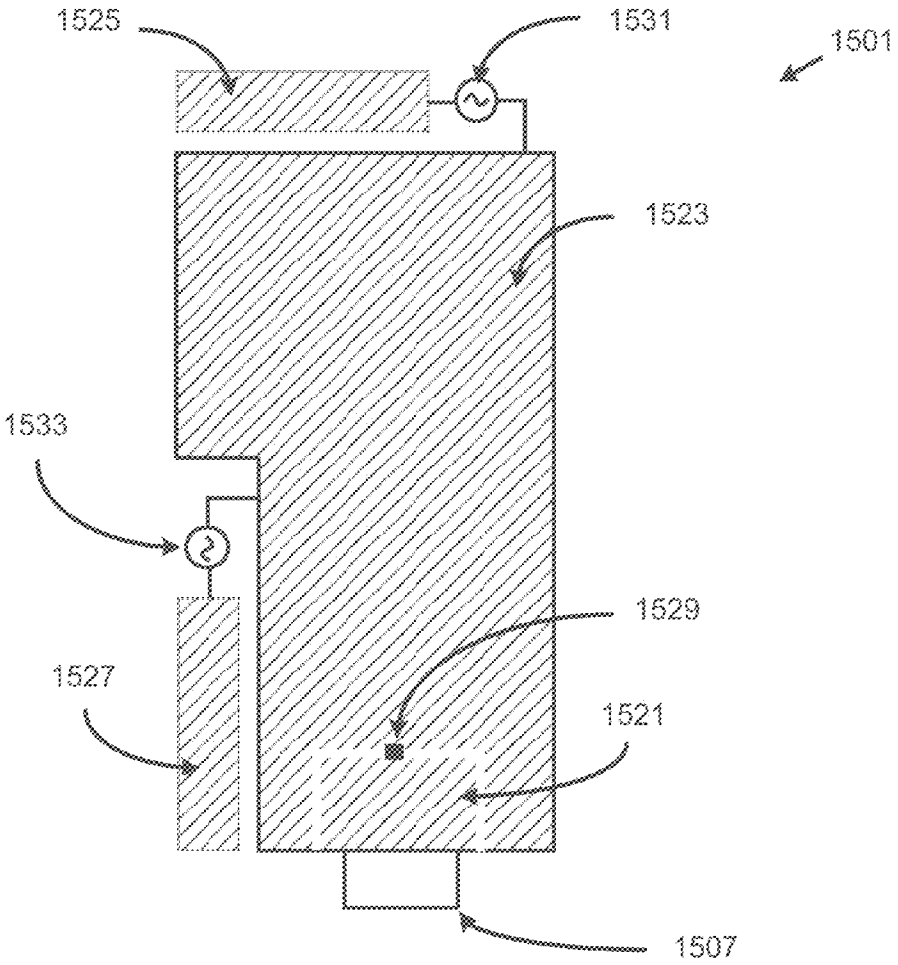

FIG. 15A illustrates an example of isolation techniques and structures used to improve the performance of multiple antennas used in a Universal Serial Bus (USB) dongle device application 1500. One example of a USB dongle device 1501 includes a portable piece of hardware having a USB male connector or a plug 1507 that may be inserted into a USB port 1503 of a host device 1505 such as a laptop or desktop computer. The USB dongle device 1501 may support wireless applications and contain multiple built-in antennas. In FIG. 15A, the performances of the antennas can depend on surrounding objects such as the ground plane size and LCD panel size associated with the host device 1505. These objects can make optimizing the performance of multiple antennas, including impedance matching and radiation efficiency, difficult and unstable. FIG. 15B illustrates one implementation of multiple antenna structures integrated in a USB dongle device 1501 to overcome optimization problems created by the surrounding objects.

In FIG. 15B, the USB dongle device 1501 includes a first antenna 1525 and a second antenna 1527, a first antenna source 1531, and a second antenna source 1533 which are used to feed RF input signals to the first antenna 1525 and the second antenna 1527, respectively, a ground plane 1523 coupled to the first and second source 1531 and 1533, and a metal plate 1521 coupled to the ground plane 1523 via a electrical component 1529, the metal plate 1521 also being connected to the USB male connector 1507.

In operation, the ground plane 1523 is configured to provide ground to the host device 1505 connected to USB male connector 1507 via the metal plate 1521 and the two antennas 1525 and 1527. However, the surrounding objects associated with the computer 1505 can interfere with and reduce the performance of the two antennas at certain frequencies. Thus, isolating the two antennas 1525 and 1527 at certain frequencies from the surrounding objects associated with the computer 1505 may be advantageous with respect to antenna performance. For example, the electrical component 1529 may be replaced by a frequency-dependent connector, such as an inductor, to connect the metal plate 1521 to the ground plane 1523 and isolate the metal plate 1521 from the two antennas 1525 and 1527 at certain frequencies. At DC operation, for example, the inductor may act as a low impedance component which allows DC current. When the USB dongle device 1501 is plugged into the USB slot 1503 of the host device 1505 via USB connector 1507, DC and low frequency signals may be supplied from the host device 1505 to the USB dongle device 1501 through the metal plate 1521 and the inductor 1529 to all the circuitries fabricated on the ground plane 1523 of USB dongle device 1501.

At a high frequency range or microwave frequency, for example, the inductor may act as a high impedance component which can block RF current from flowing. For example, RF interference caused by the large ground plane or the LCD panel associated with the host device 1505 to the two antennas 1525 and 1527 in the USB dongle device 1501 can be blocked by the inductor 1529. Thus, a frequency-dependent connector may be used to effectively isolate the ground plane from the two antennas to maintain or improve the performance of multiple antennas used in a USB dongle application.

Other signals transmitted between the host device 1505 and the USB dongle device 1501 may include digital signals. However, these signals typically do not require or use the ground plane 1523. Thus, isolating the ground plane 1523 from the host device 1505 may not affect the transmitted digital signals.

An embodiment of a wireless device supporting an MTM antenna and using one or more frequency-dependent structures to isolate certain circuit components from the MTM antenna may include a device enclosure; a substrate structure residing inside the device enclosure, the substrate structure having a first surface and a second surface, different from the first surface; a ground electrode supported by the substrate structure; a first metal plate supported by the first surface of the substrate structure; an electrical component connected to the first metal plate and the ground electrode, in which an RF frequency source determines an impedance associated with the electrical component; a second metal plate supported by the second surface of the substrate structure; several vias formed in the substrate structure for connecting the first metal plate to the second metal plate; and several electrically conductive portions supported by the substrate structure, in which the ground electrode, at least part of the substrate structure and the electrically conductive portions are configured to form a composite left and right handed (CRLH) metamaterial antenna structure that exhibits one or more frequency resonances associated with an antenna signal.

FIGS. 16A-16D illustrate isolation techniques and structures to improve the performance of an MTM antenna used in a compact handheld wireless device 1600 where other circuit elements are in proximity to the MTM antenna. The compact handheld device 1600 may be configured as a multi-band device which can support two frequency ranges: 880 MHz to 960 MHz and 1710 MHz to 1880 MHz.

Figure 16A:
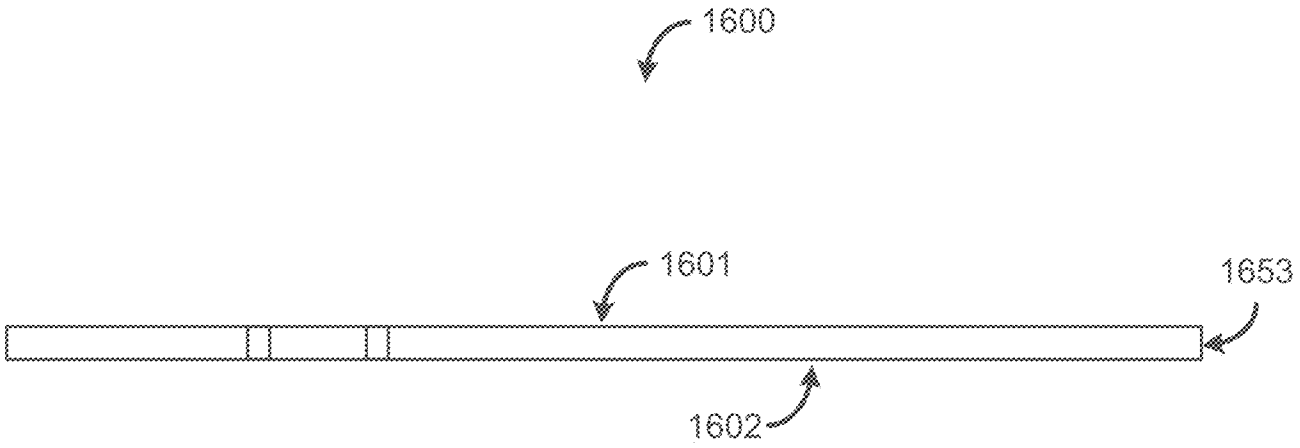
FIGS. 16A-16D illustrate an implementation of an MTM antenna structure used in a wireless device with a frequency-dependent connection to a ground plane, according to example embodiments.

FIG. 16A illustrates a side view of a compact handheld wireless device 1600. The handheld wireless device 1600 may include a top layer 1601 and bottom layer 1602 which are formed on each side of a substrate 1653 as shown in FIG. 16A. Top views of the top layer 1601 and the bottom layer 1602 are shown in FIGS. 16B and 16C, respectively.

Figure 16B:
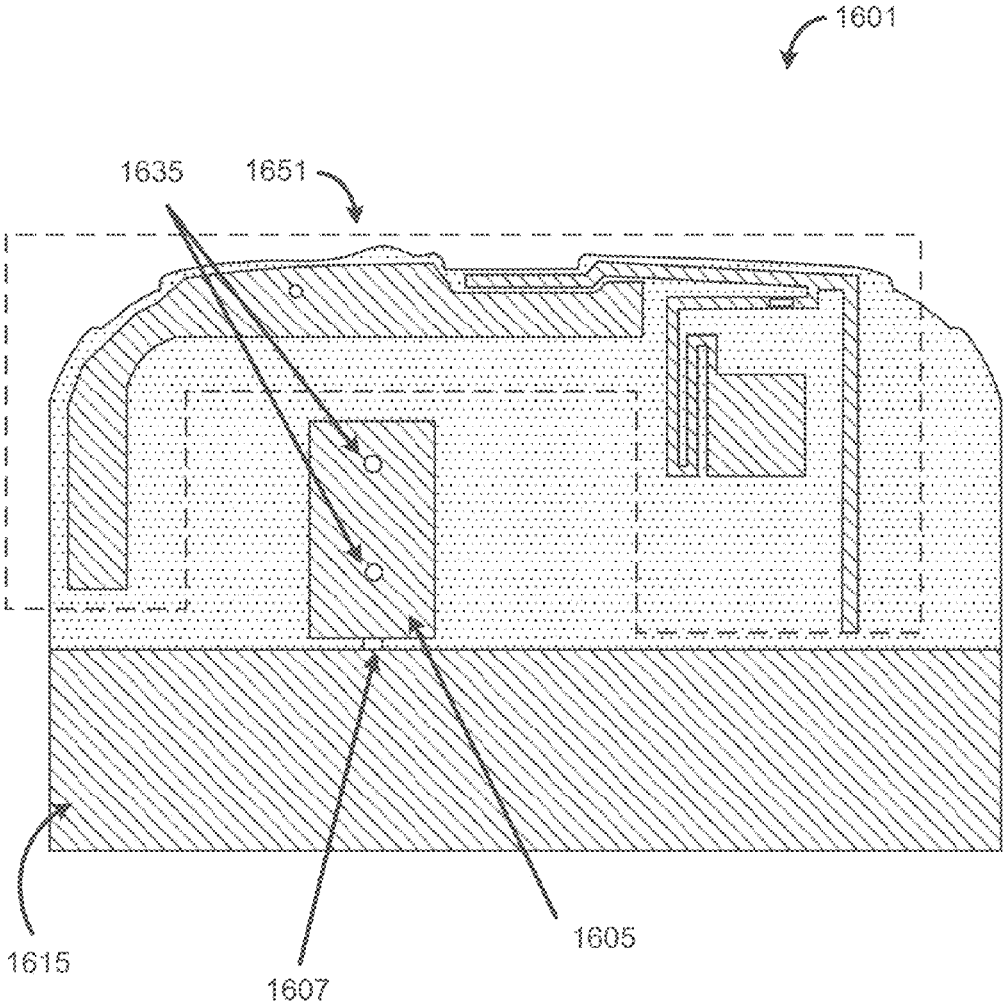

FIG. 16B illustrates structural elements of the top layer of the wireless device 1600. These structural elements include a top ground plane 1615, a top metal plate 1605 which is coupled to the top ground plane 1615 by an electrical component 1607, and a MTM antenna 1651 that is adjacent to the metal plate 1605.

Figure 16C:
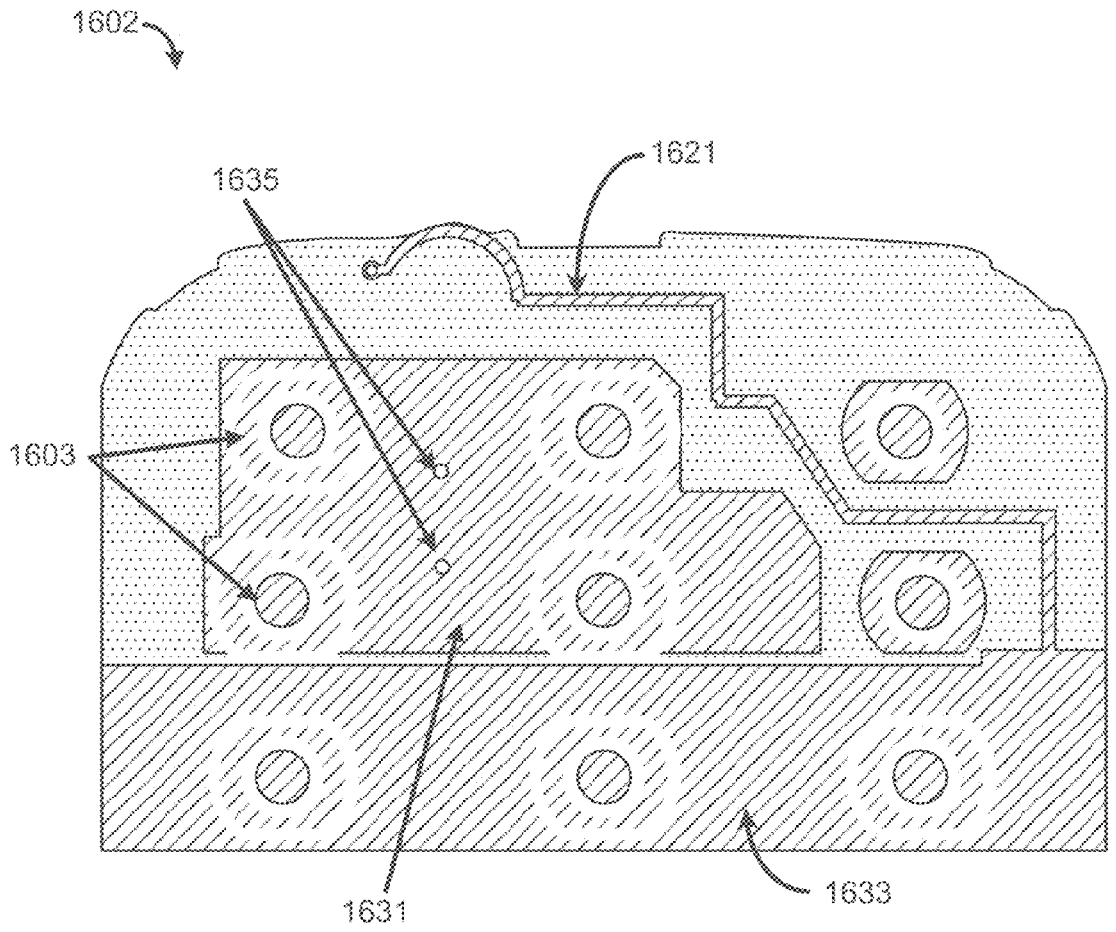

FIG. 16C illustrates structural elements of the bottom layer 1602 of the wireless device 1600. These structural elements include a bottom ground plane 1633, a bottom metal plate 1631, a via line 1621 to connect the MTM antenna 1651 on the top layer 1601 to the bottom ground plane 1633, a pair of vias 1635 to connect the bottom metal plate 1631 to the top metal plate 1605, and several key domes 1603, which are designed to connect phone keys to a printed circuit board (PCB). Since the key domes 1603 follow the same layout as the phone keys, the key domes 1603 may overlap other structures, as shown in FIG. 16C, such as the bottom ground plane 1633, the bottom metal plate 1631 and the exposed substrate.

The top ground plane 1615 and the bottom ground plane 1633 may be connected to form a single ground plane by using an array of vias (not shown) formed in the substrate, or by conductive lines formed along a perpendicular edge of the substrate. As shown in FIGS. 16B-16C, the ground plane, which includes both top and bottom ground planes 1615 and 1633, is shared by the MTM antenna 1651 and the top and bottom metal plates 1605, 1631.

Due to the compactness of the handheld device 1600, surrounding objects such as the key domes 1603, and top and bottom metal plates 1605, 1631 are in proximity to the MTM antenna 1651 and may interfere with the MTM antenna performance. Hence, during operation, these objects can interfere with and reduce the performance of the MTM antenna 1651 at certain frequencies. Thus, isolating the MTM antenna 1651 from the top and bottom metal plates 1605, 1631 may be of particular interest in terms of certain antenna performance metrics. Specifically, the top metal plate 1605 and the bottom metal plate 1631 may be isolated from the top ground plane 1615 and the bottom ground plane 1633, respectively, to maintain antenna performance, such as impedance matching and radiation efficiency, without RF interference by the proximity of the bottom ground plane 1633 used by key domes 1603 and DC supply traces. For example, the electrical component 1607 may be replaced by a frequency-dependent connector, such as an inductor, to connect the top metal plate 1605 to the ground plane 1615 and isolate the top metal plate 1605, including the bottom metal plate 1631, from the MTM antenna 1651 at certain frequencies. At DC frequency, the inductor may act as a low impedance component which allows DC current. Thus, the DC bias may be supplied to the top and bottom metal plates 1605, 1631 through the inductor so that the key domes 1603 can function properly.

At RF frequency, the inductor offers a high impedance so as to isolate the top and bottom metal plates 1605, 1631 from the top and bottom ground plane 1615, 1633, respectively. Stated differently, the top and bottom metal plates 1605, 1631 appear as two disconnected metal plates instead of a single ground plane and thus lack sufficient current flow or interference that may reduce the performance of the MTM antenna 1651.

Figure 16D:
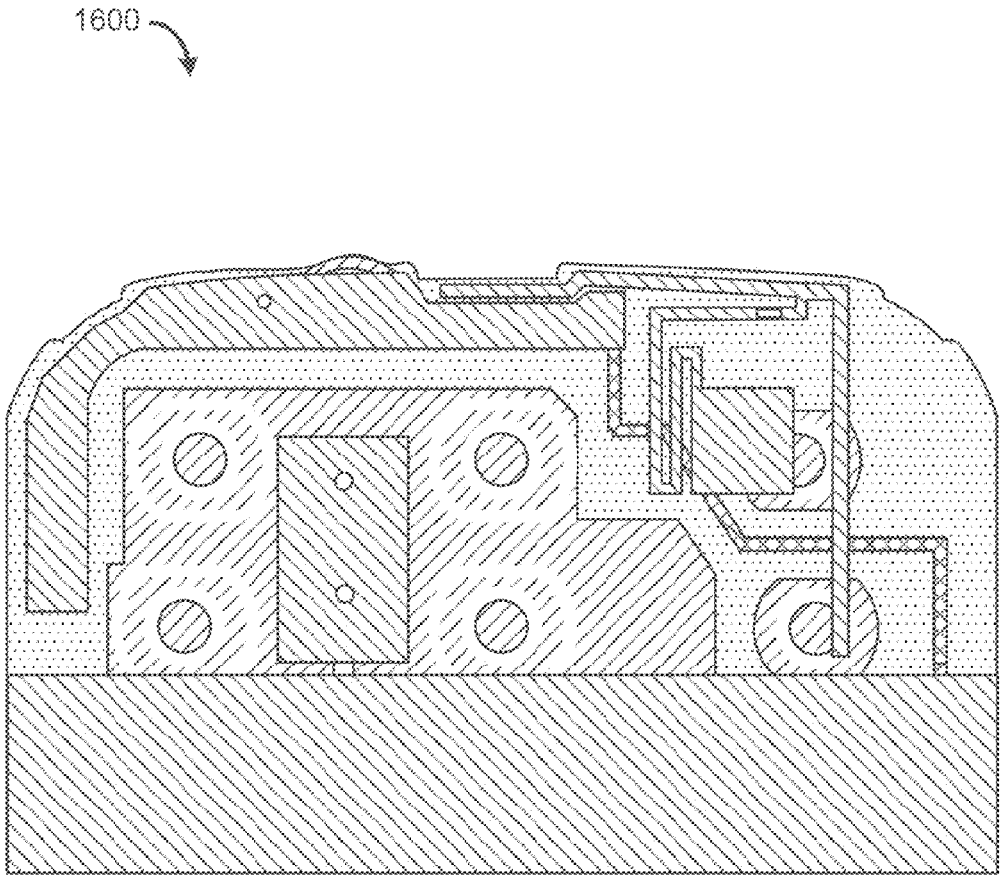

FIG. 16D shows a top view of two superimposed layers, the top layer 1601 and the bottom layer 1602, associated with the wireless device 1600.

Figure 17:
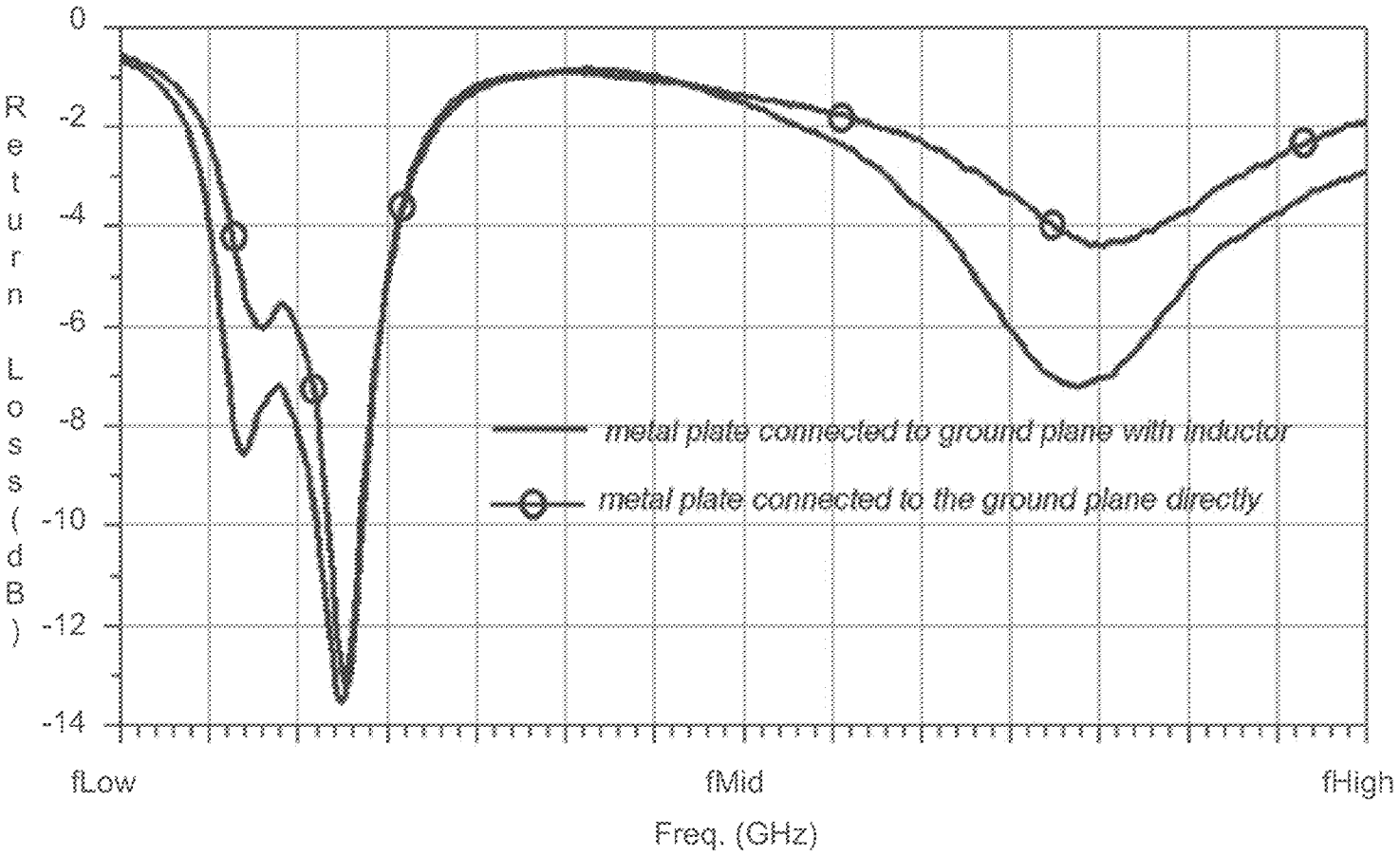
FIG. 17 illustrates the return loss of an MTM antenna, such as the MTM antenna structure illustrated in FIGS. 16A-16D, and the return loss on direct connection to the ground plane, according to an example embodiment.

FIG. 17 plots a comparison of the measured return loss of the MTM antenna 1651 as a function of signal frequency between the top metal plate 1605 directly connected to the ground plane and the top metal plate 1605 connected to the ground plane through the frequency-dependent connector 1607, such as an inductor, as illustrated in FIG. 16D. In FIG. 17, the horizontal axis is the frequency of the signal transmitted through the MTM antenna 1651, while the vertical axis is the return loss in dB of the signal. The comparison plot of the measured return loss in FIG. 17 indicate that when the top metal plate 1605 is connected directly to the ground plane, this results in a greater return loss than when an inductor is coupled between the top metal plate 1605 and the ground plane at almost all frequencies. In these figures, the lower return loss numbers generally indicate a better impedance match from source to load and thus show better performance metrics achieved when the metal plate and ground plane are connected through the inductor instead of being directly connected.

Figure 18A:
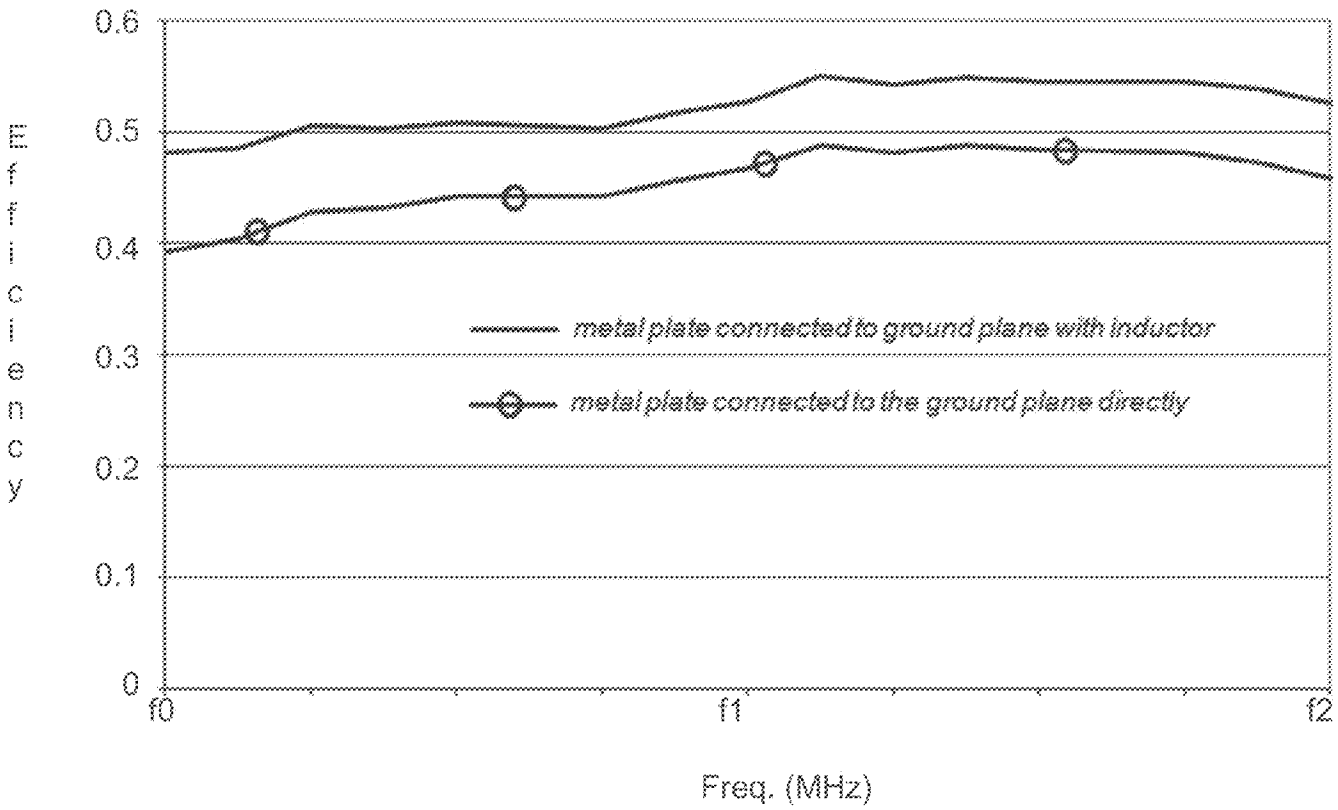
FIG. 18A illustrates a comparison of the lower frequency range of the radiation antenna efficiency of an MTM antenna, such as the MTM antenna structure illustrated in FIGS. 16A-16D, and the radiation antenna efficiency on direct connection to the ground plane, according to an example embodiment.
Figure 18B:
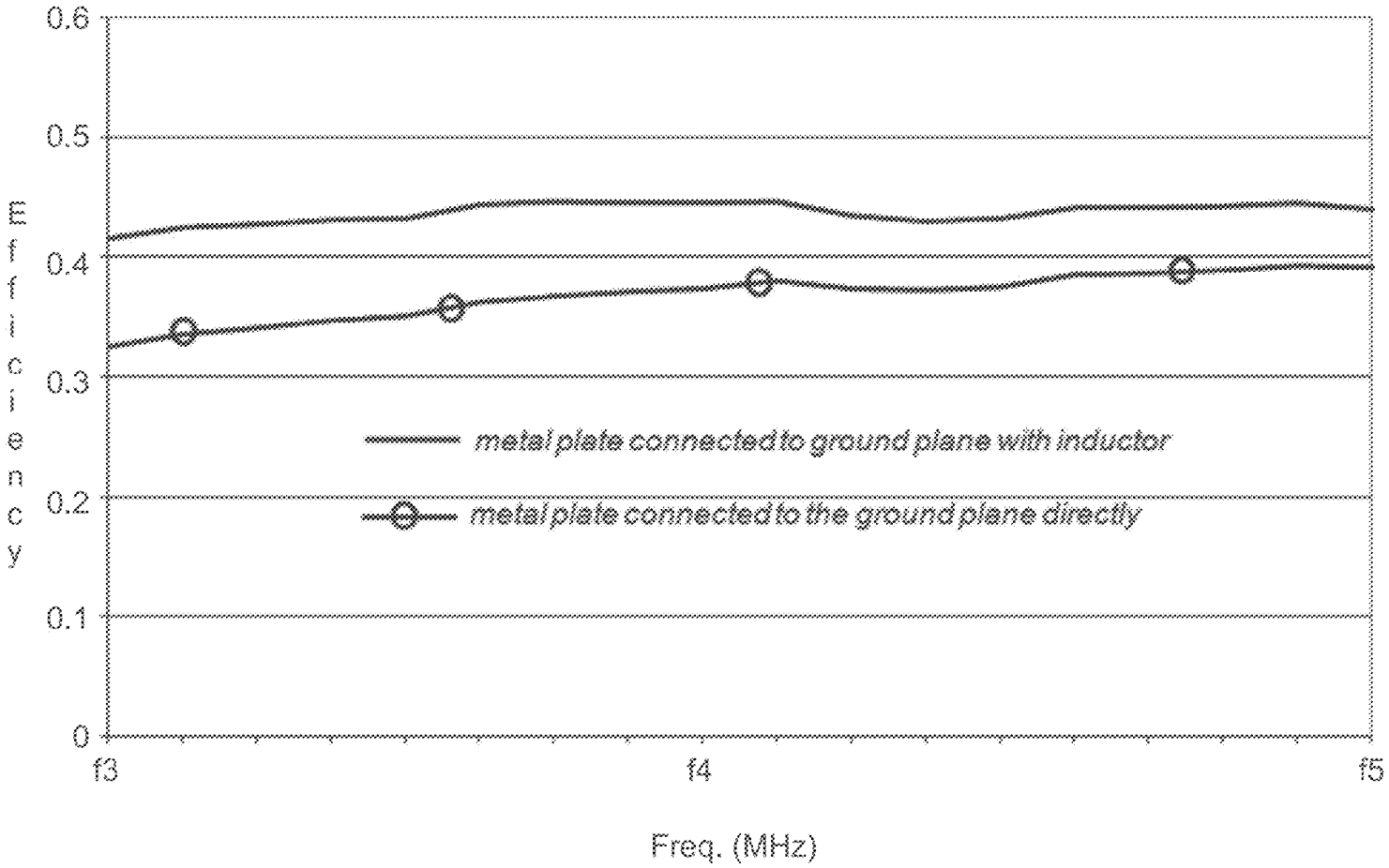
FIG. 18B illustrates a comparison of the upper frequency range of the measured radiation antenna efficiency of the MTM antenna shown in FIGS. 16A-16D, and the same antenna with metal plates connected to the ground plane directly.

FIGS. 18A and 18B plots a comparison of the radiation antenna efficiency of the MTM antenna 1651 over a lower and upper frequency range, respectively, between the top metal plate 1605 connected directly to the ground plane and the top metal plate 1605 connected to the ground plane through the frequency-dependent connector 1607, such as an inductor, as illustrated in FIG. 16D. The results in both figures indicate that the efficiency of the MTM antenna 1651 of the lower and upper frequency range is higher when the top metal plate is connected to the ground plane through the inductor. Thus, as evidenced in FIGS. 17, and 18A-8B, the frequency-dependent connector, such as an inductor, may be used in compact integrated circuit designs to isolate the RF interference associated with the surrounding objects from the MTM antenna 1651 and improve antenna performance metrics such as return loss and efficiency.

Figure 19A:
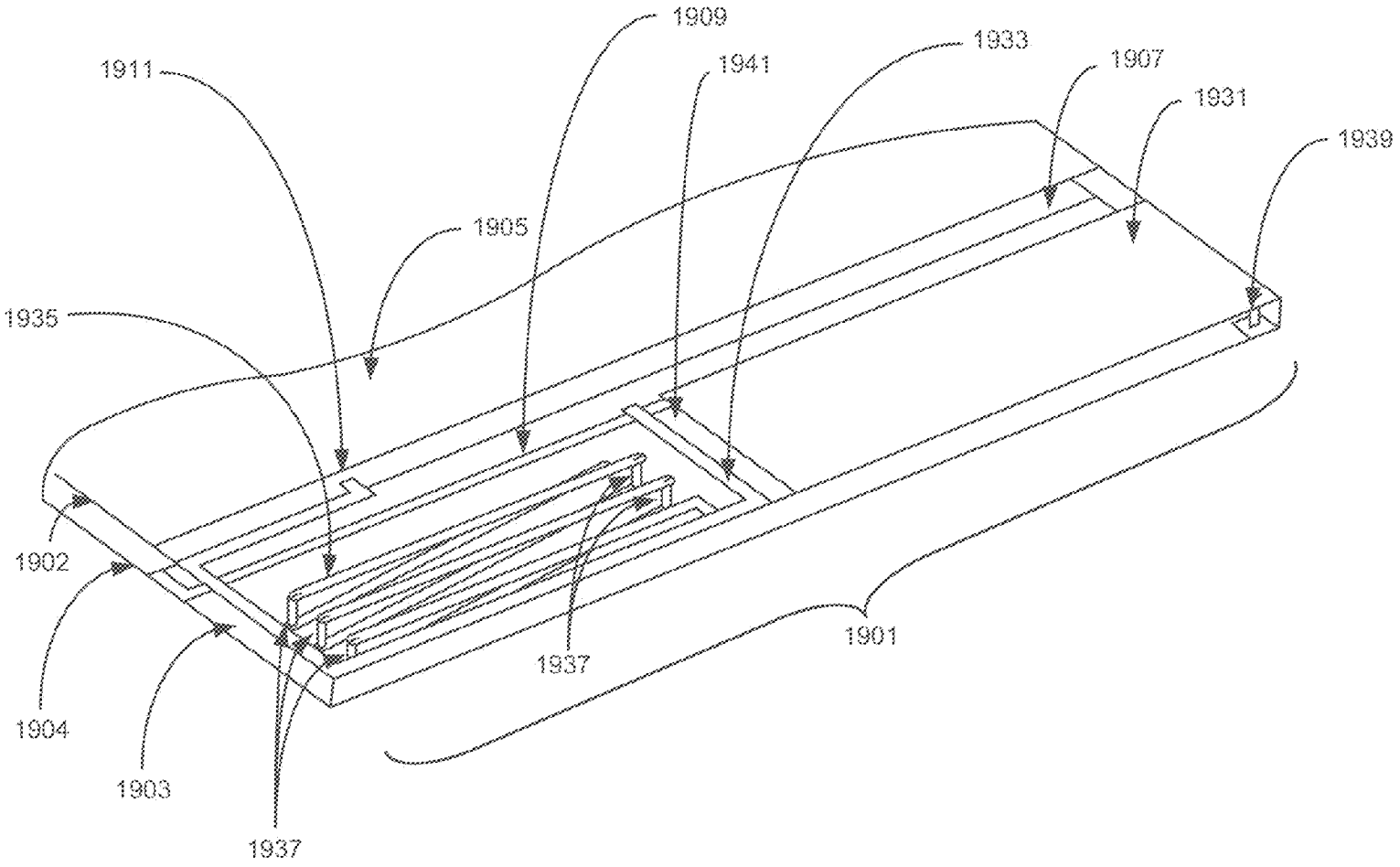
FIG. 19A illustrates a 3D perspective view of a planar MTM antenna used in a wireless device with a frequency-dependent connection to a ground plane configuration, according to an example embodiment.
Figures 19B, 19C:
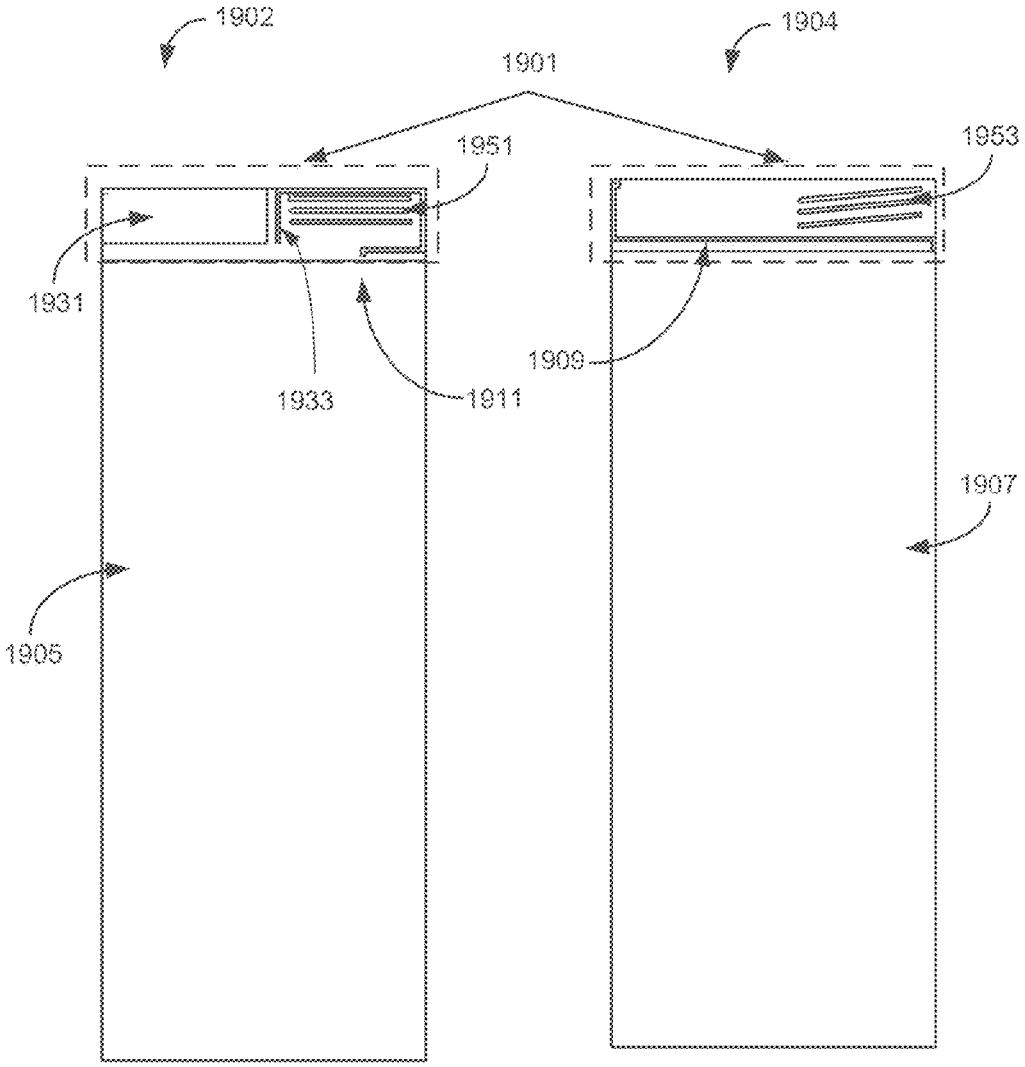
FIG. 19B illustrates a top view of the planar MTM antenna of FIG. 8A, according to an example embodiment.
FIG. 19C illustrates a bottom view of the planar MTM antenna of FIGS. 19A and 19B, according to an example embodiment.

Other MTM antenna designs of the wireless device 1600 shown in FIG. 16A-16D may include a planar antenna design 1901 as illustrated in FIGS. 19A-19C. An isometric view, a top view of a top layer, and a top view of bottom layer of a planar MTM antenna are illustrated in FIGS. 19A-19C, respectively.

In the isometric view illustrated in FIG. 19A, the MTM antenna 1901 is located at a distal end of a substrate 1903. A top ground plane 1905 is formed on a top layer 1902 and adjacent to the MTM antenna 1901. For clarity, a top view of the top layer 1902 is also provided in FIG. 19B to distinguish the MTM antenna 1901 from several overlapping structural elements shown in FIG. 19A. Referring to FIGS. 19A and 19B, the planar MTM antenna 1901 may include several conductive portions such as a cell patch 1931 which is formed on the top layer 1902 of the substrate 1903, a feed line 1933 which is capacitively coupled to the cell patch 1931 through a coupling gap 1941 to direct an antenna signal to and from the cell patch 1931, a conductive spiral 1935 which is attached to the feed line 1933 and formed on the top layer 1902 and a bottom layer 1904 of the substrate 1903. The distal end of the feed line 1933 is coupled to a feed port 1911 which may be in communication with an antenna circuit that generates and supplies an antenna signal to be transmitted out through the antenna, or receives and processes an antenna signal received through the antenna. Several vias 1937 are inserted in the respective via holes so as to provide conductive connections between the conductive portions in the top layer 1902 and those in the bottom layer 1904. In this example, a conductive spiral 1935 is attached to the feed line 1933. The conductive spiral 1935 includes a top spiral portion 1951, a bottom spiral portion 1953, and the vias 1937 penetrating through the substrate 1903. Both top and bottom spiral portions 1951, 1953 are referenced in FIG. 19B and FIG. 19C, respectively. A top view of the bottom layer 1904 is also provided in FIG. 19C to distinguish the antenna structure from several overlapping structural elements shown in FIG. 19A. In FIG. 19B, the top spiral portion 1951 is comprised of discrete segments formed in the top layer 1902;

Referring to FIG. 19C, the bottom spiral portion 1953 is comprised of another set of discrete segments formed in the bottom layer 1904 as illustrated; and the vias 1937 are used to connect the top and bottom discrete segments to form a vertical spiral shape as shown in FIG. 19A. An additional conductive line attached to the feed line 1933 can induce an RH monopole resonance. Instead of the vertical spiral as used in this example, a meander line, a zigzag line or other type of lines or strips can be used. Alternatively, the feed line 1933 and the conductive spiral 1935 can be connected directly but with a different total length. A via line 1909 is formed in the bottom layer 1904 and coupled to the bottom ground plane 1907. A via 1939 connects the cell patch 1931 in the top layer 1902 to the via line 1909 in the bottom layer 1904.

In operation, the performance of this planar MTM antenna 1901 in a wireless device 1600 may be reduced when placed nearby objects such as the human body, thus lowering the overall handheld device performance. Other isolation techniques and structures, as described in the previous embodiments, may be applied to this MTM antenna configuration in order to maintain the antenna performance where the MTM antenna 1901 is proximate to another conducting plane. For example, to eliminate or minimize interferences from nearby sources such as the human body or other external objects, the planar MTM antenna 1901 may be elevated and metal plates may be added underneath the planar MTM antenna 1901 to shield these interferences. However, in instances where these metal plates are connected to ground plane to support other circuit elements, these metal plates may hinder or degrade the performance of the MTM antenna 1901. Thus, controlling and isolating the RF interference from the metal plate underneath an elevated MTM antenna from the ground plane is important in terms of antenna performance. An implementation of an elevated MTM antenna using isolating techniques and structures is provided in the next section.

FIGS. 20A-20D illustrate multiple views of a wireless device 2000 with an elevated MTM antenna 2007 and a frequency dependent connection to a ground plane. Elevated antenna designs may be constructed to improve antenna performance by forming the antenna over multiple surfaces and substrates.

An embodiment of a wireless device supporting an elevated MTM antenna and using one or more frequency-dependent structures to isolate certain circuit components from the elevated MTM antenna may include a device enclosure; a first planar substrate having a first surface and a second surface, different from the first surface; a ground plane supported by the first and second surfaces of the first planar substrate; a first metal plate supported by the first surface of the first planar substrate; a second metal plate supported by the second surface of the first planar substrate; several of vias formed in the first planar substrate for connecting the first metal plate and the second metal plate; an electrical component supported by the first surface of the first planer substrate for connecting the first metal plate to the ground plane, wherein an RF frequency source determines an impedance associated with the electrical component; an antenna section configured to be substantially in parallel with and in proximity to a planar section of the device enclosure, comprising: a second planar substrate, and at least one conductive portion associated with the second planar substrate; and a third planar substrate configured to be substantially in parallel with and in proximity to a planar section of the device enclosure, in which the at least one conductive portion form a composite right and left handed (CRLH) metamaterial structure configured to support at least one frequency resonance in a first antenna signal associated with the antenna section.

Figure 20A:
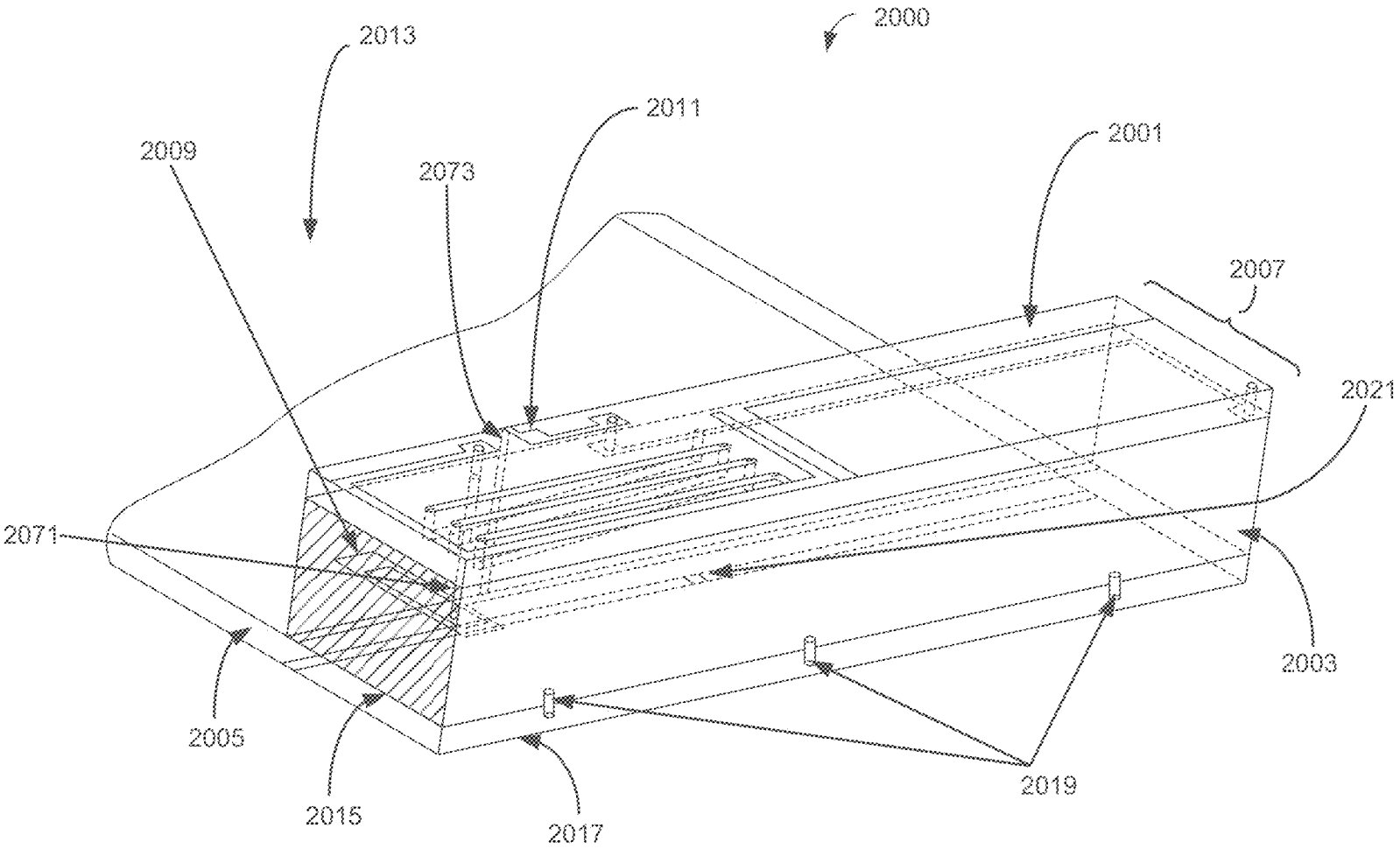
FIGS. 20A-20E illustrate multiple views of an elevated MTM antenna structure with a frequency-dependent connection to a ground plane, according to an example embodiment.

FIG. 20A illustrates an isometric view of the wireless device 2000 supporting an elevated MTM antenna and using one or more frequency-dependent structures to isolate certain circuit components from the elevated MTM antenna. The wireless device includes three substrates: a first substrate 2001, a second substrate 2003, and a third substrate 2005. The three substrates may be stacked in the order where the first substrate 2001 is configured to be the top layer, a third substrate 2005 is configured to be the bottom layer, and the second substrate 2003 is configured to be between the first substrate 2001 and a third substrate 2005. Various types of substrate materials may be used in the wireless device 2000 design shown in FIGS. 20A-20D. For example, an FR-4 material may be used for the first substrate 2001 AND the third substrate 2005, while air may be used for the second substrate 2003.

Figure 20B:
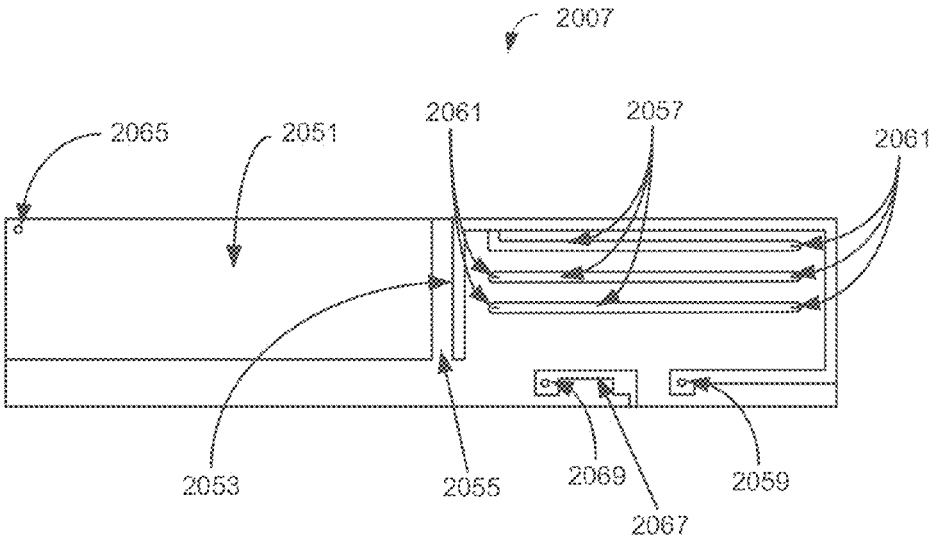
Figure 20C:
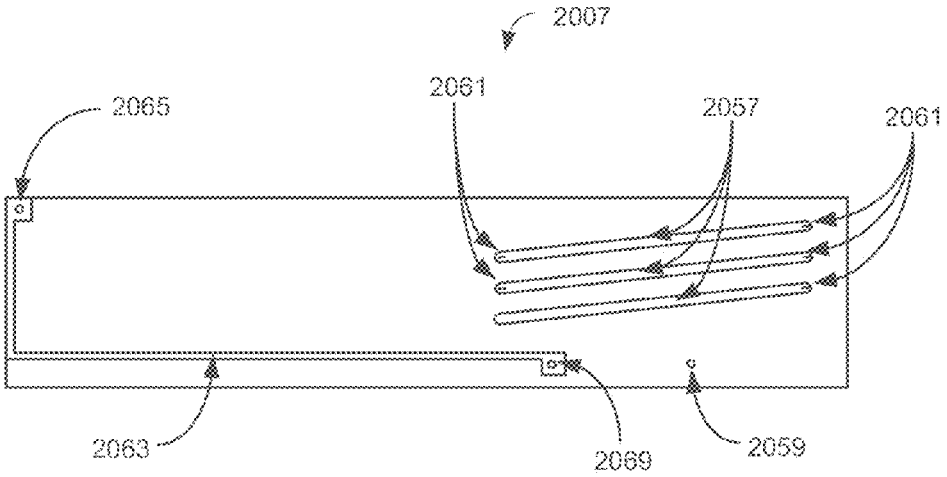

The wireless device 2000 includes an elevated MTM antenna 2007 fabricated on the first substrate 2001 as shown in FIG. 20A. FIGS. 20B-20C provide illustrations of a top view of a top and a bottom layer, respectively, of the elevated MTM antenna 2007 to distinguish the antenna from several other overlapping structural elements shown in FIG. 20A. In FIGS. 20B-20C, the elevated MTM antenna 2007 may include several conductive portions such as a cell patch 2051 which is formed on a top layer of the first substrate 2001, a feed line 2053 which is capacitively coupled to the cell patch 2051 through a coupling gap 2055 to direct an antenna signal to and from the cell patch 2051, a conductive spiral 2057 which is attached to the feed line 2053 and formed on the top layer and a bottom layer of the first substrate 2001. The distal end of the feed line 2053 is coupled to the antenna input port 2009, shown in FIG. 20A and FIG. 20D, by way of a via 2059 penetrating the first substrate 2001 and a conductive line 2071 which connects the feed line 2053 to the antenna input port 2009. The feed line 2053 may be in communication with an antenna circuit that generates and supplies an antenna signal to be transmitted out through the antenna, or receives and processes an antenna signal received through the antenna. Referring again to FIGS. 20B-20C, several vias 2061 are inserted in the respective via holes so as to provide conductive connections between the conductive portions in the top layer and those in the bottom layer of the first substrate 2001. In this example, a conductive spiral 2057 is attached to the feed line 2053. The conductive spiral 2057 includes a top spiral portion, a bottom spiral portion, and the vias 2061 penetrating through the first substrate 2001. The top spiral portion is comprised of discrete segments formed in the top layer; the bottom spiral portion is comprised of another set of discrete segments formed in the bottom layer; and the vias 2061 are used to connect the top and bottom discrete segments to form a vertical spiral shape. An additional conductive line attached to the feed line 2053 can induce an RH monopole resonance. Instead of the vertical spiral as used in this example, a meander line, a zigzag line or other type of lines or strips can be used. Alternatively, the feed line 2053 and the conductive spiral 2057 can be connected directly but with a different total length. Referring to FIG. 20C, a long via line 2063 is formed in the bottom layer of the first substrate 2001 and connected to a short via line 2067 shown in FIG. 20B, which is formed on the top layer of the first substrate 2001, through a via 2069. The short via line 2067 is connected to a top ground plane 2013 by a vertical strip of metal 2073 that extends along the perpendicular side of the first substrate 2001 and the second substrate 2003. A via 2065 connects the cell patch 2051 in the top layer to the via line 2063 in the bottom layer of the first substrate 2001.

Additional structural elements illustrated in FIG. 20A include a ground plane, which is formed on both sides of the third substrate 2005. The ground plane includes two conductive planes, the top ground plane 2013 and a bottom ground plane 2023, which may be connected by using an array of vias (not shown) formed in the third substrate 2005 or by conductive lines formed along the perpendicular edge of the third substrate 2005. An antenna via line 2011 may be connected to the top ground plane 2013 through the via line 2011 which extends along the perpendicular side of the first substrate 2001 and the second substrate 2003. By terminating the via line 2011 to the top ground plane 2013, the MTM antenna 2007 can use the entire ground plane 2013 as part of the radiator to increase efficiency. Top and bottom metal plates 2015, 2017 have the same footprint area as the first substrate and are added on both sides of the third substrate 2005. The two metal plates 2015, 2017 are connected by several vias 2019.

Figure 20D:
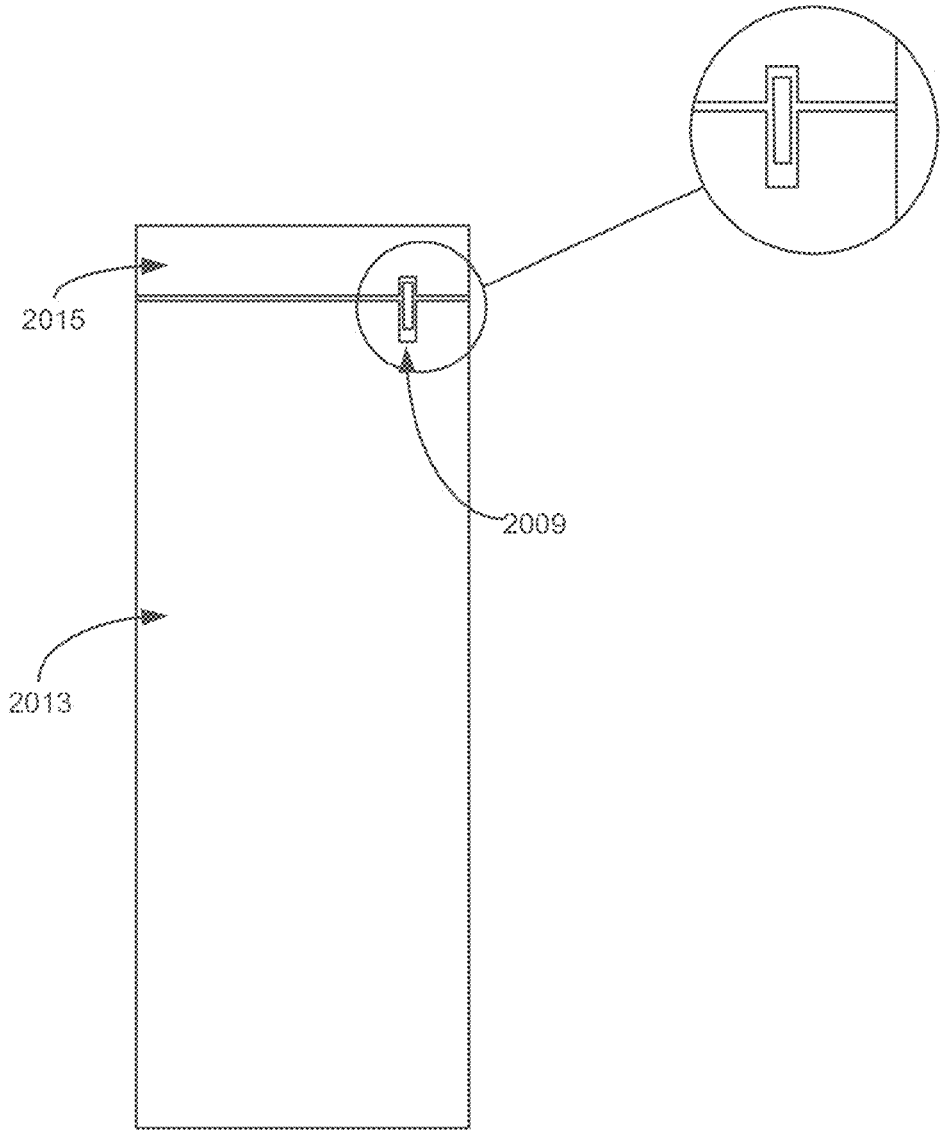
Figure 20E:
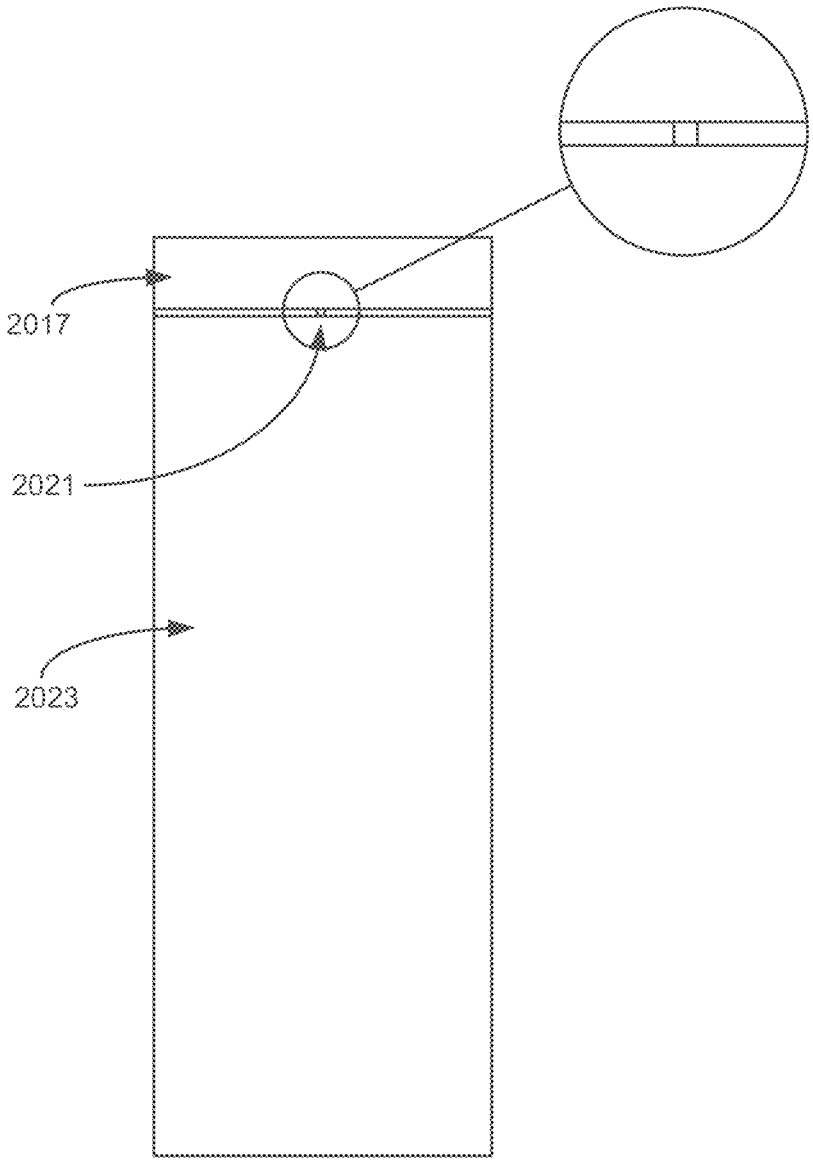

In operation, the top and bottom metal plates 2015, 2017 of the wireless device 2000 illustrated in FIGS. 20A, 20D, and 20E can act as a shield and thus minimize the impact of the human body effect emanating from the bottom side of the third substrate 2005. While these metal plates 2015, 2017 may provide sufficient shielding for the elevated MTM antenna 2007, integrating other RF circuitries in the metal plates 2015, 2017 can save additional space on the wireless device 2000. During DC operation, a DC current can be supplied to the metal plates 2015, 2017 to support the RF circuitries. However, at high RF operation, undesirable interactions between these RF circuitries and the elevated MTM antenna 2007 may be present and reduce the performance of the antenna. Thus, isolating the elevated MTM antenna 2007 from the metal plates 2015, 2017 at certain frequencies may be of particular interest and advantageous in terms of antenna performance.

In FIG. 20E, for example, an electrical component 2021 having frequency-dependent properties, such as an inductor, may be coupled between the top metal plate 2015 and the bottom ground plane 2023 to isolate the top metal plate 2015, including the bottom metal plate 2017, from the elevated MTM antenna 2007 at certain frequencies. At DC operation, for example, the inductor 2021 may act as a low impedance component which allows DC current from the integrated circuitries formed on the metal plates 2015, 2017 to be transferred to other circuit components in the wireless device 2000 without distortion. However, at a high frequency range or microwave frequency, the inductor 2021 may act as a high impedance component which can block RF current from flowing to the metal plates 2015, 2017 and thus prevent interference associated with the metal plates 2015, 2017, from affecting the MTM antenna performance during high frequency operation.

Figure 21:
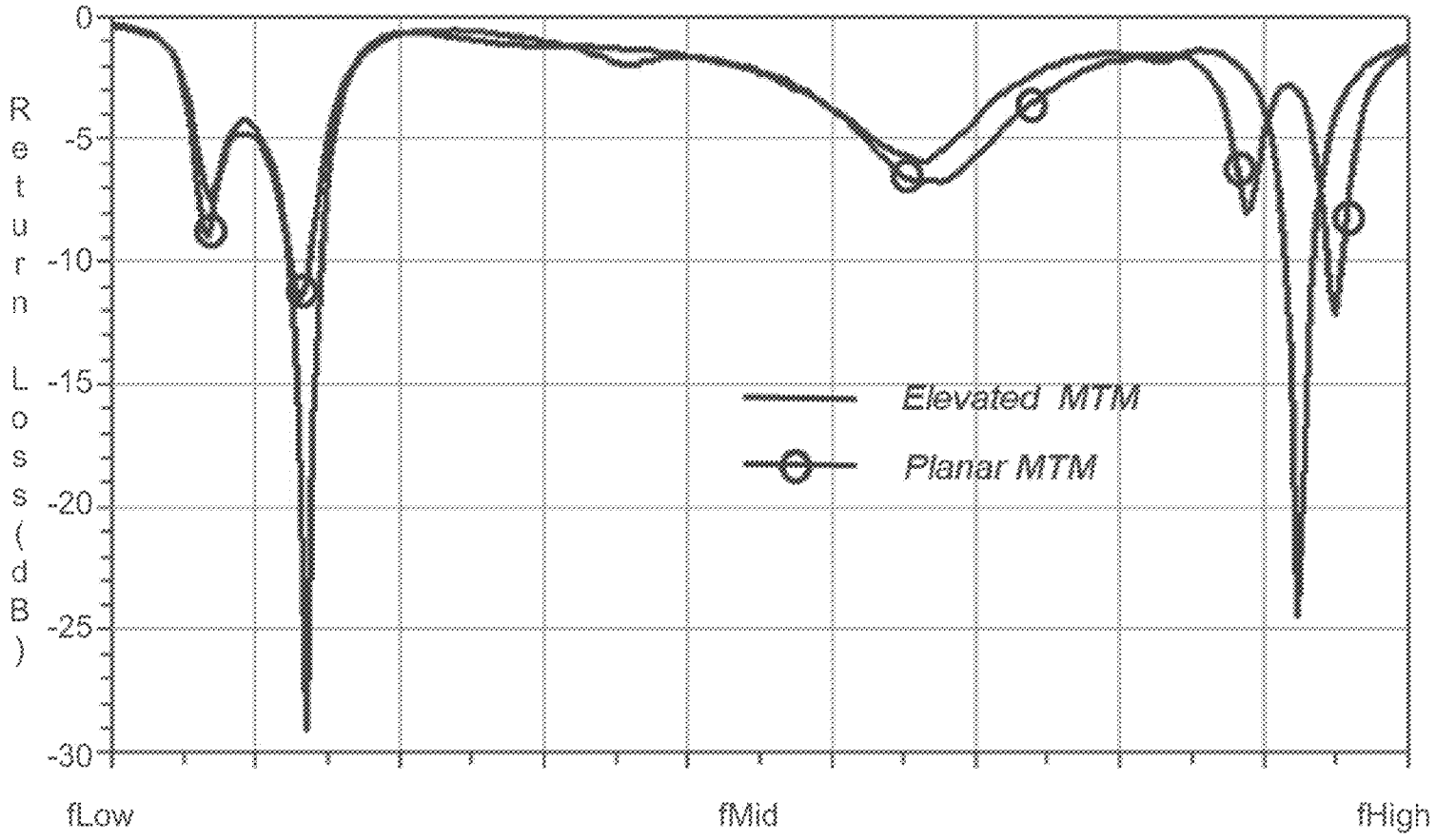
FIG. 21 illustrates the return losses of a planar MTM antenna, such as illustrated in FIGS. 19A-19C and an elevated MTM antenna illustrated in FIGS. 20A-20G, according to example embodiments.

FIG. 21 illustrates a plot of the return loss of the planar MTM antenna such as illustrated in FIGS. 19A-19C compared to the return loss of an elevated MTM antenna which is used in the wireless device 2000 such as illustrated in FIGS. 20A-20E. The return loss is plotted in dB as a function of transmission frequency. The results plotted in FIG. 21 show that in some embodiments the elevated MTM antenna 2007 has similar impedance matching as the planar MTM antenna 1901 at certain frequencies. Thus, the elevated MTM antenna 2007 of FIG. 20 offers the benefit of providing adequate shielding through the use of the metal plates 2015, 2017 while yielding similar impedance matching results in comparison to the planar MTM antenna illustrated in FIG. 19.

Figure 22:
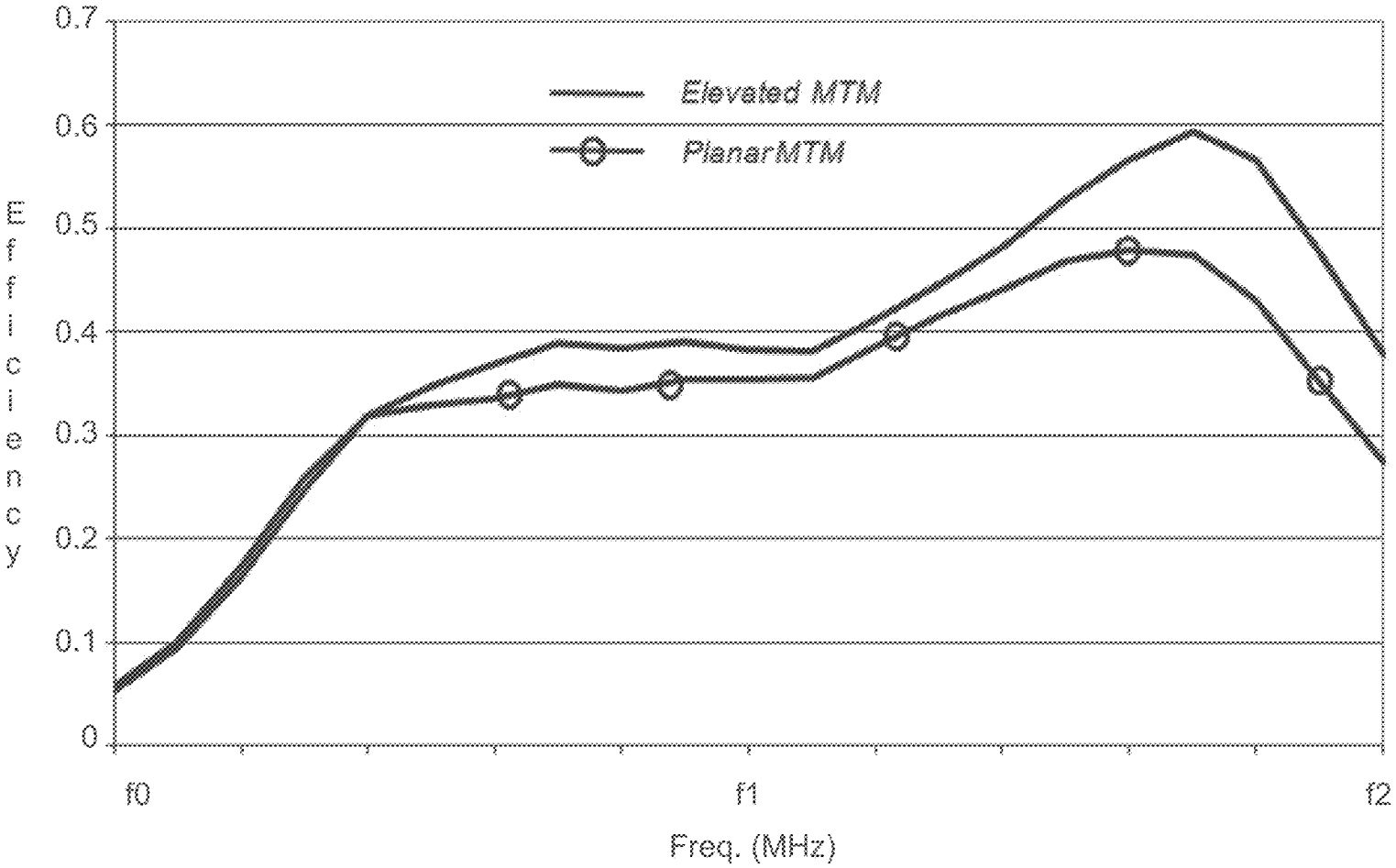
FIG. 22 illustrates a comparison of the radiation efficiencies between elevated MTM antennas and planar MTM antennas for the lower frequency ranges, according to example embodiments.
Figure 23:
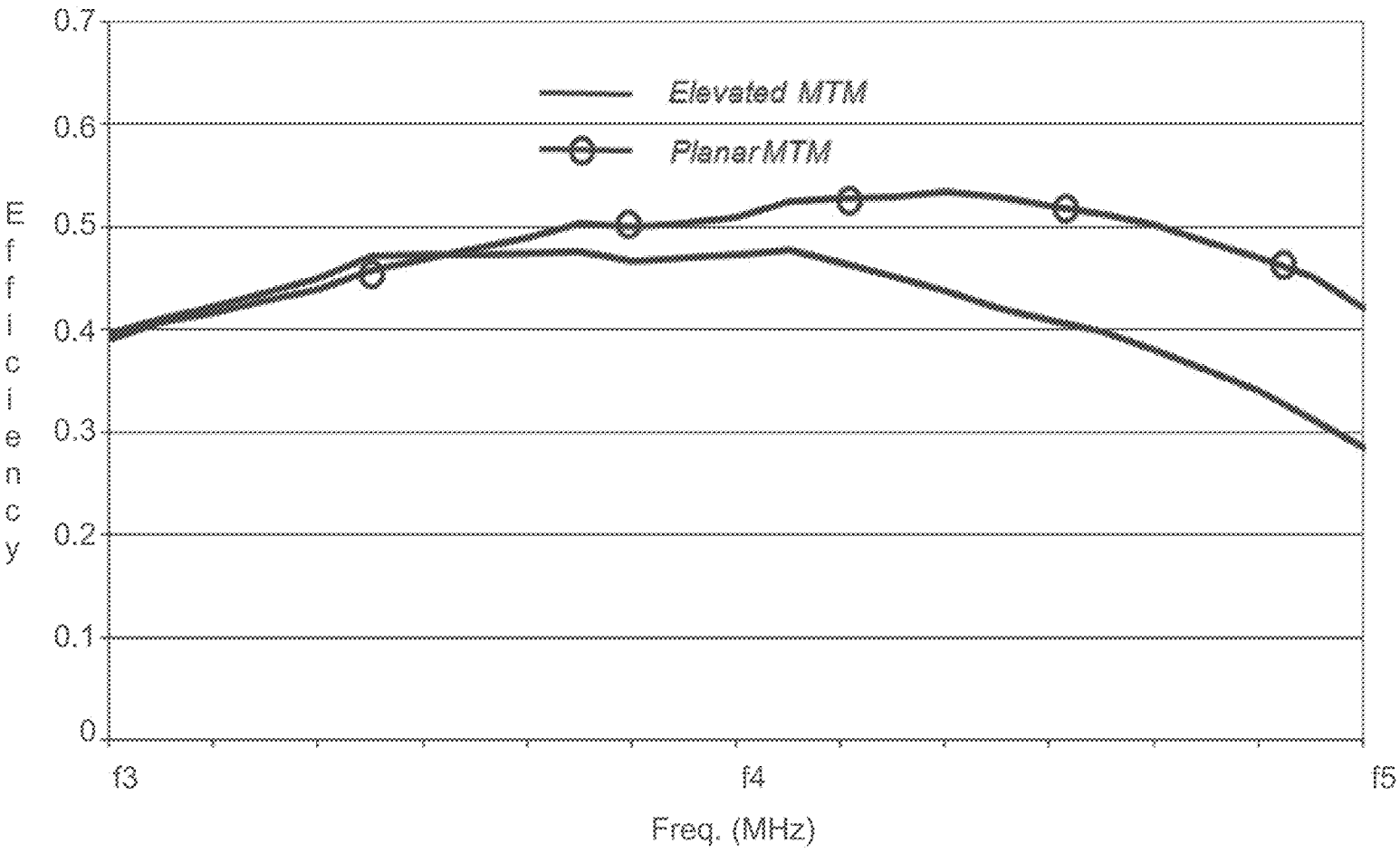
FIG. 23 illustrates a comparison of the radiation efficiencies between elevated MTM antennas and planar MTM antennas for the upper frequency ranges, according to example embodiments.

FIG. 22 and FIG. 23 illustrate radiation efficiencies for elevated MTM antennas and planar MTM antennas over low band of frequencies and high band of frequencies, respectively. In FIG. 22 figures, the elevated MTM antenna demonstrates better antenna efficiencies in the low band than the planar MTM antenna. In FIG. 23, both planar and elevated MTM antenna demonstrates comparable antenna efficiencies in the high band. Thus, the elevated MTM antenna 2007 of FIG. 20 offers the benefit of providing adequate shielding through the use of the metal plates 2015, 2017 while yielding better or comparable efficiency results in comparison to the planar MTM antenna illustrated in FIG. 19.

Figure 24:
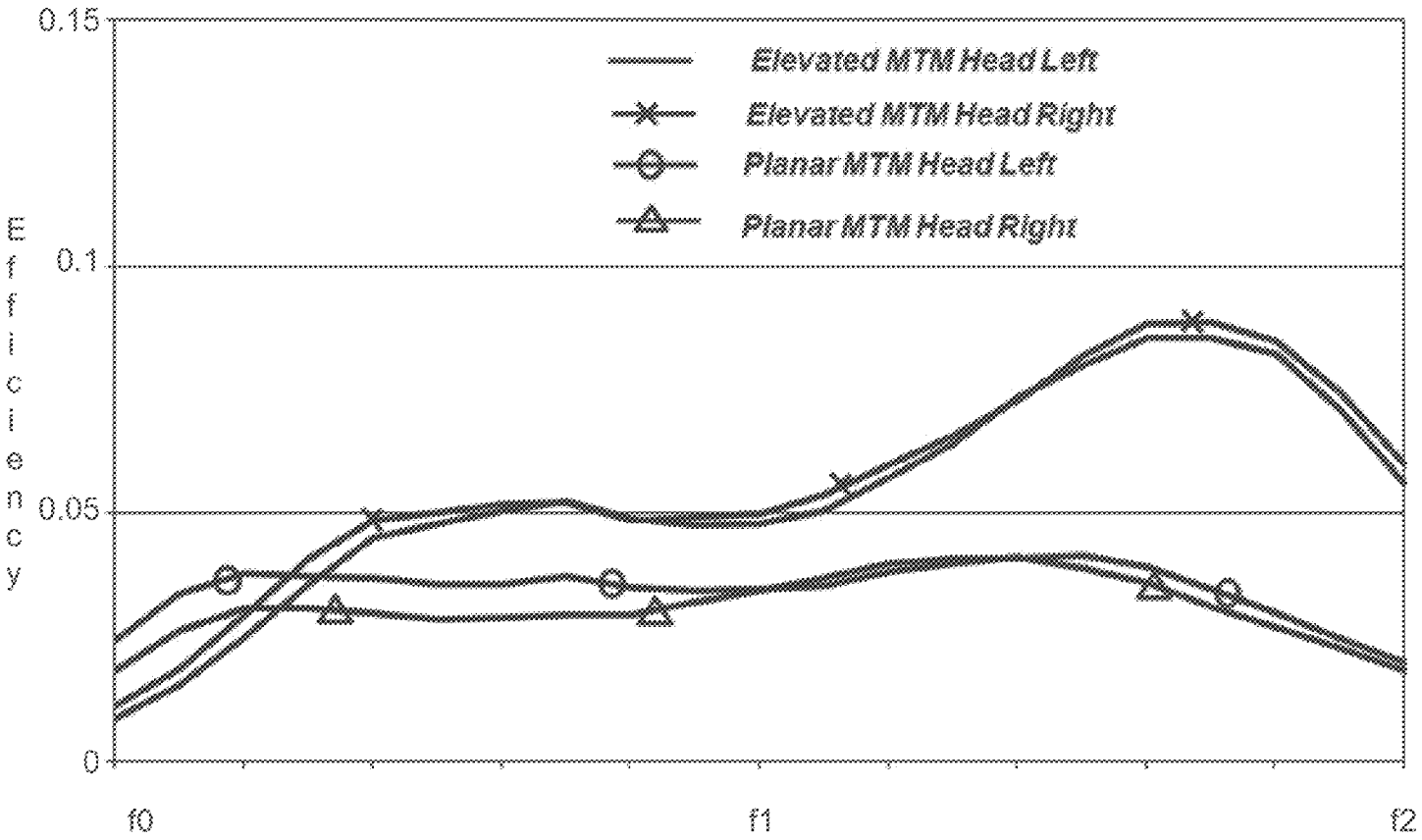
FIG. 24 illustrates the lower frequency ranges of the measured antenna efficiencies over various frequency ranges comparing the planar MTM antenna and the elevated MTM antenna for radiation performance testing involving a human head application.
Figure 25:
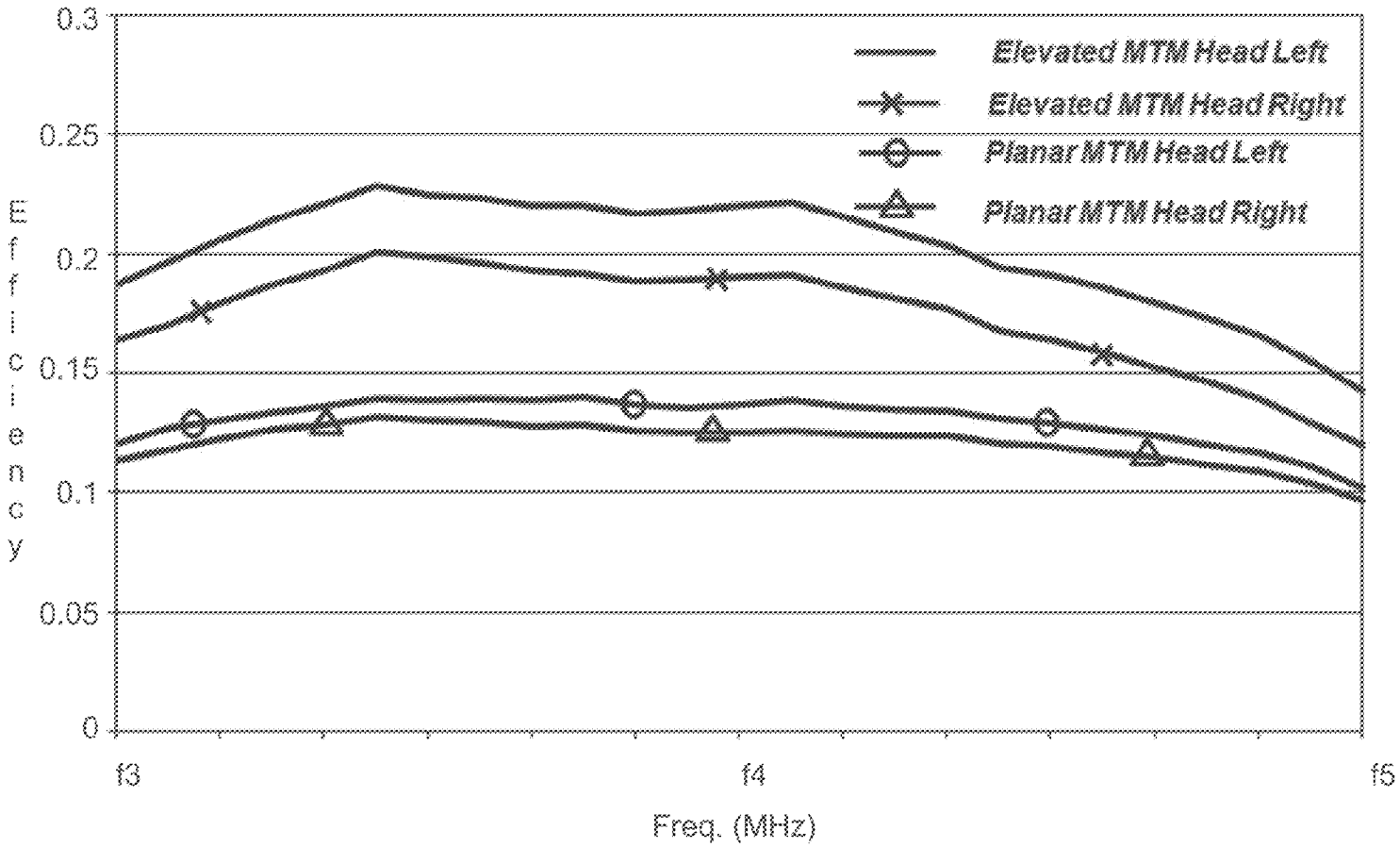
FIG. 25 illustrates the upper frequency ranges of the measured efficiencies over various frequency ranges comparing the planar MTM antenna and the elevated MTM antenna for radiation performance testing involving a human head application.

FIG. 24 and FIG. 25 illustrate antenna efficiencies over various frequency ranges comparing the planar MTM antenna and the elevated MTM antenna for radiation performance testing involving a human head application, such as a left and a right side of a human head phantom. By comparison, the figures demonstrate that the elevated MTM antenna has better antenna efficiency than the planar MTM antenna in human head applications. These results further support the effectiveness of the metal plates employed in applications involving proximity effects caused by the human body.

An embodiment of a wireless device supporting a planar MTM antenna having multiple cell patch structures and using one or more frequency-dependent structures to isolate certain circuit components from the elevated MTM antenna may include a device enclosure; a substrate structure residing inside the device enclosure, the substrate structure having a first surface and a second surface, different from the first surface; a ground electrode supported by the first and second surfaces of the substrate structure; a first metal plate and a second metal plate supported by the first surface of the substrate structure; a first electrical component for connecting the first metal plate to the ground electrode, wherein an RF frequency source determines an impedance associated with the first electrical component; a second electrical component for connecting the second metal plate to the ground electrode, wherein an RF frequency source determines an impedance associated with the second electrical component; and Several electrically conductive portions supported by the substrate structure, in which the ground electrode, at least part of the substrate structure and the electrically conductive portions are configured to form a composite left and right handed (CRLH) metamaterial antenna structure that exhibits one or more frequency resonances associated with an antenna signal.

Figure 26A:
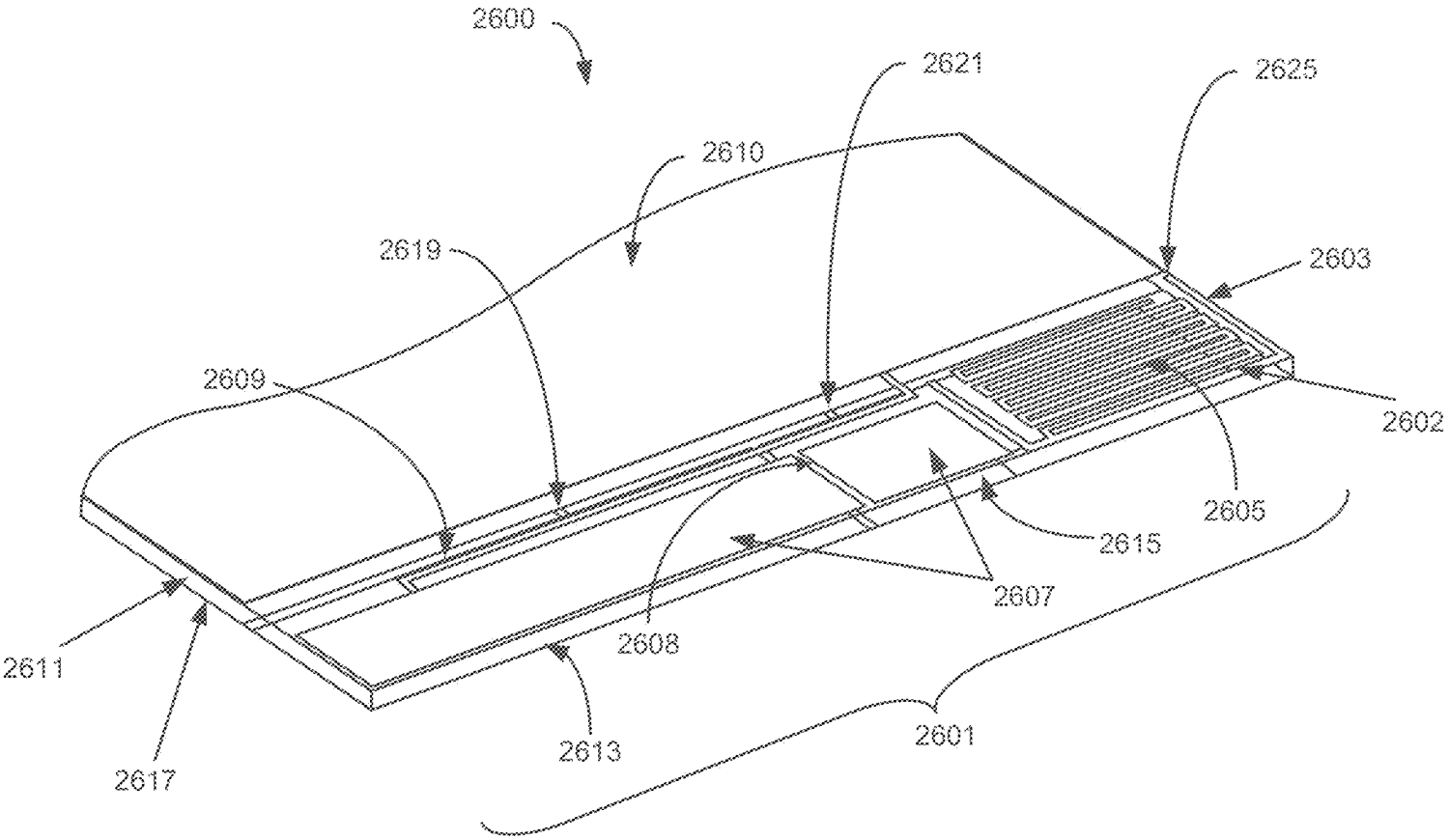
FIG. 26A illustrates a 3D perspective view of a planar MTM antenna having multiple cell patch structures used in a wireless device with a frequency-dependent connection to a ground plane, according to an example embodiment.
Figure 26B:
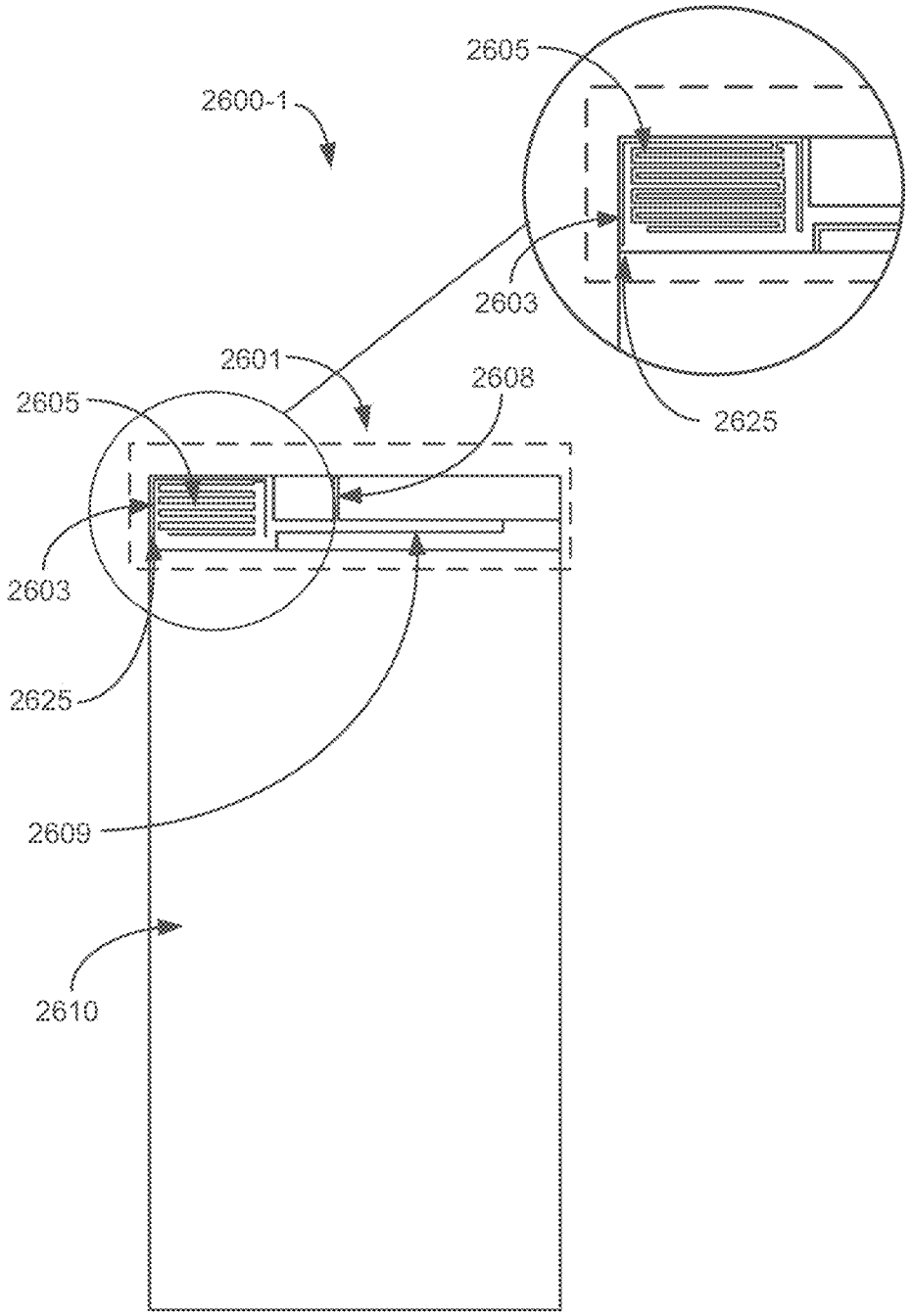
FIG. 26B illustrates a top view of the planar MTM antenna configuration as in FIG. 26A, according to an example embodiment.
Figure 26C:
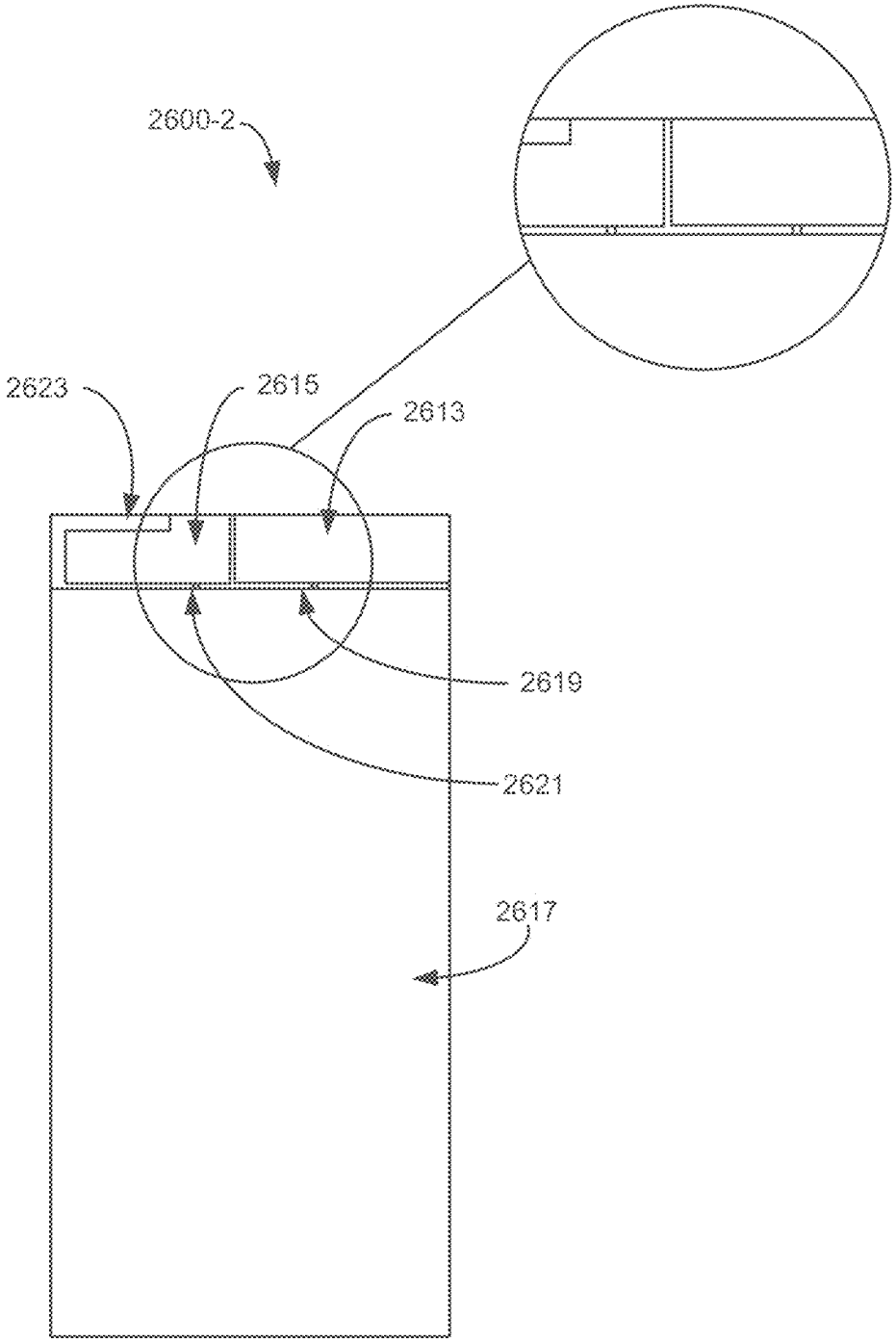
FIG. 26C illustrates a bottom view of the planar MTM antenna configuration of FIGS. 26A and 26B, according to an example embodiment.

FIG. 26A, FIG. 26B, and FIG. 26C show a isometric view, top view of a top layer 2600-1, and top view 2600-2 of a bottom layer 2600-3, respectively, of an implementation of a planar MTM antenna having multiple cell patch structures used in a wireless device 2600 with a frequency dependent connection to a ground plane.

Referring to the isometric view and the top layer 2600-1 in FIG. 26B, an MTM antenna 2601 may include a feed line 2602, a launch pad 2603 connected to the proximal end of the feed line 2602, a meander structure 2605 which is connected to the feed line 2603, a cell patch 2607 which is capacitively coupled to the distal end of the feed line 2602, a via line 2609 which is used to connect to the cell patch 2607 to a top ground plane 2610 printed on top of a substrate 2611. The cell patch 2607, in this example, includes two sections which are separated by a cut slot 2608. The substrate 2611 may be formed from printed circuit board (PCB) material such as FR-4 with a dielectric constant of 4.4 and height of 1 mm, for example. An antenna input 2625 formed at the distal end of the launch pad 2603 is used to feed RF input signals to the MTM antenna structure 2601.

Referring to the isometric view in FIG. 26A and the bottom layer 2600-2 in FIG. 26C, two metal plates, 2613 and 2615, are formed beneath substrate 2611. The two metal plates 2613 and 2615 are connected to the bottom ground plane 2617 through a pair of electrical components such as two inductors, 2619 and 2621, respectively. The top ground plane 2610 is connected to the bottom ground plane 2617 by an array of vias (not shown) through the substrate 2611 to form a single ground plane on both sides of substrate 2611.

In operation, at a DC frequency, the DC current can be supplied to other components formed on the metal plates 2613, 2615 through the two inductors 2619, 2621.

At RF frequency, two inductors act like high impedance components which can mitigate negative effects to the antenna performance. Also, metal plates 2613, 2615 can provide shielding to the MTM antenna 2601 which may improve the antenna performance when the antenna is placed near surrounding objects such as the human body. In addition, these metal plates 2613, 2615 can reduce antenna radiation to the bottom side of the substrate 2611 which may improve antenna performance related to SAR measurements. An L shape cut-out area 2623 on the metal plate 2615 may be used in this application to help impedance matching and radiation efficiency of the monopole mode which may be contributed by the launch pad 2603. The width of the cut slot 2608 and the spacing between the metal plates 2613, 2615 may be optimized to achieve improved impedance matching of the LH mode and meander mode.

Figure 27:
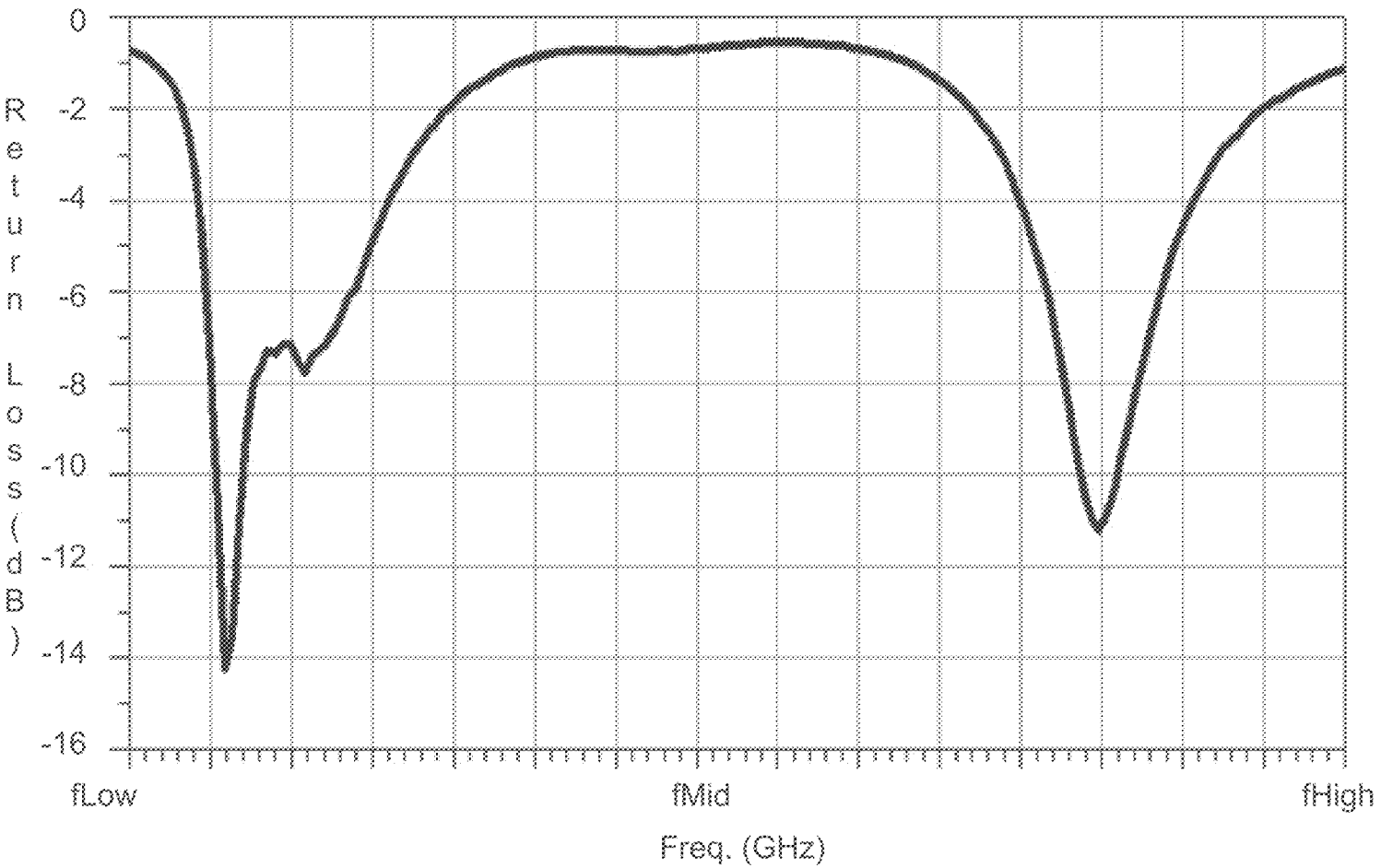
FIG. 27 illustrates the return loss of the planar MTM antenna configuration of FIGS. 26A-26C, according to an example embodiment.

FIG. 27 illustrates the return loss, in dB, of the planar MTM antenna 2601 used in the wireless device 2600 such as illustrated in FIGS. 26A-26C. The planar MTM antenna 2601 of FIG. 26 offers the benefit of providing adequate shielding through the use of the metal plates 2613, 2615 while yielding similar return loss results in comparison to the planar MTM antenna 1901 illustrated in FIG. 19.

Figure 28A:
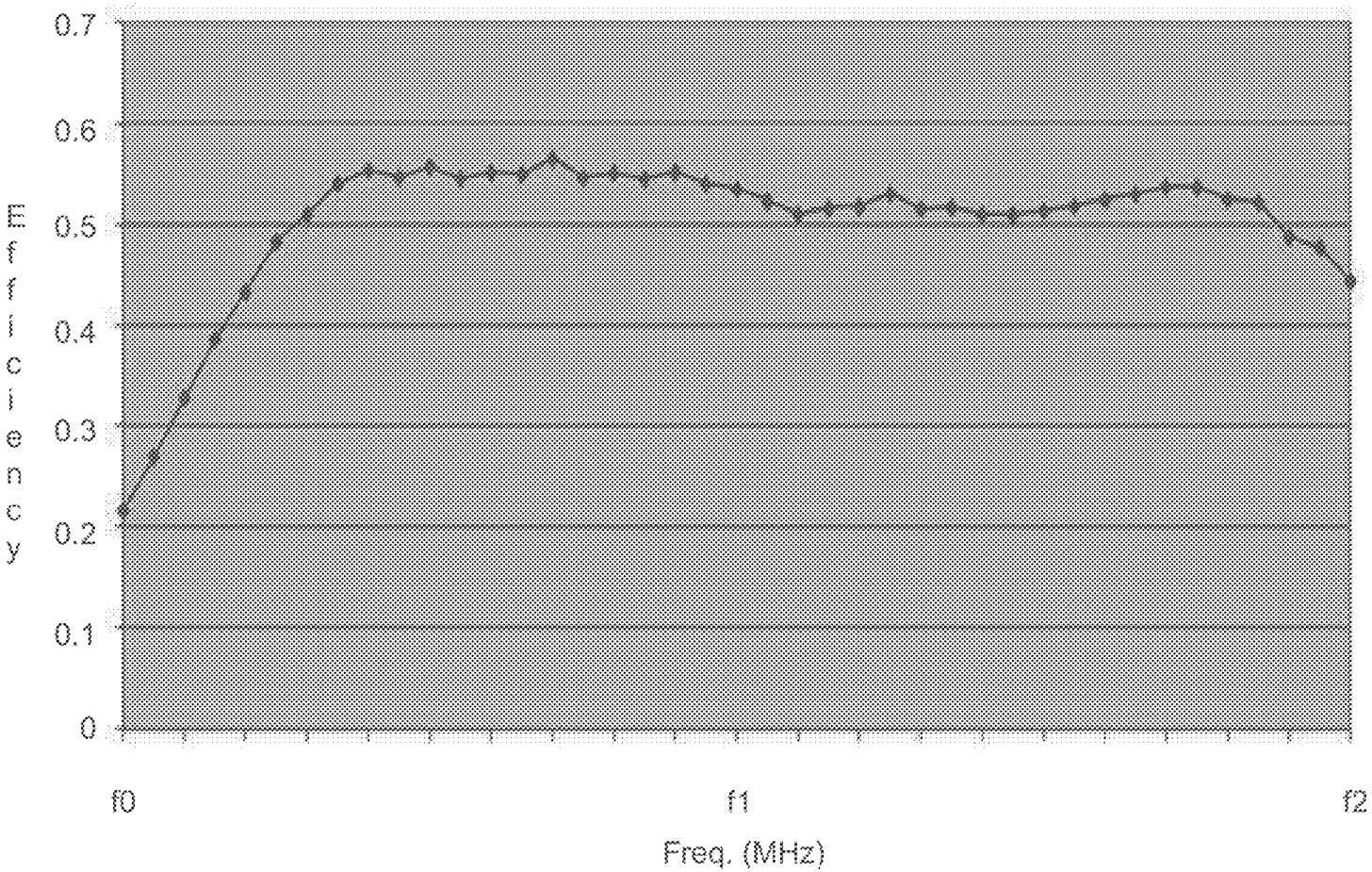
FIGS. 28A and 28B illustrate radiation efficiencies in the operational frequency bands, according to an example embodiment.
Figure 28B:
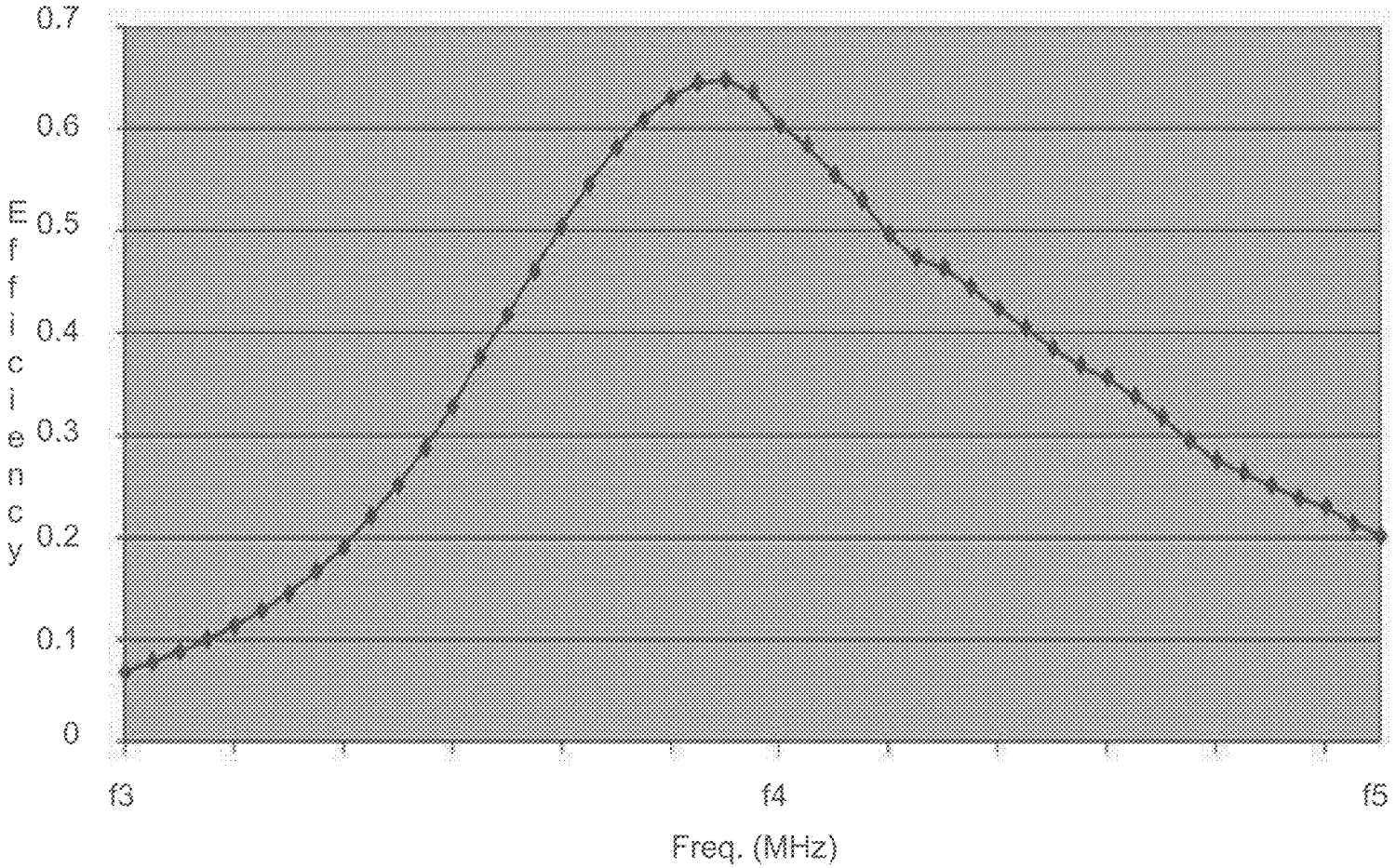

FIGS. 28A-28B illustrate the radiation efficiency for a planar MTM antenna 2601 as illustrated in FIGS. 26A-26C over multiple frequency ranges. The planar MTM antenna 2601 of FIG. 26 offers the benefit of providing adequate shielding through the use of the metal plates 2613, 2615 while yielding radiation efficiency results in comparison to the planar MTM antenna 1901 illustrated in FIG. 19.

An embodiment of a wireless USB dongle device supporting one or more non-planar MTM antennas and using one or more frequency-dependent structures to isolate certain circuit components from the elevated MTM antenna may include a device enclosure; a first planar substrate having a first surface and a second surface, different from the first surface, residing inside the device enclosure; a ground plane formed on the first and second surfaces of the first planar substrate; a first metal plate formed on the first surface of the first planar substrate; a second metal plate formed on the second surface of the first planar substrate; several vias formed in the first planar substrate for connecting the first metal plate and the second metal plate; a electrical component formed on the first surface of the first planer substrate for connecting the first metal plate to the ground plane, wherein an RF frequency source determines an impedance associated with the electrical component; a first antenna section configured to be substantially in parallel with and in proximity to a first planar section of the device enclosure, comprising: the first planar substrate, and at least one first conductive portion associated with the first planar substrate; a second antenna section configured to be substantially in parallel with and in proximity to a second planar section of the device enclosure, comprising: a second planar substrate, and at least one second conductive portion associated with the second planar substrate; and a joint antenna section connecting the first and second antenna sections; a third antenna section configured to be substantially in parallel with and in proximity to the first planar section of the device enclosure, comprising: the first planar substrate, and at least one third conductive portion associated with the first planar substrate; a forth antenna section configured to be substantially in parallel with and in proximity to a fourth planar section of the device enclosure, comprising: a fourth planar substrate, and at least one forth conductive portion associated with the forth planar substrate; and a joint antenna section connecting the third and forth antenna sections, in which the at least one first conductive portion and the at least one second conductive portion form a composite right and left handed (CRLH) metamaterial structure configured to support at least one frequency resonance in a first antenna signal associated with the first and second antenna sections, and the at least one third conductive portion and the at least forth conductive portion form another composite right and left handed (CRLH) metamaterial structure configured to support at least one frequency resonance in a second antenna signal associated with the third and fourth antenna sections.

Figure 29A:
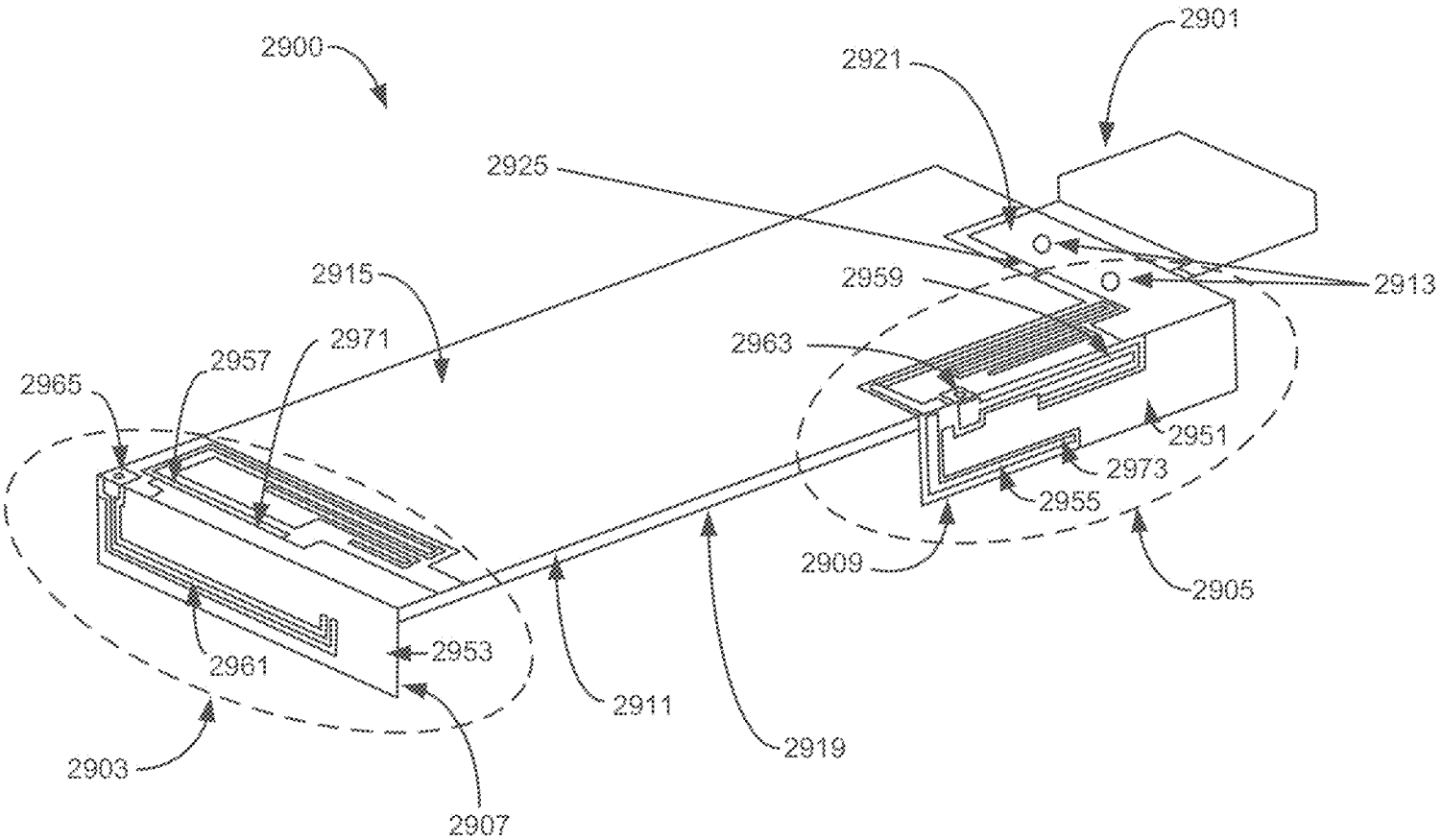
FIG. 29A illustrates a top view of a USB dongle application using an MTM antenna structure with a frequency-dependent connection to a ground plane, according to an example embodiment.
Figure 29B:
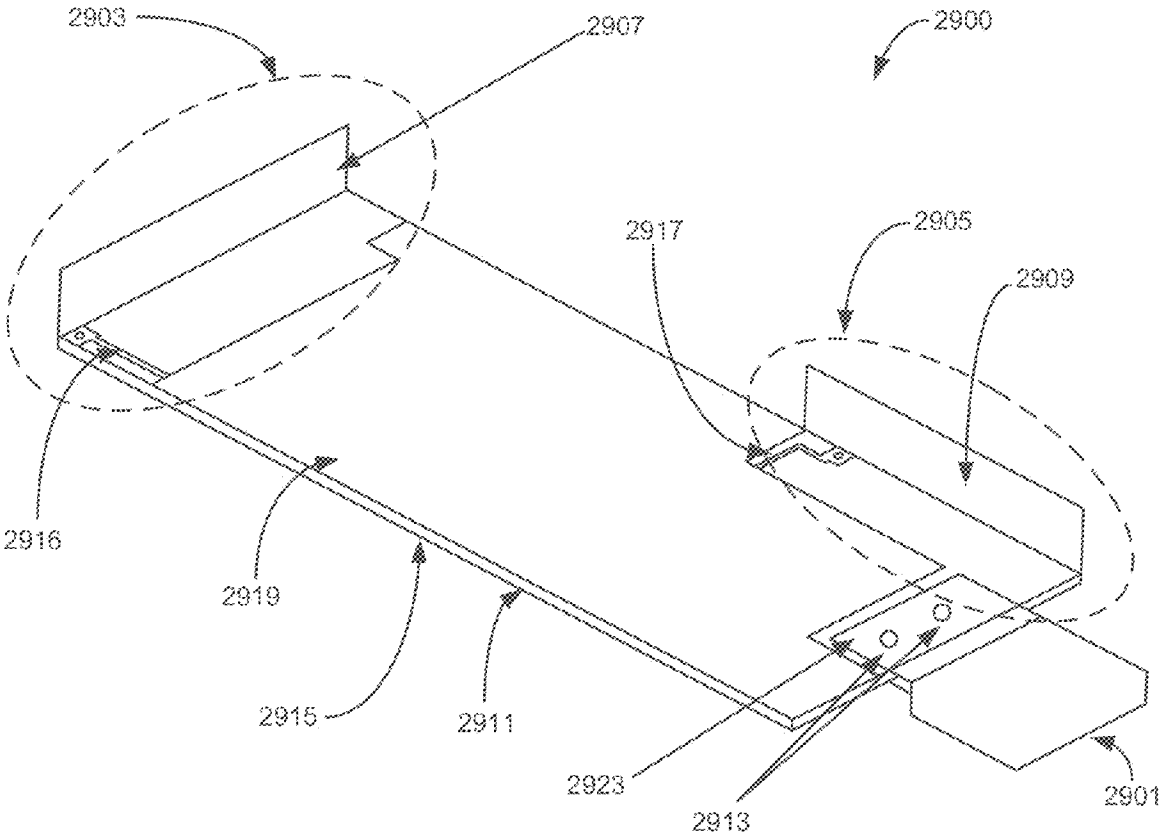
FIG. 29B illustrates a bottom view of the USB dongle application of FIG. 29A, according to an example embodiment.
Figure 29C:
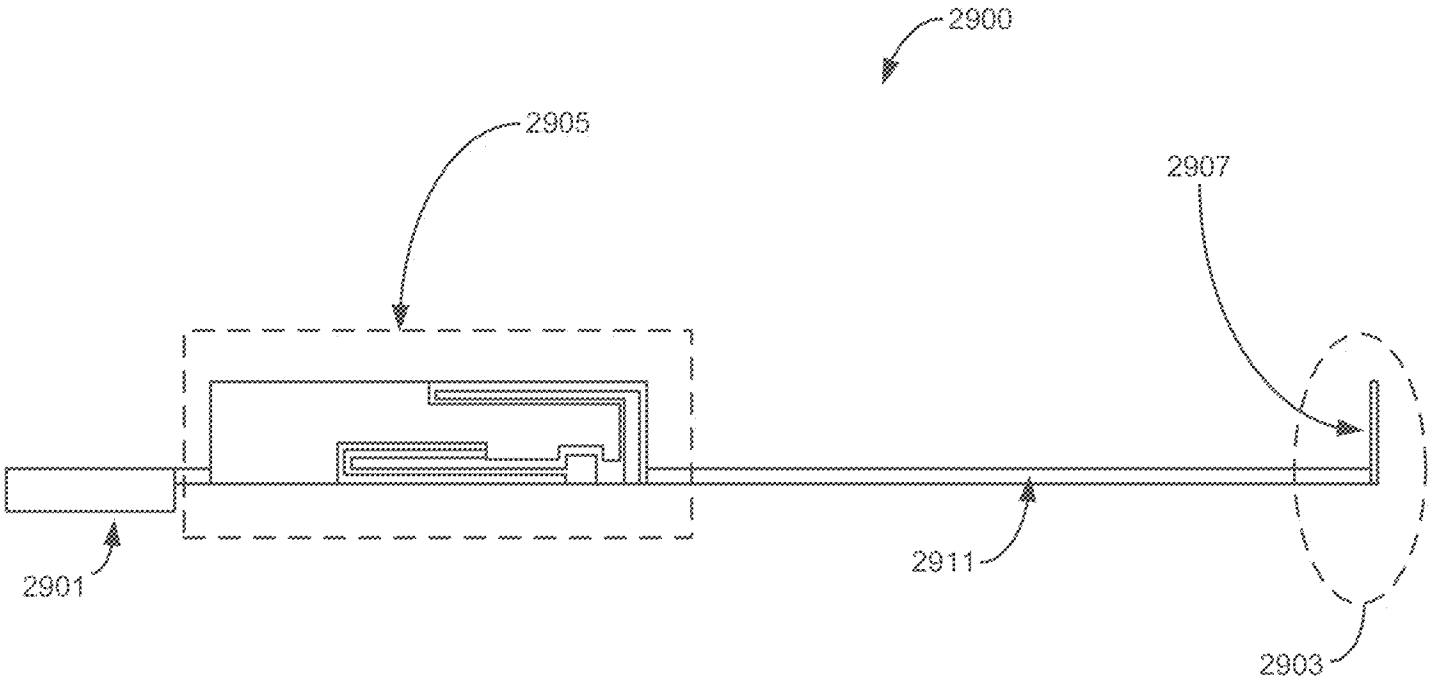
FIG. 29C illustrates a side view of the USB dongle application of FIGS. 29A and 29B, according to an example embodiment.

FIGS. 29A, 29B, and 29C illustrate the top, bottom, and side views, respectively, of a wireless USB dongle device 2900 having two non-planar, L-shaped MTM antennas 2903, 2905 with a frequency dependent connection to a ground plane. The USB dongle device 2900 includes a USB connector 2901 which may be connected to a USB port of a host device such as a laptop or other device (not shown). The USB dongle device 2900 may include two antennas, a first antenna 2903 and a second antenna 2905. The first antenna 2903 is formed at a distal end of the USB dongle device 2900 and the second antenna 2905 is formed at a side edge adjacent to the USB connector 2901.

In FIG. 29A, the USB dongle device 2900 is made up of three substrates: a first substrate 2907, a second substrate 2909 and a third substrate 2911. The first substrate 2907 and the second substrate 2909 are each mounted vertically to the third substrate 2911. Elements of the first antenna 2903 are fabricated on the first substrate 2907 and the third substrate 2911. Elements of the second antenna 2905 are fabricated on the second substrate 2909 and the third substrate 2911. Fabricating portions of the first antenna 2903 elements and the second antenna 2905 elements on multiple substrates, such as on the first substrate 2907 and the second substrate 2909, can save space on the third substrate for other components to be mounted.

Referring again to FIG. 29A, the non-planar, L-shaped MTM antennas 2903, 2905 each have a cell patch 2951, 2953, respectively, that is polygonal in shape and extends from the third substrate 2911 to the vertical substrates 2907, 2909, respectively. A feed line 2957 associated with the first antenna 2903 is also formed on the third substrate 2911 and is electromagnetically coupled to the cell patch 2953 through a coupling gap 2971. A feed line 2955 associated with the second antenna 2905 is formed on the second substrate 2909 and extends to the third substrate 2911, and is electromagnetically coupled to the cell patch 2951 through a coupling gap 2973. A meander line may be added to the feed line in each of the two antennas to induce a monopole mode.

Referring to FIGS. 29A and 29B, a top via line 2959 associated with the second antenna 2905 is formed in second substrate 2909. The top via line 2959 is connected to a via 2963, formed in the third substrate 2911, and the cell patch 2951. The via 2963 is connected to a bottom via line 2917, as shown in FIG. 29B, which is connected to a bottom ground 2919. Thus, the cell patch 2951 of second antenna 2905 is coupled to the bottom ground 2919 through the top via line 2959, the via 2963, and the bottom via line 2917. A top via line 2961 associated with the first antenna 2903 is formed in first substrate 2907. The top via line 2961 is connected to a via 2965, formed in the third substrate 2911, and the cell patch 2953. The via 2965 is connected to a bottom via line 2916, as shown in FIG. 29B, which is connected to a bottom ground 2919. Thus, the cell patch 2953 of the first antenna 2907 is coupled to the bottom ground 2919 through the top via line 2961, the via 2965, and the bottom via line 2916.

In FIG. 29B, the bottom ground 2919 may be connected a top ground plane 2915 by using an array of vias (not shown) formed in the third substrate 2911 or by conductive lines formed along the perpendicular edge of third substrate 2911 to form a single ground plane. The via lines 2917 of both first antenna 2903 and second antenna 2905 are terminated on a bottom ground plane 2919 of the third substrate 2911 to maximize antenna efficiency.

Improved performance metrics for the USB connector 2901 when connected to a USB port of a host device (not shown) may be achieved when the ground plane of the USB dongle device 2900, which includes the two antennas 2903, 2905 and other RF and baseband circuitries, is isolated from the host device. Isolating the ground plane may be accomplished by implementing two small metal plates, top metal plate 2921 and bottom metal plate 2923, near the USB dongle connector 2901 that are separated from the top and bottom ground plane 2915, 2919, respectively, as shown in FIGS. 29A-29B. In addition to improved performance metrics, antenna performance of the USB dongle device 2900 may be made independent of the host device connected to the USB dongle device 2900 by using such an isolation technique.

As power for the USB dongle device 2900 is typically supplied by a host device, the DC connection from the USB connector 2901 to other components fabricated on third substrate may be needed. In the illustrated embodiment, an electrical component such as an inductor 2925 may be mounted between the top metal plate 2921 and the top ground plane 2915 to support DC bias conducted from the host device to the USB connector 2901. The top metal plate 2921 and the bottom metal plate 2923 are also connected to each other through vias 2913. The shape and size of the top and bottom metal plates 2921, 2923 may be optimized to achieve the optimum antenna matching, antenna efficiency, isolation between two antennas 2903, 2909 and antenna far-field correlation.

Figure 30:
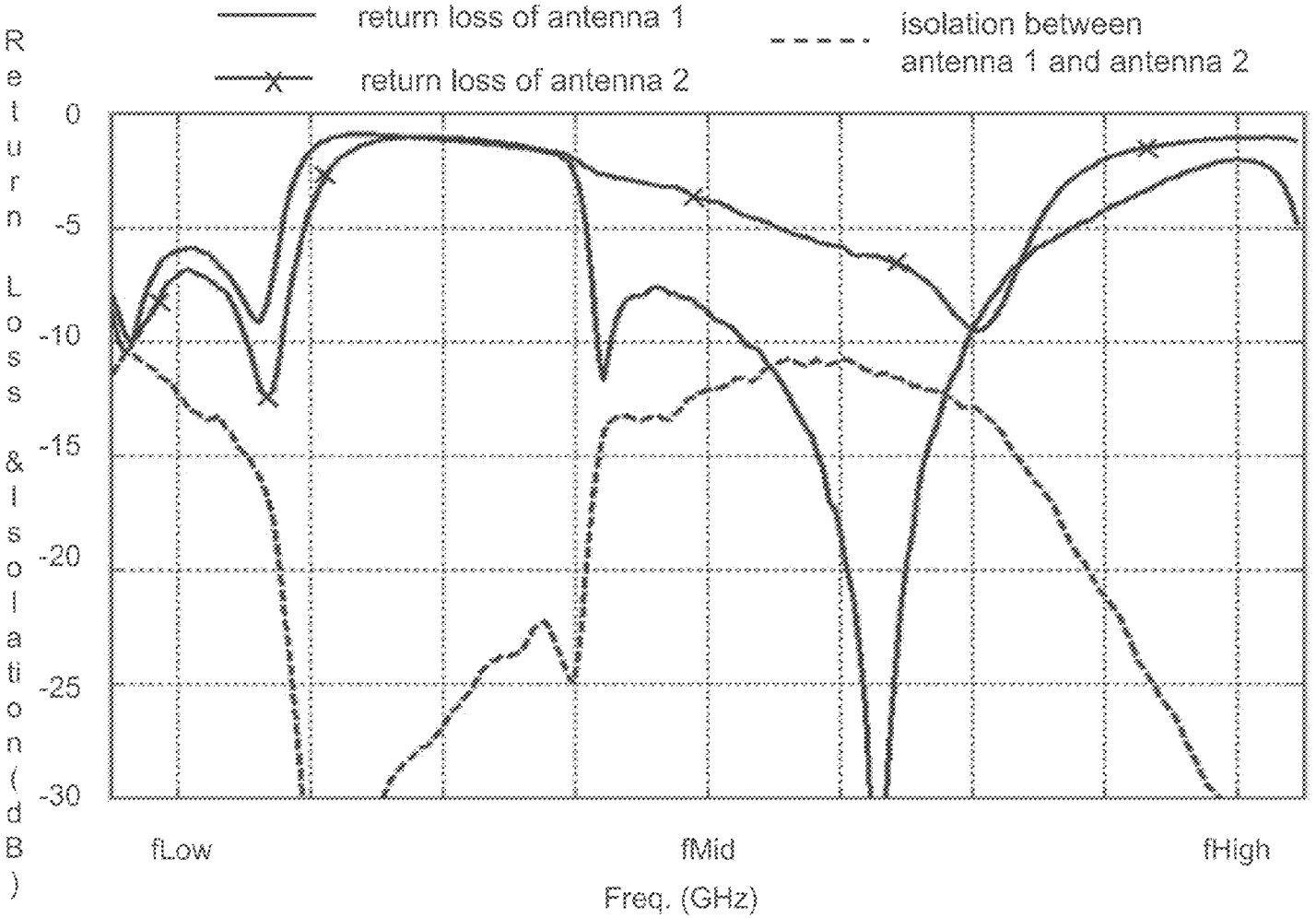
FIG. 30 illustrates return losses and isolation between antennas of FIGS. 29A-29C, according to example embodiments.

FIG. 30 illustrates the measured return loss and isolation between antenna 1 and antenna 2 of FIGS. 29A-29C, showing both antennas operate in the frequency range from 740 MHz to 900 MHz and from 1850 MHz to 1990 MHz.

Figure 31:
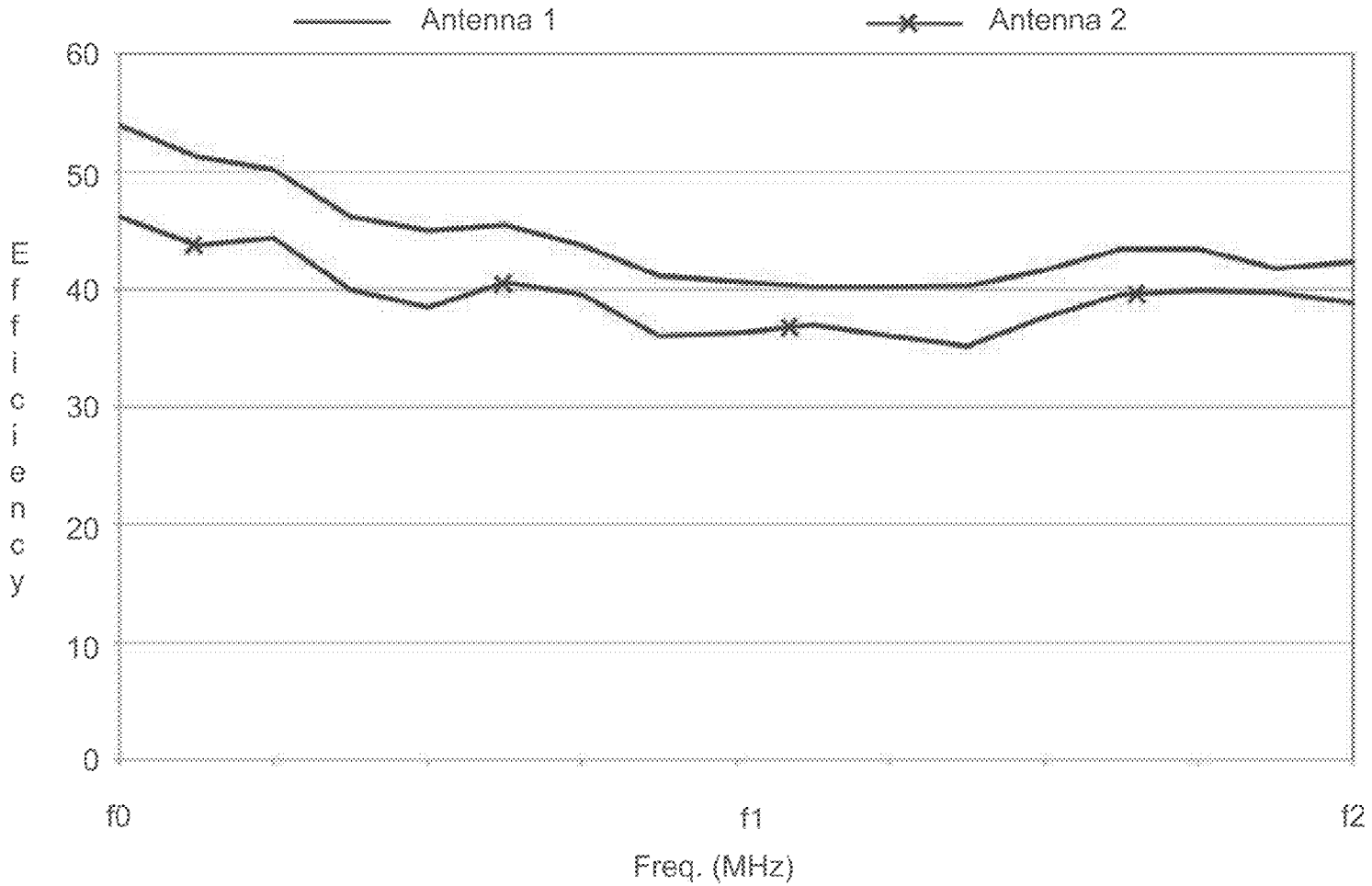
FIG. 31 illustrates antenna efficiencies of the antennas of FIGS. 29A-29C at the lower band, according to example embodiments.
Figure 32:
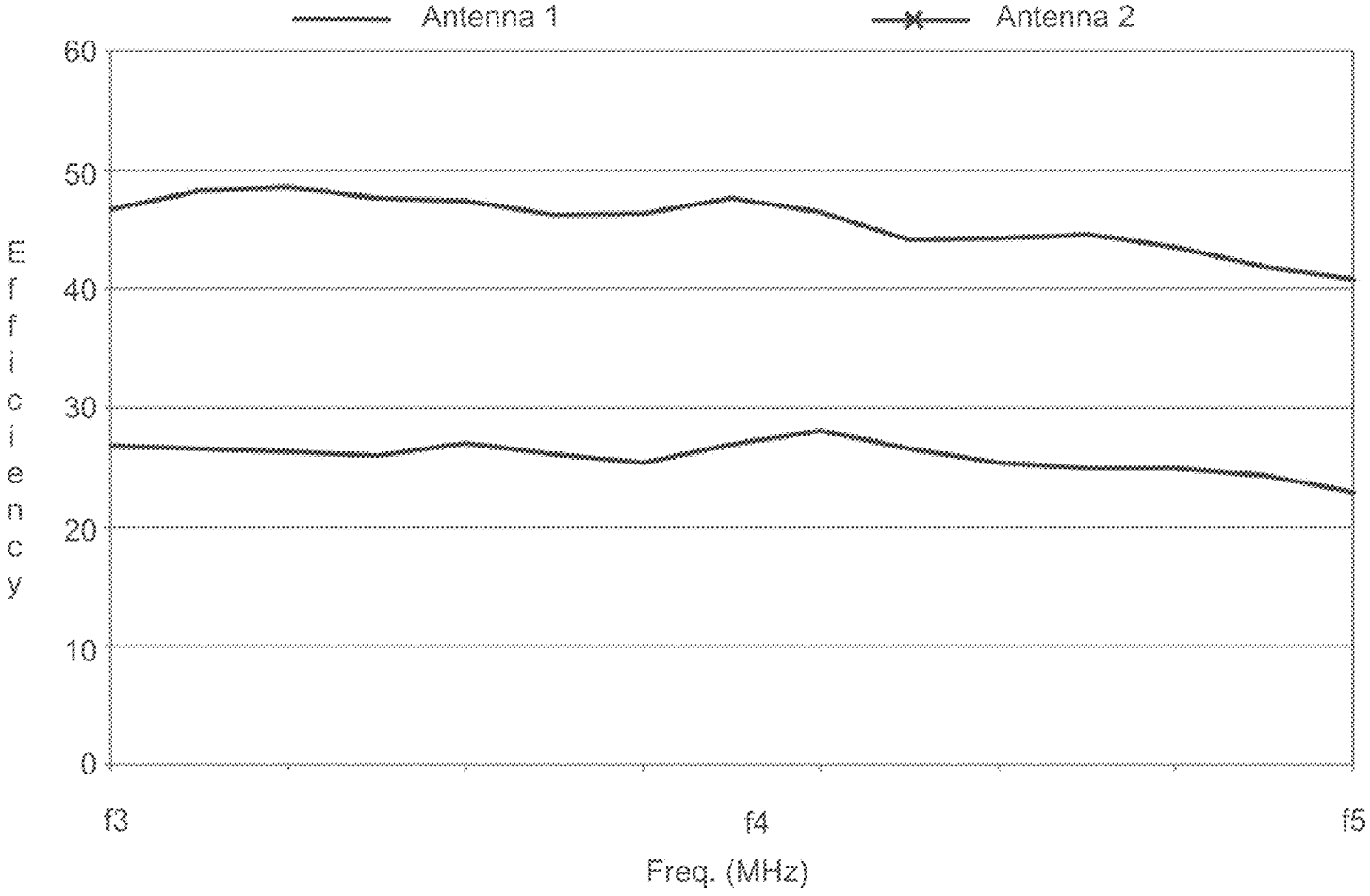
FIG. 32 illustrates antenna efficiencies of the antennas of FIGS. 29A-29C at the upper band, according to example embodiments.

FIG. 31 and FIG. 32 show the measured antenna efficiencies of antenna 1 and antenna 2 at lower and upper bands, respectively.

The isolated ground techniques and associated structures described in this document present antenna configurations that represent non-MTM antenna designs, planar MTM antenna designs, multilayer MTM antenna designs, and non-planar MTM antenna designs, as described hereinabove. Other isolated ground techniques may be implemented to the antenna configurations described above which involve different types of electrical components acting as frequency-dependent connectors. For example, although the cited examples of electrical components included the use of inductors, other components may include other passive components such as capacitors or a combination of capacitors and inductors. For example, when a capacitor is attached in between the ground plane and the metal plate, a high frequency signal can propagate between circuits mounted on the ground plane and the metal plate. Due to the high impedance the capacitor presents, DC and low frequency signals are blocked at the two ends of the capacitor. Thus, the design of the antenna and other RF circuitries may be modified based on the use of capacitors as frequency-dependent connectors.

Other implementations of frequency-dependent connectors may include multiple passive components such as inductors and capacitors, which are used in combination to connect the ground plane and the metal plate. For example, in one implementation, a metal plate may be connected to one end of the inductor and the other end of inductor is connected to one end of the capacitor. The other end of the capacitor can be then connected to the ground plane forming an L-C circuit. In this case, the DC and high frequency signal cannot pass through this L-C circuit and only intermediate frequency signals can propagate between the circuits mounting on the ground plane and the metal plate.

Based on different applications where different frequency signals are needed to propagate between the ground plane and metal plate, different configurations of the passive components may be implemented, and the antenna and other RF circuitries may be modified accordingly.

In addition, electrical components in these examples may include active component such as an RF switch, time-dependent switch, and pin diode. However, additional control circuits may be needed to determine the ON and OFF states of these active devices according to a dependent factor such as or frequency, time, or voltage threshold. For example, in one implementation of a device utilizing an active component connected to ground, an RF switch may be turned ON at a first frequency state to transmit an RF signal from the circuit on the ground plane to the circuit on the metal plate. In another frequency state, the RF switch may be turned OFF to prevent the RF signal from propagating to the metal plate which may reduce the SAR level of the antenna device.

While this document contains many specifics, these should not be construed as limitations on the scope of any invention or of what is claimed, but rather as descriptions of features specific to particular embodiments. Certain features that are described in this document in the context of separate embodiments can also be implemented in combination in a single embodiment. Conversely, various features that are described in the context of a single embodiment can also be implemented in multiple embodiments separately or in any suitable subcombination. Moreover, although features described above as acting in certain combination can in some cases be exercised for the combination, and the claimed combination is directed to a subcombination or variation of a subcombination.

Particular embodiments have been described in this document. Variations and enhancements of the described embodiments and other embodiments can be based on what is described and illustrated in this document.

What is claimed is:

1. A wireless device, comprising:

one or more antennas that transmit or receive one or more antenna signals at one or more radio frequency (RF) antenna frequencies;

an antenna circuit in communication with the one or more antennas, the antenna circuit generating the one or more antenna signals for transmission by the one or more antennas or receiving the one or more antenna signals from the one or more antennas;

a ground electrode structure to which the antenna circuit is connected to provide an electrical ground for the antenna circuit and for the one or more antennas;

an electrically conductive component located nearby the ground electrode structure without being in direct contact with the ground electrode structure; and a frequency-dependent connector that connects the electrically conductive component to the ground electrode structure and is structured to produce a low impedance to allow for transmission of a DC signal between the electrically conductive component and the ground electrode structure and to produce a high impedance at the one or more RF antenna frequencies to reduce or suppress transmission of the one or more antenna signals between the electrically conductive component and the ground electrode structure;

wherein the electrically conductive component is configured to provide a DC node for connection to an electrical unit to enable the electrical unit to function, the electrical unit isolated from the one or more antennas at the one or more RF antenna frequencies using the frequency-dependent connector;

wherein the ground electrode structure and the electrically conductive component comprise metallization regions located on at least one metallization layer, the at least one metallization layer patterned to form the one or more antennas; and wherein at least one of the one or more antennas includes a composite right and left handed (CRLH) metamaterial structure configured to exhibit a plurality of frequency resonances.

2. The device of claim 1, wherein the frequency-dependent connector includes an inductor.

3. The device of claim 1, wherein the frequency-dependent connector includes a transistor.

4. The device of claim 1, wherein the frequency-dependent connector includes a diode.

5. The device of claim 1, wherein the frequency-dependent connector includes a capacitor.

6. The device of claim 1, further comprising the electrical unit connected to the electrically conductive component.

7. The device of claim 6, wherein the electrical unit includes one or more key domes.

8. The device of claim 6, wherein the electrical unit includes a microphone.

9. The device of claim 1, wherein the at least one metallization layer comprises a metallization layer which is patterned to form the one or more antennas and the ground electrode structure.

10. The device of claim 1, wherein the at least one metallization layer comprises a plurality of metallization layers which are patterned to form the one or more antennas and the ground electrode structure.

11. The device of claim 1, wherein the ground electrode structure includes a single ground electrode.

12. The device of claim 1, wherein the ground electrode structure includes two or more ground electrodes.

13. The wireless device of claim 1, wherein the metamaterial structure comprises:

a cell patch;

a feed line having a distal end close to and capacitively coupled to the cell patch and a proximal end coupled to a feed port for directing the one or more antenna signals to and from the cell patch; and a via line coupling the cell patch to the ground electrode structure.

* * * * *